US007663615B2

(12) United States Patent
Shirasaki et al.

(10) Patent No.: US 7,663,615 B2
(45) Date of Patent: Feb. 16, 2010

(54) LIGHT EMISSION DRIVE CIRCUIT AND ITS DRIVE CONTROL METHOD AND DISPLAY UNIT AND ITS DISPLAY DRIVE METHOD

(75) Inventors: Tomoyuki Shirasaki, Higashiyamato (JP); Jun Ogura, Fussa (JP)

(73) Assignee: Casio Computer Co., Ltd., Tokyo (JP)

( * ) Notice: Subject to any disclaimer, the term of this patent is extended or adjusted under 35 U.S.C. 154(b) by 699 days.

(21) Appl. No.: 11/302,590

(22) Filed: Dec. 12, 2005

(65) Prior Publication Data

US 2006/0125740 A1 Jun. 15, 2006

(30) Foreign Application Priority Data

Dec. 13, 2004 (JP) ..... 2004-360105
Dec. 20, 2004 (JP) ..... 2004-368031
Dec. 21, 2004 (JP) ..... 2004-368850

(51) Int. Cl.
*G09G 5/00* (2006.01)

(52) U.S. Cl. ..... 345/204; 345/76; 345/55

(58) Field of Classification Search ..... 345/76, 345/204, 55

See application file for complete search history.

(56) References Cited

U.S. PATENT DOCUMENTS 7,365,713 B2 4/2008 Kimura
2003/0095087 A1 5/2003 Libsch et al.
2004/0080474 A1 4/2004 Kimura
2004/0246212 A1 12/2004 Kobayashi et al.
2005/0030264 A1* 2/2005 Tsuge et al. ..... 345/76
2006/0125740 A1 6/2006 Shirasaki et al.
2006/0244687 A1 11/2006 Fish et al.
2007/0120795 A1 5/2007 Uchino et al.

FOREIGN PATENT DOCUMENTS

EP 1 434 193 A1 * 6/2004
EP 1 632 930 A1 3/2006

(Continued)

OTHER PUBLICATIONS

Chinese Office Action (and English language translation thereof) dated Feb. 15, 2008, issued in a counterpart Chinese Application.
Japanese Office Action (and English translation thereof) dated Jun. 18, 2008, issued in counterpart Japanese Application No. 2004-360105.

(Continued)

*Primary Examiner*—Richard Hjerpe
*Assistant Examiner*—Leonid Shapiro
(74) *Attorney, Agent, or Firm*—Frishauf, Holtz, Goodman & Chick, P.C.

(57) ABSTRACT

A light emission drive circuit includes an electric charge accumulating section for accumulating electric charges on the basis of a gradation sequence signal designating a luminance gradation sequence. A light emission control section flows a light emission drive current having a current value in accordance with an amount of the electric charges accumulated in the electric charge accumulating section. A writing control section controls a supplying state of the electric charges based on the gradation sequence signal to the electric charge accumulating section on the basis of a first control signal. A voltage control section controls a drive voltage for operating the light emission controlling section on the basis of a second control signal.

15 Claims, 23 Drawing Sheets

FOREIGN PATENT DOCUMENTS

| | | | |
|---|---|---|---|
| JP | 8-330600 | A | 12/1996 |
| JP | 2003-173165 | A | 6/2003 |
| JP | 2003-202834 | A | 7/2003 |
| JP | 2006-171109 | A | 6/2006 |
| WO | WO 03/023752 | A1 | 3/2003 |
| WO | WO 2004/088624 | A1 | 10/2004 |

OTHER PUBLICATIONS

Japanese Office Action (and English translation thereof) dated Jun. 18, 2008, issued in counterpart Japanese Application No. 2004-368031.

Japanese Office Action (and English translation thereof) dated Jun. 18, 2008, issued in counterpart Japanese Application No. 2004-368850.

* cited by examiner

LIGHT EMISSION DRIVE CIRCUIT AND ITS DRIVE CONTROL METHOD AND DISPLAY UNIT AND ITS DISPLAY DRIVE METHOD

CROSS-REFERENCE TO RELATED APPLICATIONS

This application is based upon and claims the benefit of priority from prior Japanese Patent Applications No. 2004-360105, filed Dec. 13, 2004; No. 2004-368031, filed Dec. 20, 2004; and No. 2004-368850, filed Dec. 21, 2004, the entire contents of all of which are incorporated herein by reference.

BACKGROUND OF THE INVENTION

1. Field of the Invention

The present invention relates to an emission drive circuit and its drive control method and a display unit and its display drive method. Particularly, the present invention relates to a light emission drive circuit that can apply a current control type (or a current drive type) of light emission element emitting light at a predetermined luminance gradation sequence by supplying a current in accordance with the display data to plural display panels (pixel arrays) and its drive control method, and a display unit provided to each display pixel and its display drive method.

2. Description of the Related Art

In recent years, as a monitor and a display of a personal computer and a video system, a display device in place of a conventional display unit applying a conventional cathode-ray tube (CRT) has been widely used. Particularly, a liquid crystal display (LCD) has been rapidly widespread because it can be made thinner, lighter, spacious, and lower-power consumption or the like, in comparison with the conventional display. In addition, a relatively small liquid crystal display has been also widely applied as a display device that has been remarkably widespread in recent years such as a cellular phone, a digital camera, and a personal digital assistance (PDA).

As a next-generation display device (display) following such a liquid crystal display, a full-scale commercial viability and diffusion of a light emission element type of display device, in which an organic electro luminescence (hereinafter, abbreviated as "an organic EL element") and an inorganic electro luminescence (hereinafter, abbreviated as "an inorganic EL element") or a light emission element (a self-luminous type of a display pixel) such as a light emission diode (LED) are arranged in a matrix, has been expected.

Particularly, in comparison with the above-described liquid crystal display, the light emission element type of display applying an active matrix drive system has a higher display response speed, no viewing angle dependency, a high luminance, a high contrast, and a high resolution of a display image quality or the like. Further, the light emission element type of display does not need a back light as the liquid crystal display. Therefore, the light emission element type of display has a very superior characteristic such that it can be made further thinner and lighter and a low-power consumption is possible.

In such a light emission element type of display, various drive control mechanisms and control methods for controlling the operation of the light emission element (the light emission state) are suggested. For example, as described in Jpn. Pat. Appln. KOKAI Publication No. 8-330600, there has been known a configuration including a drive circuit provided with a plurality of switching elements for light-emission-drive controlling the light emission element (hereinafter, abbreviated as "a light emission drive circuit") for each display pixel to compose a display panel in addition to the above-described light emission element.

FIG. 22 is a schematic block diagram showing a substantial part of a voltage control active matrix light emission element type of display according to the prior art. FIG. 23 is an equivalent circuit diagram showing a constitutional example of a display pixel (a light emission drive circuit and a light emission element) that can be applied to a light emission element type of display according to the prior art. Here, in FIG. 23, the circuit configuration provided with an organic EL element as the light emission element is shown.

An active matrix type of organic EL display unit described in Jpn. Pat. Appln. KOKAI Publication No. 8-330600, as roughly illustrated in FIG. 22, is configured so as to comprise: a display panel 110P in which a plurality of display pixels EMp are arranged in a matrix in the vicinity of each intersecting point of a plurality of scan lines (a selection line; a signal line in a Y direction) SLp arranged in row and column directions respectively and a data line (a signal line; a signal line in a X direction) DLp; a scan driver (a Y directional peripheral drive circuit) 120P connected to each scan line SLp; and a data driver (a X directional peripheral drive circuit) 130P connected to each data line DL.

Each of display pixels EMp, as shown in FIG. 23, is configured so as to have: a light emission drive circuit DCp including a thin film transistor (TFT) Tr 111 in which a gate terminal is connected to the scan line SLp and a source terminal and a drain terminal are connected to the data line DL and a contact point N111, respectively, and a thin film transistor Tr 112 in which the gate terminal is connected to the contact point N111 and a predetermined power source voltage Vdd is applied to the source terminal; and an organic EL element (a current control type of a light emission element) OEL in which an anode terminal is connected to the drain terminal of a thin film transistor Tr 112 of the light emission drive circuit DCp and a ground potential Vgnd that is a lower potential than the power source voltage Vdd is applied to a cathode terminal. Here, in FIG. 23, reference symbol Cp denotes a condenser to be formed between the gate sources of the thin film transistor Tr 112.

In the display unit including the display panel 110P configured by the display pixel EMp having such a structure, first, an on-level scan signal voltage Ssel is sequentially applied from the scan driver 120P to each scan line SLp, whereby the thin film transistor Tr 111 of the display pixel EMp (the light emission drive circuit DCp) for each row is turned on and the display pixel EMp is set at a selection state.

By applying a gradation sequence signal voltage Vpix in accordance with the display data to the data line DLp of each row by a data driver 130P in synchronization with this selection timing, a potential corresponding to the gradation sequence signal voltage Vpix is applied to the contact point N111 (namely, the gate terminal of the thin film transistor Tr 112) via the thin film transistor Tr 111 of each display pixel EMp (the light emission drive circuit DCp).

Thereby, the film transistor Tr 112 is turned on in a conducting state in accordance with the potential of the connect point N111 (namely, a conducting state in accordance with the gradation sequence signal voltage Vpix). Then, a predetermined light emission drive current is supplied from the power source voltage Vdd to the ground potential Vgnd via the thin film transistor Tr 112 and the organic EL element OEL, and the organic EL element OEL performs the light emission operation at a luminance gradation sequence in accordance with the display data (the gradation sequence signal voltage Vpix).

Next, by applying an off-level scan signal voltage Ssel to the scan line SLp from the scan driver 120P, the thin film transistor Tr 111 of the display pixel EMp for each row is turned off, the display pixel EMp is set at a no-selection state, and the data line DLp and the light emission drive circuit DCp are electrically shielded. In this case, when the potential applied to the gate terminal (the contact point N111) of the thin film transistor Tr 112 is kept in the condenser Cp, a predetermined potential is applied between the gate sources of this thin film transistor Tr 112, and this results in that the thin film transistor Tr 112 is kept in the on state.

Accordingly, as same as the light emission operation in the above-described selection state, a predetermined light emission drive current is supplied from the power source voltage Vdd to the organic EL element OEL via the thin film transistor Tr 112 and the light emission operation continues. The light emission operation is controlled so as to be continued, for example, on one frame till the gradation sequence signal voltage Vpix corresponding to the next display data is applied (written) in the display pixel EMp of each row.

Such a voltage drive control method is called as a voltage gradation sequence designation system (or a voltage gradation sequence designation driving) because the current value of the light emission drive current to be supplied to the organic EL element OEL is controlled by controlling the voltage value of the voltage (the gradation sequence signal voltage Vpix) to be applied to each display pixel EMp (specifically, the gate terminal of the thin film transistor Tr 112 of the light emission drive circuit DCp) so as to perform the light emission operation at a predetermined luminance gradation sequence.

The display unit in which the light emission drive circuit corresponding to the voltage gradation sequence designation system is provided to each display pixel involves the following problem.

In the light emission drive circuit DCp as shown in FIG. 23, a current path is connected to the organic EL element OEL in series and the operation property (particularly, the threshold voltage value property) of the thin film transistor Tr 112 for the light driving to supply the light drive current corresponding to the display data (the gradation sequence signal voltage) is changed (temporarily changed) depending on the usage time or the like. In such a case, the current value of the light emission drive current (the current between the source and the drain) flowing between the source and the drain at the predetermined gate voltage (the potential of the contact point 111) is varied (for example, decreased). For this reason, it becomes difficult to stably realize the light emission operation at the appropriate luminance gradation sequence in accordance with the display data for a long time.

In addition, in the case where the element properties (the threshold voltage property) of the thin film transistors Tr 111 and 112 within the display panel 110P are variable for each light emission drive circuit DCp or in the case where the element properties of the thin film transistors Tr 111 and 112 are variable for each display panel 110P depending on a production lot, the above-described variation of the current value of the light emission drive current becomes large in the light emission drive circuit of the voltage gradation sequence designation system. For this reason, the appropriate gradation sequence control cannot be carried out and the display image quality is lowered.

BRIEF SUMMARY OF THE INVENTION

An object of the present invention is to provide an emission drive circuit capable of realizing the operation for light-emission driving a light emission element at an appropriate luminance gradation sequence in accordance with the display data by supplying a light emission drive current having a current value in accordance with the display data and its drive control method and a display unit having a good display image quality and its display drive method.

According to a first aspect of the present invention, there is provided a light emission drive circuit for supplying a light emission drive current to make a light emission element perform light emission, comprising:

an electric charge accumulating section for accumulating electric charges on the basis of a gradation sequence signal designating a luminance gradation sequence;

a light emission control section for flowing a light emission drive current having a current value in accordance with an amount of the electric charges accumulated in the electric charge accumulating section;

a writing control section for controlling a supplying state of the electric charges based on the gradation sequence signal to the electric charge accumulating section on the basis of a first control signal; and a voltage control section for controlling a drive voltage for operating the light emission controlling section on the basis of a second control signal.

According to a second aspect of the present invention, there is provided a light emission circuit comprising:

a selection line;

a hold line;

a data line;

a supplying voltage line;

a hold transistor having a gate electrically connected to the hold line, and a current path;

a drive transistor having a gate and a current path, the gate of the drive transistor being electrically connected to one end of the current path of the hold transistor and one end of the current path of the drive transistor being connected to the supplying voltage line; and a selection transistor having a gate and a current path, the gate of the selection transistor being electrically connected to the selection line, one end of the current path of the selection transistor being connected to the other end of the current path of the drive transistor, and the other end of the current path of the selection transistor being connected to the data line.

According to a third aspect of the present invention, there is provided a drive control method of a light emission drive circuit, which supplies a light emission drive current to a light emission element to make the light emission element perform the light emission, comprising:

setting a first potential difference equivalent to a threshold value of a transistor element, or a first potential difference equivalent to the minimum luminance voltage necessary for generating the light emission drive current required for making the light emission element perform the light emission operation at the minimum luminance gradation sequence between a gate and a source of a transistor element to supply the light emission drive current to the light emission element;

applying a gradation sequence signal to make the light emission element perform the light emission operation at a luminance gradation sequence to the transistor element and setting a second potential difference in accordance with the luminance gradation sequence between the gate and the source of the transistor element; and turning on the transistor element at a predetermined conducting state on the basis of the second potential difference, generating the light emission drive current having a current value in accordance with the luminance gradation sequence, and supplying it to the light emission element.

According to a fourth aspect of the present invention, there is provided a display unit comprising:

a plurality of display pixels each of which includes a light emission element and a light emission drive circuit having an electric charge accumulating section for accumulating electric charges based on a gradation sequence signal to designate a luminance gradation sequence in accordance with display data, a light emission control section for generating a light emission drive current having a predetermined current value in accordance with the electric charges accumulated in the electric charge accumulating section and supplying the light emission drive current to the light emission element, a writing control section for controlling the supplying state of the electric charges based on the gradation sequence signal to the electric charge accumulating section, and a voltage control section for controlling a drive voltage for making the light emission control section perform the operation, respectively;

a selection line in which a writing control signal for controlling the operation state of the writing control section of the each display pixel is applied;

a hold line in which a voltage control signal for controlling the operation state of the voltage control section of the each display pixel is applied; and a data line to which the gradation sequence is supplied.

According to a fifth aspect of the present invention, there is provided a display having:

a selection line;

a hold line;

a data line;

a supplying voltage line;

a hold transistor, in which a gate is connected to the hold line;

a drive transistor having a gate and a current path, the gate of the drive transistor being connected to one end of a current path of the hold transistor and one end of the current path of the drive transistor beings connected to the supplying voltage line;

a selection transistor having a gate and a current path, the gate of the selection transistor being connected to the selection line, one end of a current path of the selection transistor being connected to the other end of the current path of the drive transistor, and the other end of the current path of the selection transistor being connected to the data line;

a light emission element which is connected to the other end side of the current path of the drive transistor;

a selection driver which outputs a selection signal to the selection line;

a hold driver which outputs a hold signal to the hold line;

a data driver which supplies a gradation sequence signal to the data line; and a supplying voltage driver which outputs a supplying voltage to the supplying voltage line.

According to a sixth aspect of the present invention, there is provided a display drive method of a display unit which comprises a display panel made by a plurality of display pixels and makes the each display pixel perform the light emission operation at a predetermined luminance gradation sequence by supplying a gradation sequence signal designating a luminance gradation sequence in accordance with the display data to the each display pixel, and displays desired image information on the display panel, the method comprising:

setting at least part of the plural display pixels at a selection state, and setting a first potential difference equivalent to a threshold voltage of the transistor element or a first potential difference equivalent to the minimum luminance voltage necessary for generating the light emission drive current required for making the light emission element perform the light emission operation at the minimum luminance gradation sequence between one end of a gate and one end of a current path of a transistor element for supplying a light emission drive current to a current controlled type of a light emission element provided in the each display pixel;

sequentially setting the display pixel for each row of the display panel at a selection state, sequentially applying a gradation sequence signal for making the light emission element of the each display pixel perform the light emission operation at a predetermined luminance gradation sequence in accordance with the display data, and setting a second potential difference in accordance with the luminance gradation sequence between a gate and one end of a current path of the transistor element; and setting at least part of the plural display elements arranged on the display panel at a no-selection state, turning on the transistor element of the each display element on the basis of the second potential difference, and individually generating the light emission drive current having a current value in accordance with the luminance gradation sequence for the each light emission element and supplying the light emission current to the each light emission element.

The light emission control section may have a drive transistor including a current path and a control terminal, in which a current value of the light emission drive current is set due to a potential difference between the control terminal and one end of the current path.

The light emission control section may have a drive transistor including a current path and a control terminal, the drive transistor flowing the light emission drive current of the current value, which is based on the current value of the writing current flowing through the current path in a light emission operation time period as the gradation sequence signal in a writing operation time period.

The light emission control section may have a drive transistor including a current path and a control terminal, the drive transistor applying a voltage that attains to a saturated range to one end and the other end of a current path in a light emission operation time period.

A precharge voltage exceeding the threshold of the light emission control section may be applied to the electric charge accumulating section in a period of time of the precharge operation.

The voltage setting section may remain a predetermined electric charge in the light emission control section by partially discharging the electric charges accumulated in the electric charge accumulating section on the basis of the precharge voltage in a period of time of the correction operation.

The voltage setting section may further accumulate the electric charges in accordance with the gradation sequence current in the electric charge accumulating section after the period of time of the correction operation.

The voltage setting section may be provided with writing control section for controlling the supplying state of the electric charges on the basis of the gradation sequence signal to the electric charge accumulating section and voltage control section for controlling the state of applying the voltage to the control terminal of the drive transistor.

The voltage setting section may have a precharge voltage applying section for applying the precharge exceeding the threshold of the light emission control section to the electric charge accumulating section and writing control section for controlling the state of supplying the electric charges on the basis of the gradation sequence signal to the electric charge accumulating section. In addition, the precharge voltage and the gradation sequence signal may be selectively applied to the electric charge accumulating section via the writing control section.

The voltage setting section may have a selection transistor, of which one end of the current path is connected to one end of the electric charge accumulating section.

The voltage setting section may have a holding transistor, of which one end of the current path is connected to the control terminal of the drive transistor and the other end of the electric charge accumulating section.

The voltage setting section may have a selection transistor, of which one end of the current path is connected to one end of the electric charge accumulating section and one end of the drive transistor and the other end of the current path is connected to a gradation sequence signal line through which the gradation sequence signal is flowing and a holding transistor, of which one end of the current path is connected to the control terminal of the drive transistor and the other end of the electric charge accumulating section.

The selection transistor may be operated by a first control signal and may be operated by the second signal that is different from the first control signal.

According to an eighth aspect of the present invention, there is provided a drive control method of a light emission drive circuit for flowing a light emission drive current to make a light emission element to perform light emission, comprising:

a first potential difference step of setting a first potential difference on the basis of a precharge voltage that is larger than the minimum luminance gradation sequence necessary for generating the light emission drive current required for making the light emission element to perform the light emission operation at the minimum luminance gradation sequence or a threshold potential difference between the control terminal and one end of a current path of the drive transistor in which a current value of the light emission drive current is set by a potential difference between a control terminal and one end of the current path;

a second potential difference step of setting a second potential difference equivalent to the minimum luminance potential difference or the threshold potential difference between the control terminal and one end of the current path of the drive transistor by turning on the drive transistor on the basis of the first potential difference; and a third potential difference step of setting a third potential difference equivalent to the luminance gradation sequence between the control terminal and one end of the current path of the drive transistor by applying a gradation sequence signal for making the light emission element to perform the light emission operation at a predetermined luminance gradation sequence and flowing the gradation sequence signal to the current path of the drive transistor.

The step for setting the third electric potential difference may set the third electric potential difference by applying the gradation sequence current having a predetermined current value for making the light emission element to perform the light emission operation at the predetermined luminance gradation sequence as the gradation sequence signal to add and accumulate the electric charges based on the gradation sequence current to the electric charges due to the second electric potential between one the control terminal of the drive transistor and one end of the current path.

According to a ninth aspect of the present invention, there is provided a A display unit comprising:

a light emission element; and a plurality of display pixels including a light emission drive circuit having electric charge accumulating section for accumulating electric charges based on a gradation sequence to designate a luminance gradation sequence in accordance with the display data, light emission control section for generating a light emission drive current having a predetermined current value in accordance with the electric charges accumulated in the electric charge accumulating section and supplying the light emission drive current to the light emission element, and voltage setting section for partially discharging the electric charges accumulated in the electric charge accumulating section in order for the light emission control section to set the light emission drive current at the predetermined current value, respectively.

The light emission control section may be provided with a current path and a control terminal and may have a drive transistor in which a current value of a light emission drive current is set due to an electric potential difference between the control terminal and one end of the current path.

The light emission control section may be provided with a current path and a control terminal and may have a drive transistor for flowing the light emission drive current in the light emission operation time period, which is based on the current value of the written current flowing through the current path as the gradation sequence signal in the writing operation time period.

The light emission control section may be provided with the current path and the control terminal and may have a drive transistor in which a voltage saturated in a period of light emission operation is applied to one end and the other end of the current path.

To the electric charge accumulating section, a precharge voltage exceeding the threshold of the drive transistor may be applied in a period of time of the precharge operation.

The voltage setting section may remain a predetermined electric charge in the drive transistor by partially discharging the electric charges accumulated in the electric charge accumulating section on the basis of the precharge voltage in a period of time of the correction operation.

The voltage setting section may remain a predetermined electric charge in the drive transistor by partially discharging the electric charges accumulated in the electric charge accumulating section on the basis of the precharge voltage in a period of time of the correction operation.

The voltage setting section may further accumulate the electric charges in accordance with the gradation sequence current in the electric charge accumulating section after the period of time of the correction operation.

The voltage setting section may have a precharge voltage applying section for applying the precharge exceeding the threshold of the drive transistor to the electric charge accumulating section and writing control section for controlling the state of supplying the electric charges on the basis of the gradation sequence signal to the electric charge accumulating section and the precharge voltage and the gradation sequence signal may be selectively applied to the electric charge accumulating section via the writing control section.

The voltage setting section may have a selection transistor, of which one end of the current path is connected to one end of the electric charge accumulating section.

In the voltage setting section, one end of the current path is connected to the control terminal of the drive transistor and the other end of the electric charge accumulating section. A The voltage setting section may have a selection transistor, of which one end of the current path is connected to one end of the electric charge accumulating section and one end of the drive transistor and the other end of the current path is connected to a gradation sequence signal line through which the gradation sequence signal is flowing and a holding transistor, of which one end of the current path is connected to the control terminal of the drive transistor and the other end of the electric charge accumulating section.

The selection transistor may be operated by a first control signal and may be operated by the second signal that is different from the first control signal.

The display unit may be provided with gradation sequence signal supply section for supplying the gradation sequence signal to the each display pixels via a gradation sequence signal line connected to the voltage setting section and in the light emission drive circuit of the each display pixels, the gradation sequence signal applied to the gradation sequence signal line may be applied to the electric charge accumulating section via the voltage setting section.

The gradation sequence signal supply section may be provided with section for generating the precharge voltage exceeding the threshold of the light emission control section and applying it to the gradation sequence signal line and in the light emission circuit of the each display pixel, the precharge voltage applied to the gradation sequence signal line may be applied to the electric charge accumulating section via the voltage setting section.

The gradation sequence signal supply section may selectively apply the precharge voltage and the gradation sequence signal to the gradation sequence signal line.

The gradation sequence signal is a gradation sequence current having a predetermined current value for making the light emission element to perform the light emission operation at a desired luminance gradation sequence on the basis of the display data and the electric charges in accordance with the gradation sequence current may be accumulated in the electric charge accumulating section.

The voltage setting section may be provided with writing control section for controlling the state of supplying the electric charges to the electric charge accumulating section based on the gradation sequence signal and voltage control section for controlling the application state of the voltage to the control terminal of the drive transistor.

The voltage setting section may be further provided with a writing signal line in which a writing control signal for controlling the operational state of the writing control section and a voltage signal line to which a voltage control signal for controlling the operational state of the voltage control section of the each display pixel.

The voltage setting section may be further provided with writing drive section for applying the writing control signal to the writing signal line and voltage drive section for applying the voltage control signal to the voltage signal line.

The voltage setting section may be provided with power source drive section for applying the supplied voltage to the light emission control section.

According to a tenth aspect of the present invention, there is provided a display drive method of a display unit for making light emission elements of a plurality of display pixels to perform the light emission arranged in a row direction and a column direction, comprising:

a first potential difference step of setting a first potential difference on the basis of a precharge voltage that is larger than the minimum luminance gradation sequence necessary for generating the light emission drive current required for making the light emission element to perform the light emission operation at the minimum luminance gradation sequence or a threshold potential difference between the control terminal and one end of a current path of the drive transistor which sets the display pixel at a selection state and supplies a light emission drive current to the light emission element;

a second potential difference step of setting a second potential difference equivalent to the minimum luminance potential difference or the threshold potential difference between the control terminal and one end of the current path of the transistor element by turning on the drive transistor on the basis of the first potential difference;

a third potential difference step of setting a third potential difference equivalent to the luminance gradation sequence between the control terminal and one end of the current path of the drive transistor by applying a gradation sequence signal for making the light emission element to perform the light emission operation at a predetermined luminance gradation sequence and flowing the gradation sequence signal to the current path of the drive transistor; and a light emission step that the drive transistor flows the light emission drive current on the basis of the gradation sequence signal to the light emission element by applying a voltage so that a potential difference between one end and the other end of the current path is saturated to the other end of the current path of the drive transistor.

The first potential difference step may concurrently set a plurality of the display pixels at the selection state. The second potential difference step may concurrently set the plural rows of the display pixels at the no-selection state to set the second potential difference equivalent to the minimum luminance voltage. The third potential difference step may sequentially set the display pixel for each row at the selection state to sequentially flow the gradation sequence signal to the current path of the drive transistor. The light emission step may concurrently flow the light emission drive current to the plural rows of the light emission elements.

The step of setting the third potential difference at the each display pixel may add and accumulate the electric charges based on the gradation sequence current to the electric charges generated by the second potential difference to the control terminal of the transistor element and one end of the current path to set the third potential difference by applying the gradation sequence current having a predetermined current value for making the light emission element of the each display pixel at a desired luminance gradation sequence as the gradation sequence signal.

According to an eleventh aspect of the present invention, there is provided a light emission drive circuit, comprising:

light emission control means having a current path of flowing a light emission drive current from the current path;

electric charge accumulating means for accumulating electric charges in accordance with a current value of a current flowing through the light emission control means;

voltage setting means for flowing a current of a current value that allows the light emission element to perform the light emission operation at a predetermined luminance other than the no-light luminance gradation sequence and accumulating the electric charges equivalent to the predetermined luminance gradation sequence in the electric charge accumulating means; and gradation sequence setting means for discharging the electric charges equivalent to the predetermined luminance gradation sequence accumulated in the electric charge accumulating means on the basis of a no-light luminance gradation sequence signal till this electric charge becomes the electric charges such that the light emission element equivalent to the light emission drive current of the current value such that the light emission element is made into the no-light emission state or the electric charges such that the light emission drive current does not flow.

The gradation sequence setting means may selectively supply the no-light emission luminance gradation sequence signal and a gradation sequence signal equivalent to the luminance gradation sequence other than the no-light emission luminance gradation sequence.

It is preferable that the no-light emission luminance gradation sequence signal is a voltage signal of a predetermined voltage value and a gradation sequence signal equivalent to the luminance gradation sequence other than the no-light emission luminance gradation sequence is a current signal of a predetermined current value.

The gradation sequence setting means may flow a precharge current of an enough current value to make the light emission element to perform the light emission operation at a higher luminance gradation sequence than the predetermined luminance gradation sequence other than the no-light emission luminance gradation sequence in a period of time of precharge to the light emission control means so as to accumulate the electric charges equivalent to the high luminance gradation sequence in the electric charge accumulating means.

The voltage setting means may flow a correction current of an enough current value to make the light emission element to perform the light emission operation at the predetermined luminance gradation sequence other than the no-light emission luminance gradation sequence in a period of time of correction operation to the light emission control means so as to partially discharge the electric charges accumulated in the electric charge accumulating means.

The light emission control means may be provided with a control terminal and may have a drive transistor in which the current value of the light emission drive current is set due to the potential difference between the control terminal and one end of the current path.

The light emission control means may be provided with a control terminal and may have a drive transistor to flow the light emission drive current of the current value in a period of time of the light emission operation, which current value is based on the current vale of the writing current flowing through the current path as the gradation sequence signal in a period of time of the writing operation.

The light emission control means may be provided with a control terminal and may have a drive transistor, in which the voltage arriving at a saturation region is applied to one end of the current path and the other end thereof.

The voltage setting means may be provided with current control means connected between one end of the current path of the drive transistor and the gradation sequence setting means for controlling the current flowing through the current path of the drive transistor and drive transistor selection control means connected to the control terminal of the drive transistor for controlling the selection state of the drive transistor.

The current control means may have a selection transistor in which a control terminal is connected to a selection line and the drive transistor selection control means may have a holding transistor in which a control terminal is connected to a hold line.

The current control means may be operated by the first control signal and the drive transistor selection control means may be operated by the second control signal that is different from the first control signal.

According to a twelfth aspect of the present invention, there is provided a drive control method of a light emission drive circuit for flowing a light emission drive current to make a light emission element to perform light emission, comprising:

a first potential difference step of generating a first potential difference between the control terminal and one end of the current path of the drive transistor so that, in spite of a luminance gradation sequence signal, the current of the current value to make the light emission element to perform the light emission operation at a predetermined luminance gradation sequence other than the no-light emission luminance gradation sequence flows through a current path of the drive transistor in advance; and a second potential difference step of a current value between the control terminal and one end of the current path of the drive transistor generating the first potential difference in the first potential difference step takes a current value so that the light emission drive current from the drive transistor makes the light emission element into the no-light emission state on the basis of the no-light emission luminance gradation sequence signal.

The first potential difference step may flow a precharge current of an enough current value to make the light emission element to perform the light emission operation at a higher luminance gradation sequence than the predetermined luminance gradation sequence other than the no-light emission luminance gradation sequence in a period of time of precharge to the current path of the drive transistor and may include a precharge step to accumulate the electric charges equivalent to the high luminance gradation sequence between the control terminal of the drive transistor and one end of the current path.

The first potential difference step may flow a correction current of an enough current value to make the light emission element to perform the light emission operation at the luminance gradation sequence lower than the higher luminance gradation sequence in a period of time of correction operation to the current path of the drive transistor and may include correction step to partially discharge the electric charges accumulated between the control terminal of the drive transistor and one end of the current path.

According to a thirteenth aspect of the present invention, there is provided a display unit comprising:

a light emission element; and a plurality of display pixels comprising a light emission drive circuit having light emission control means for flowing a light emission drive current from the current path to the light emission element, electric charge accumulating means for accumulating electric charges in accordance with the current value of the current flowing the light emission control means, and voltage setting means for accumulating the electric charges equivalent to the predetermined luminance gradation sequence in the electric charge accumulating means, respectively; and gradation sequence setting means for supplying a no-light emission luminance gradation sequence signal to the display pixel and discharging the electric charges equivalent to the predetermined luminance gradation sequence accumulated in the electric charge accumulating means till the light emission element is made into the electric charges equivalent to the light emission drive current of the current value such that the light emission element is made into the no-light emission state or the electric charges so that the light emission drive current does not flow, wherein the display pixel comprises a light emission element and a light emission drive circuit, and the light emission drive circuit has the light emission control means, the electric charge accumulating means, and the voltage setting means. The display unit has the display pixels and the gradation segment setting means.

The display pixel may be provided with a light emission element and a light emission drive circuit. The light emission drive circuit preferably has electric charge accumulating means and voltage setting means and a display unit has a display pixel and gradation sequence setting means.

The gradation sequence setting means may selectively supply the no-light emission luminance gradation sequence signal and a gradation sequence signal equivalent to the luminance gradation sequence other than the no-light emission luminance gradation sequence to the display pixel via a data line.

The no-light emission luminance gradation sequence signal may be a voltage signal of a predetermined voltage value and a gradation sequence signal equivalent to the luminance gradation sequence other than the no-light emission luminance gradation sequence is a current signal of a predetermined current value.

The gradation sequence setting means may flow a precharge current of an enough current value to make the light emission element to perform the light emission operation at a higher luminance gradation sequence than the predetermined luminance gradation sequence other than the no-light emission luminance gradation sequence in a period of time of precharge to the light emission control means so as to accumulate the electric charges equivalent to the high luminance gradation sequence in the electric charge accumulating means.

The voltage setting means may flow a correction current of an enough current value to make the light emission element to perform the light emission operation at the predetermined luminance gradation sequence other than the no-light emission luminance gradation sequence in a period of time of correction operation to the light emission control means so as to partially discharge the electric charges accumulated in the electric charge accumulating means.

The light emission control means may be provided with a control terminal and may have a drive transistor in which the current value of the light emission drive current is set due to the potential difference between the control terminal and one end of the current path.

The light emission control means may be provided with a control terminal and may have a drive transistor to flow the light emission drive current of the current value in a period of time of the light emission operation, which current value is based on the current vale of the writing current flowing through the current path as the gradation sequence signal in a period of time of the writing operation.

The light emission control means may be provided with a control terminal and may have a drive transistor, in which the voltage arriving at a saturation region is applied to one end of the current path and the other end thereof.

The voltage setting means may be provided with current control means connected between one end of the current path of the drive transistor and the gradation sequence setting means for controlling the current flowing through the current path of the drive transistor and drive transistor selection control means connected to the control terminal of the drive transistor for controlling the selection state of the drive transistor.

The current control means may have a selection transistor in which a control terminal is connected to a selection line and the drive transistor selection control means may have a holding transistor in which a control terminal is connected to a hold line.

The current control means may be provided with a selection driver for outputting the selection signal to the current control means via the selection line and a holding driver for outputting the hold signal to the drive transistor selection means via the hold line.

The selection signal and the hold signal may be different from each other.

A supply voltage driver for supplying the supplying voltage to the other end of the current path of the light emission control means via a supply voltage line may be further provided.

The gradation sequence setting means may output a precharge voltage to flow the precharge current of an enough current value to make the light emission element to perform the light emission operation at a higher luminance gradation sequence than the predetermined luminance gradation sequence other than the no-light emission luminance gradation sequence to the current path of the light emission control means via a data line.

According to a fourteenth aspect of the present invention, there is provided a display drive method of a display unit for making light emission elements of a plurality of display pixels to perform the light emission arranged in a row direction and a column direction, comprising:

a first potential difference step of generating a first potential difference between the control terminal and one end of the current path of the drive transistor so that, in spite of a luminance gradation sequence signal, the current of the current value to make the light emission element of the display pixel to perform the light emission operation at a predetermined luminance gradation sequence other than the no-light emission luminance gradation sequence flows through a current path of the drive transistor in advance; and a second potential difference step of a current value between the control terminal and one end of the current path of the drive transistor generating the first potential difference in the first potential difference step takes a current value so that the light emission drive current from the drive transistor makes the light emission element into the no-light emission state on the basis of the no-light emission luminance gradation sequence signal.

The first potential difference step may flow a precharge current of an enough current value to make the light emission element to perform the light emission operation at a higher luminance gradation sequence than the predetermined luminance gradation sequence other than the no-light emission luminance gradation sequence in a period of time of precharge to the current path of the drive transistor and may include a precharge step to accumulate the electric charges equivalent to the high luminance gradation sequence between the control terminal of the drive transistor and one end of the current path.

The first potential difference step may flow a correction current of an enough current value to make the light emission element to perform the light emission operation at the luminance gradation sequence lower than the higher luminance gradation sequence in a period of time of correction operation to the current path of the drive transistor and may include correction step to partially discharge the electric charges accumulated between the control terminal of the drive transistor and one end of the current path.

The precharge step may concurrently set a plurality of the display pixels at the selection state, the correction step may concurrently set the plural rows of the display pixels at the no-selection state to set the first potential difference equivalent to the low luminance voltage.

The second potential difference step may sequentially flow the no-light emission luminance gradation sequence signal of a predetermined voltage value to the current path of the drive transistor of the display pixel to be made into a no-light emission state.

The second potential difference step may sequentially flow the luminance gradation sequence signal of a predetermined current value to the current path of the drive transistor of the display pixel to be made into a light emission state.

According to the present invention, it is possible to set the writing control means and the voltage control means at the state such that the light emission control means can flow the light drive current without delay.

According to the light emission drive circuit of the present invention, by controlling the selection transistor and the hold transistor respectively, it is possible to set the drive transistor so as to flow the light emission drive current without delay.

According to the drive control method of the light emission drive circuit, the light emission drive circuit is set at the threshold voltage of the transistor element or the voltage equivalent to the minimum luminance gradation sequence necessary for generating the light emission drive current when making the light emission element to perform the light emission operation at the minimum luminance gradation sequence in the step of setting the first potential difference in advance. Therefore, it is possible to easily set the light emission drive circuit at the appropriate luminance gradation sequence in accordance with the display data.

According to the display unit of the present invention, it is possible to set the writing control means and the voltage control means at the state such that the light emission control means can flow the light drive current without delay.

According to the display unit of the present invention, it is possible to set the drive transistor so as to flow the light emission drive current without delay by controlling the selection transistor and the hold transistor respectively.

According to the drive control method of the 1 the display unit of the present invention, the light emission drive circuit is set at the threshold voltage of the transistor element or the voltage equivalent to the minimum luminance gradation sequence necessary for generating the light emission drive current when making the light emission element to perform the light emission operation at the minimum luminance gradation sequence in the step of setting the first potential difference in advance. Therefore, it is possible to easily set the light emission drive circuit at the appropriate luminance gradation sequence in accordance with the display data.

DETAILED DESCRIPTION OF THE INVENTION

An emission drive circuit and its drive control method and a display unit and its display drive method according to the invention will be described in detail below with reference to the embodiment.

<Light Emission Drive Circuit>

First, the emission drive circuit and its drive control method according to the invention will be described with reference to the drawings below.

Figure 1:
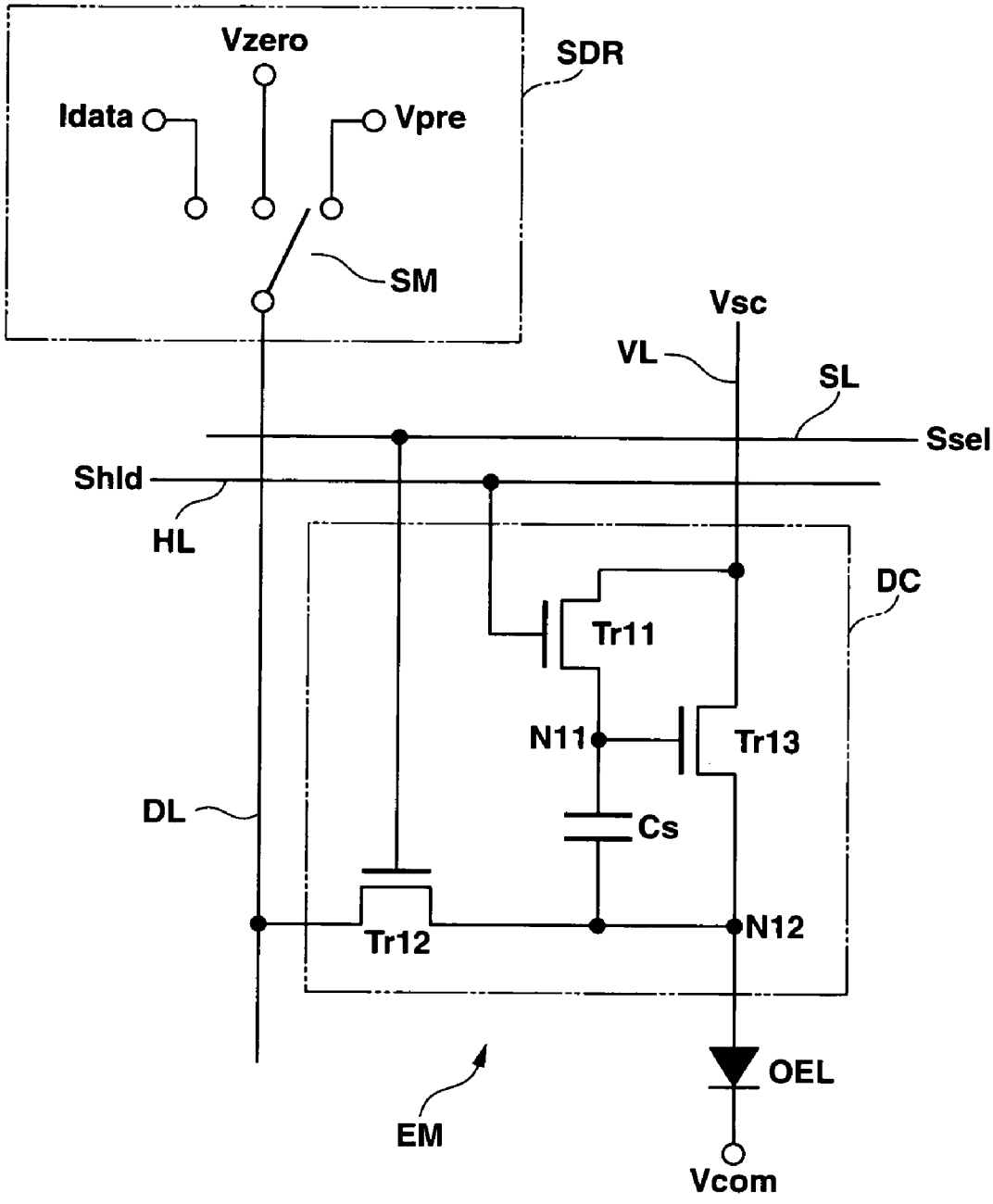
FIG. 1 is a circuit block diagram showing an embodiment of a light emission drive circuit according to the invention.

FIG. 1 is a circuit block diagram showing an embodiment of a light emission drive circuit according to the invention.

As shown in FIG. 1, for example, a light emission drive circuit DC according to the invention is configured so as to have: a selection transistor (writing control means) Tr 12 configured by a thin film transistor located in the vicinity of each intersecting point of a plurality of selection lines SL and a plurality of data lines DL arranged so as to be at right angles to each other, in which a gate terminal (a control terminal) is connected to a selection line SL and a source terminal and a drain terminal (one end and the other end of a current path) are connected to the data line DL and a contact point N12, respectively; a holding transistor (voltage control means) Tr 11 configured by a thin film transistor, in which a gate terminal is connected to a hold line HL arranged in parallel with the selection line SL, and a drain terminal and a source terminal are connected to a supplying voltage line VL to which a supplying voltage Vsc is outputted and a contact point N11, respectively; a drive transistor (light emission control means) Tr 13 configured by a thin film transistor in which a gate terminal is connected to the contact point N11, a drain terminal is connected to a supplying voltage line VL, and a source terminal is connected to a contact point N12, respectively; and a capacitor (electric charge accumulating means and a capacity element) Cs connected between the contact point N11 and the contact point N12 (namely, between the gate terminal and the source terminal of the drive transistor Tr 13). In an organic EL element (a current control type of a light emission element) OEL, an anode terminal is connected to the contact point N12 of the light emission drive circuit DC and a common voltage Vcom is applied to a cathode terminal. The common voltage Vcom is set at a potential equal to that of a selection voltage value Vs that is the supplying voltage Vsc in a time of period of the writing operation Twr (to be described later) or a potential higher than the selection voltage value Vs. Further, the common voltage Vcom is set at a lower potential than that of a light emission voltage value Ve that is the supplying voltage value Vsc in a time of period of the light emission operation Tem (to be described later).

Here, the capacitor Cs may be a parasitic capacitance formed between a gate and a source of the drive transistor Tr 13 or it may be made by further connecting a capacitance element between the contact point N11 and the contact point N12 in parallel in addition to the parasitic capacitance. In addition, the transistors Tr 11 to Tr 13 are not particularly limited. However, an n channel type of amorphous silicon TFT can be applied by composing the all of the transistors Tr 11 to Tr 13 by an n channel type of a thin firm transistor. In this case, by applying an amorphous silicon manufacturing technology that has been already established, it is possible to manufacture a light emission drive circuit of which operational property is stable, in a relatively easy manufacturing process. In addition, a light emission element of which light emission is driven by a light emission drive circuit DC is not limited to the organic EL element OEL shown in FIG. 1. The light emission element may be other light emission element such as a light emission diode if it is a current control type of a light emission element.

In other words, the light emission drive circuit DC according to the embodiment is configured in such a manner that, on the basis of a signal level of a control signal (a hold signal and a selection signal to be described later) to be applied to the hold line HL and the selection line SL individually, the hold transistor Tr 11 and the selection transistor Tr 12 are operated individually being turned on and off.

As shown in FIG. 1, the light emission drive circuit DC according to the embodiment is configured with a signal drive circuit SDR connected to the data line DL, which signal drive circuit SDR is provided with means for selectively supplying any of a gradation sequence current Idata that the organic EL element OEL emits the light at a desired luminance gradation sequence or a no-light emission display voltage (a gradation sequence voltage) Vzero that the organic EL element OEL does not emit a light and becomes the darkest display (a black display) to the light emission drive circuit DC as a gradation sequence signal for making the organic EL element OEL to perform the light emission operation at a luminance gradation sequence and means for supplying a precharge voltage Vpre of which potential is sufficiently lower than a selection voltage value Vs at a period of time of the writing operation Twr to the light emission drive circuit DC as a control voltage for correcting an element property (a threshold voltage property) of the above-described drive transistor Tr 13 before the operation of writing the gradation sequence signal. Here, as described in a drive control method to be described later, the signal drive circuit SDR is provided with switch means SM that is switch-controlled so that the gradation sequence signal of the gradation sequence current Idata or the no-light emission display voltage Vzero is supplied to the data line DL at a period of time of the writing operation Twr and the precharge voltage Vpre is supplied to the data line DL at a period of time of the precharge operation Tpre to be described later.

<Drive Control Method of Light Emission Drive Circuit (Gradation Display: (1))

Next, a first example of a drive control method of the light emission drive circuit having the above-described structure (the gradation sequence display operation) will be described below.

Figure 2:
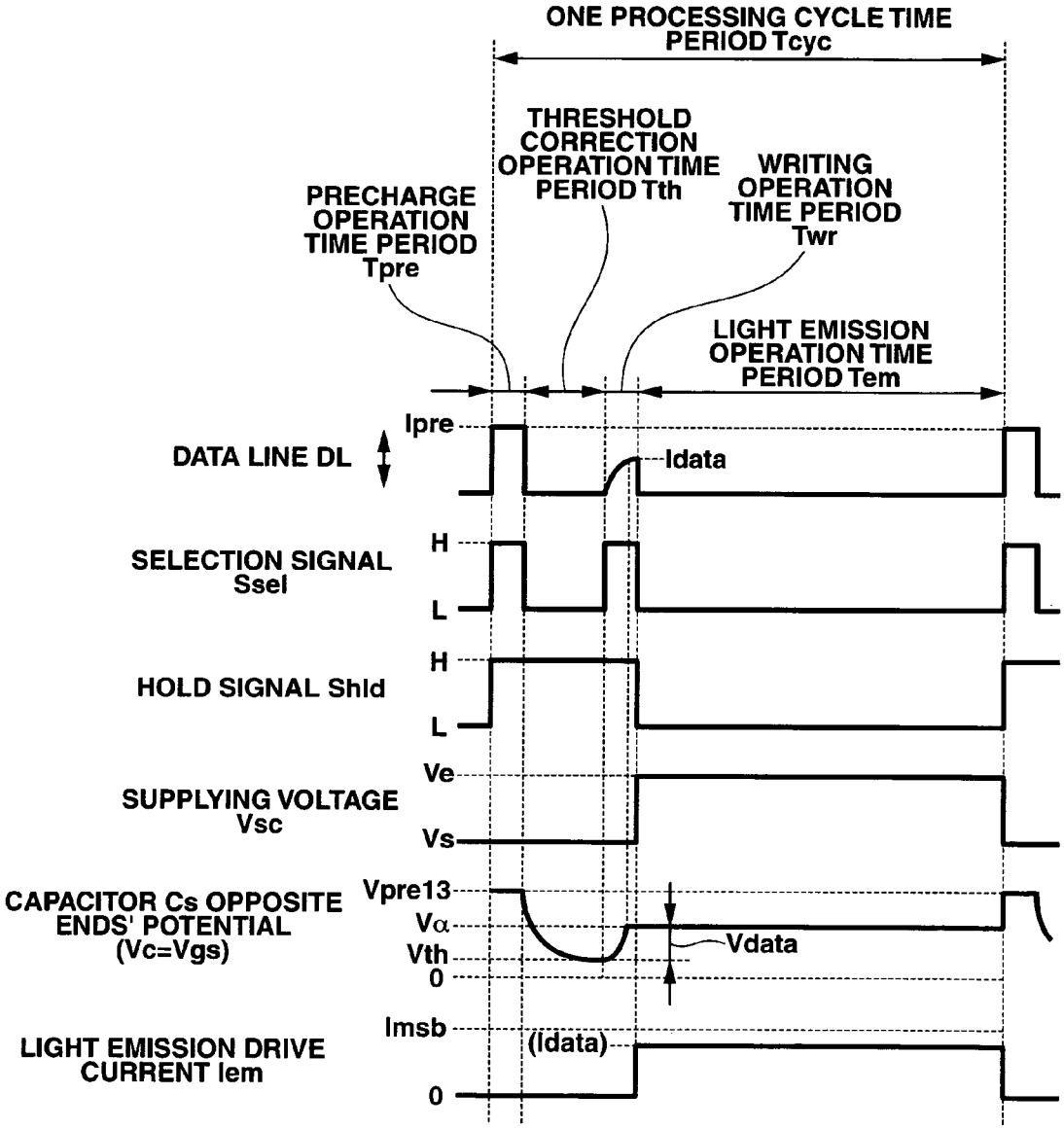
FIG. 2 is a timing chart showing a first example of the drive control operation of the light emission drive circuit according to the embodiment.
Figure 3A:
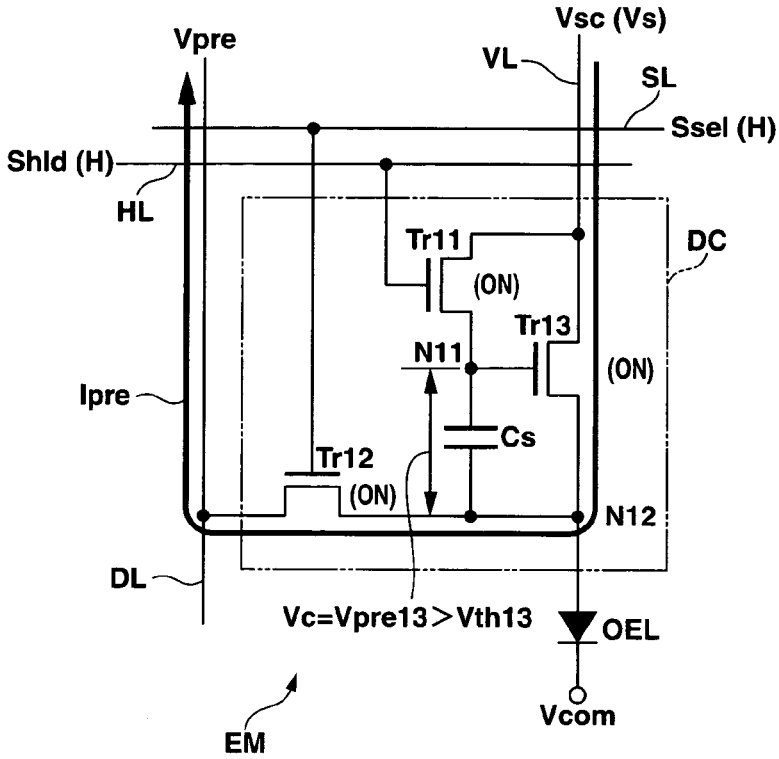
FIGS. 3A and 3B are conceptual drawings showing the operation examples (precharge operation/threshold correction operation) of the light emission drive circuit according to the embodiment in the different state.
Figure 3B:
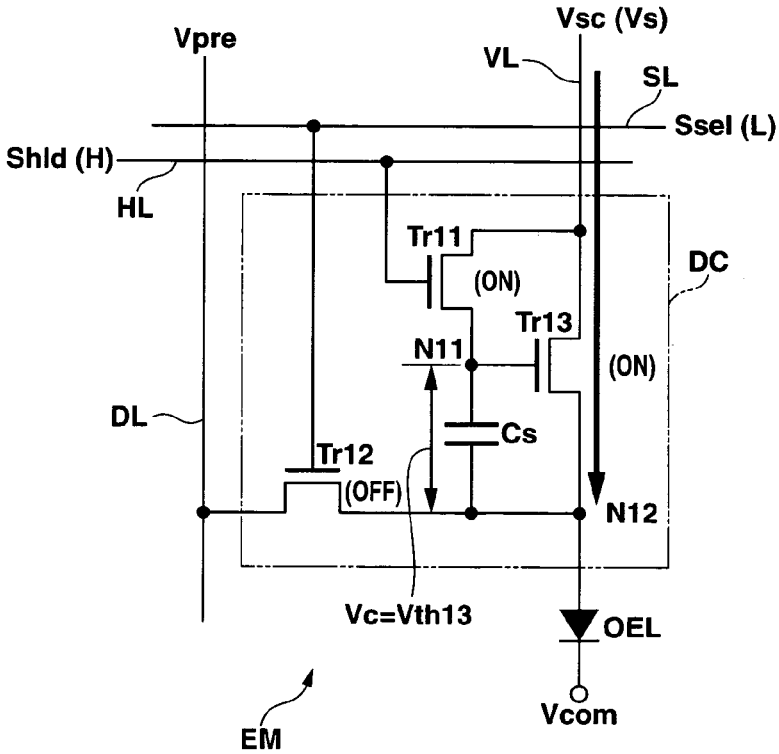
Figure 4A:
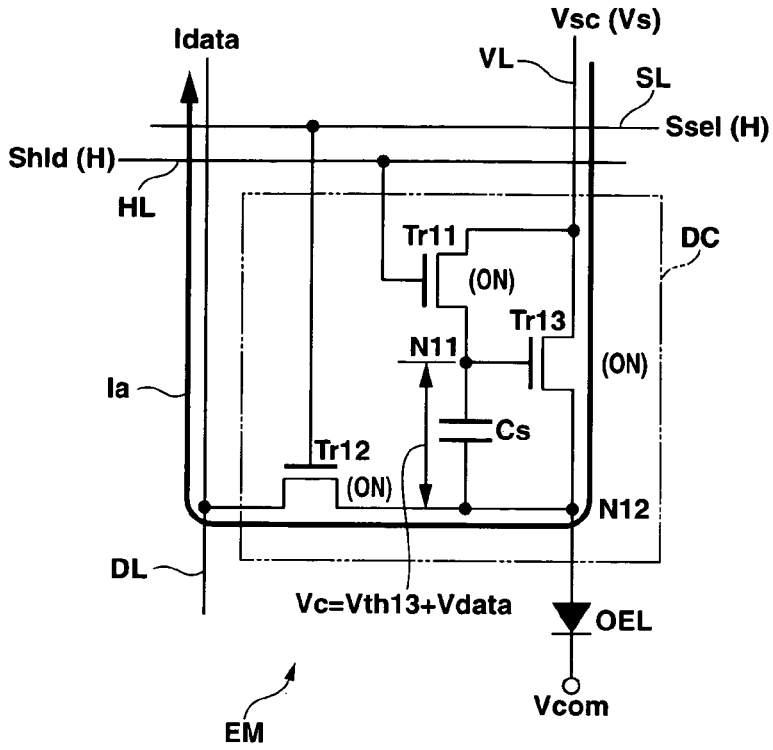
FIGS. 4A and 4B are conceptual drawings showing the operation examples (writing operation/light emission operation) of the light emission drive circuit according to the embodiment in the different state.
Figure 4B:
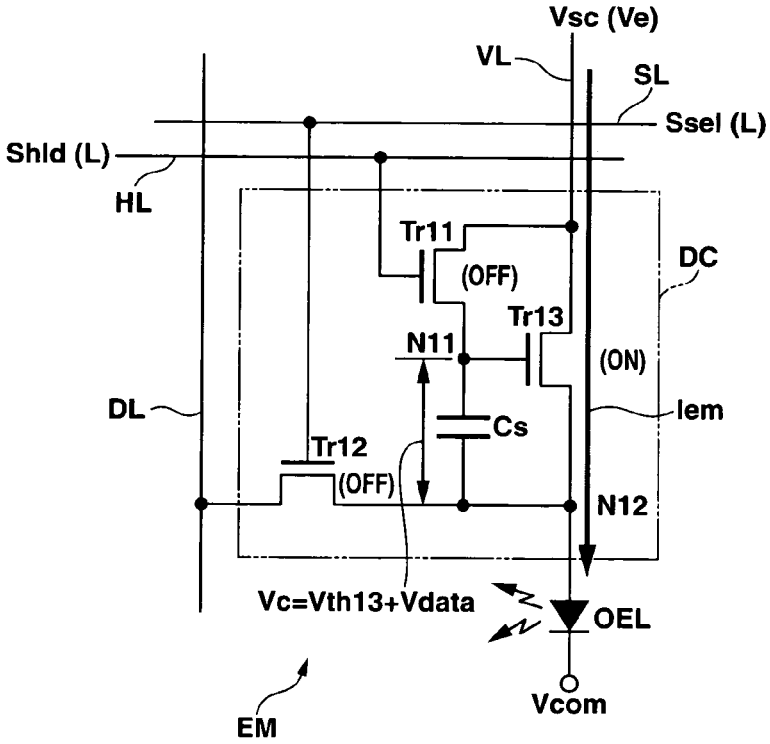

FIG. 2 is a timing chart showing a current value of the data line DL, a potential of a selection signal Ssel, a potential of a hold signal Shld, a potential of a supplying voltage Vsc, a potential difference between the opposite ends of a capacitor Cs, and a current value of a light emission drive current Iem flowing through the organic EL element OEL. FIGS. 3A and 3B are conceptual drawings showing the operation examples (precharge operation/threshold correction operation) of the light emission drive circuit according to the embodiment. FIGS. 4A and 4B are conceptual drawings showing the operation examples (writing operation/light emission operation) of the light emission drive circuit according to the embodiment.

As shown in FIG. 2, the drive control operation of the light emission drive circuit according to the embodiment is carried out by setting the light emission drive circuit so as to include a precharge operation time period Tpre of accumulating a predetermined electric charge in the capacitor Cs of the light emission drive circuit DC, a threshold correction operation time period Tth of partially discharging the electric charges accumulated in the capacitor Cs of the light emission drive circuit DC in the precharge operation time period Tpre and remaining the electric charges equivalent to the threshold of the drain-to-source current Ids of the drive transistor Tr 13 in the capacitor Cs and holding the electric charges, a writing operation time period Twr of applying the gradation sequence signal in accordance with the display data via the data line DL and writing the electric charges in accordance with the display data in the capacitor Cs, and a light emission operation time period Tem of making the organic EL element to perform the light emission operation at the luminance gradation sequence in accordance with the display data on the basis of the electric charges accumulated in the capacitor Cs so that a predetermined precharge voltage Vpre is applied from the signal drive circuit SDR via the data line DL within one processing cycle Tcyc to acquire a gate-to-source voltage Vpre13 of the drive transistor Tr 13 (the absolute value of the voltage Vpre13 is larger than the absolute value of a gate-to-source voltage Vth13 of the drive transistor Tr 13. In an n channel transistor, the voltage Vpre13 is higher than the threshold voltage Vth13) (Tcyc≧Tpre+Tth+Twr+Tem).

Here, the threshold voltage of the above-described drain-to-source current Ids of the drive transistor Tr 13 is a gate-to-source voltage of the drive transistor Tr 13 of a border line between the case that the drain-to-source current Ids of the drive transistor Tr 13 starts to flow and the case the drain-to-source current Ids of the drive transistor Tr 13 does not start to flow. In addition, the one processing cycle Tcyc is a time period required in order for a display pixel EM to display the image for one pixel in the image of one frame. In the case of displaying the image of one frame by arranging a plurality of display pixels EM in a matrix in row and column directions to display the image for one frame, the one processing cycle Tcyc is a time period required in order for the display pixel EM for one row displays the image for one row in the image for one frame. The precharge operation time periods Tpre and the threshold correction operation time periods Tth may be acquired at the same time in plural rows and the light emission operation time periods Tem may be acquired at the same time in plural rows while deviating the writing operation time period Twr to write the data for each row.

The above-described each operation time period will be described in detail below.

(Precharge Operation Time Period)

First, in the precharge operation time period Tpre, as shown in FIGS. 2 and 3A, the selection signal (the writing control signal) Ssel of the on level (a high level when the hold transistors Tr 11 and Tr 12 are the n-channel type of the thin film transistors) and the hold signal (the voltage control signal) Shld are applied to the selection line SL and the hold line HL, and the supplying voltage Vsc of the lower potential selection voltage value Vs is applied to the supplying voltage line VL of the light emission drive circuit DC. The selection voltage value Vs may be a voltage not more than the common voltage Vcom, for example, it may be a ground potential. Further, in synchronization with this timing, the switch means SM of the signal drive circuit SDR outputs the precharge voltage Vpre to the data line DL.

Figure 5:
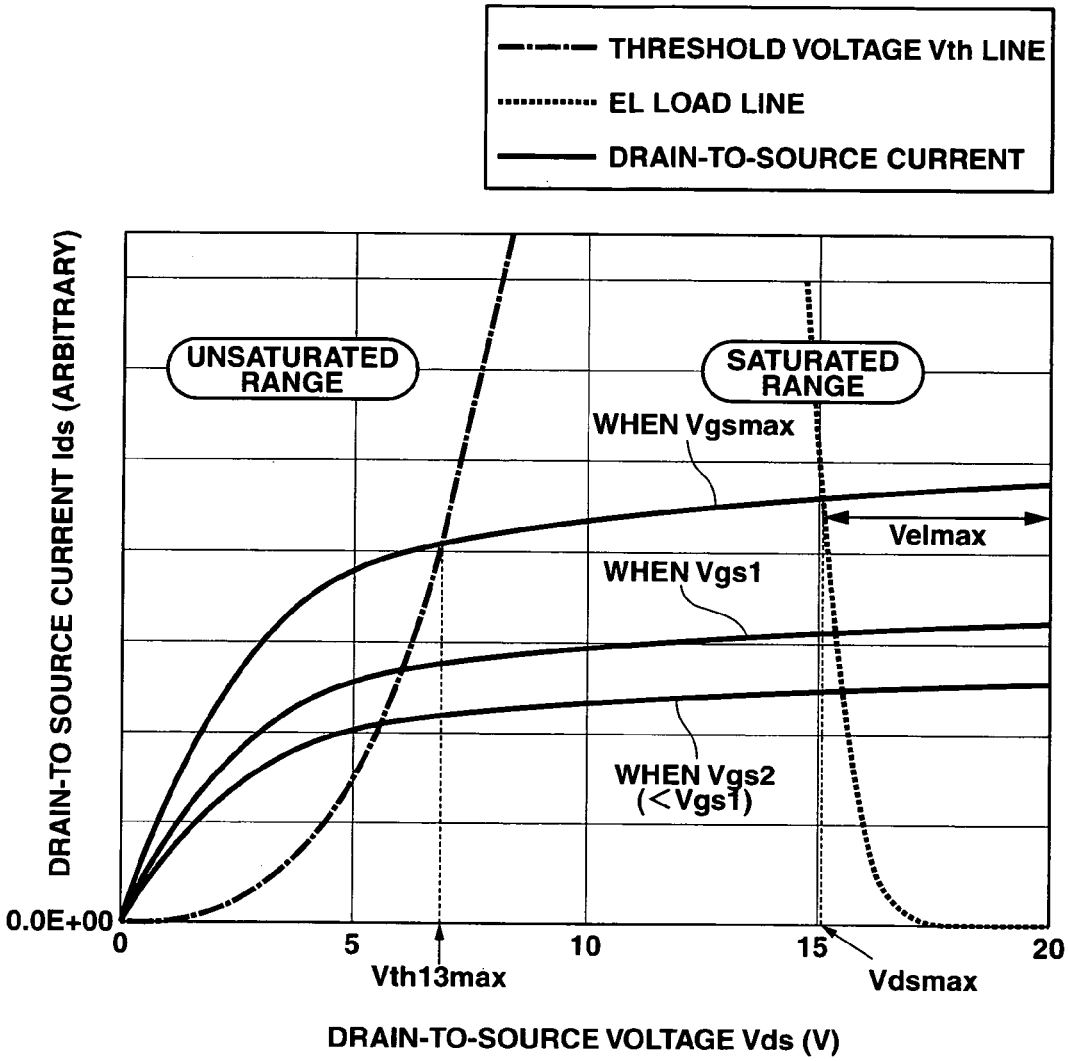
FIG. 5 is a graph showing a current property and a voltage property of the light emission drive circuit according to the embodiment.

FIG. 5 is a graph showing a drain-to-source current Ids property when modulating the drain-to-source voltage Vds at a predetermined gate-to-source voltage Vgs in the n channel type of the thin film transistor. Here, if the thin film transistor is replaced with the drive transistor Tr 13, a horizontal axis can represent a partial pressure of the organic EL element OEL and a partial pressure of the organic EL element OEL that is connected in series with the drive transistor Tr 13 and a horizontal axis can represent a current value of the current Ids between the drain and the source of the drive transistor Tr 13. In the drawing, a dashed line represents a border line of the gate-to-source threshold voltage of the drive transistor Tr 13. In this case, the left side of the border line represents an unsaturated range and the right side represents a saturation range. A solid line represents a property of a drain-to-source current Ids when the drain-to-source voltage Vds of the thin film transistor is modulated while fixing the gate-to-source voltage Vgs of the thin film transistor to a voltage Vgsmax of the maximum luminance modulation, Vgsl (<Vgsmax) and Vgs2 (<Vgsl), respectively. A broken line is an EL load line when the thin film transistor is replaced with the drive transistor Tr 13. The voltage at the right side of the EL load line becomes the partial pressure of the organic EL element OEL at the supplying voltage Vsc-to-common voltage Vcom voltage (in the drawing, 20V), and the left side of the EL load line is equivalent to the drain-to-source voltage Vds of the drive transistor Tr 13. The more the current value of the drain-to-source current Ids (namely, the gradation sequence current Idata) of the drive transistor Tr 13 is increased, the more this partial pressure of the organic EL element OEL is increased little by little.

In the unsaturated range, assuming that the gate-to-source voltage Vgs of the drive transistor Tr 13 is fixed, the more the drain-to-source voltage Vds of the drive transistor Tr 13 is increased, the more the current value of the drain-to-source voltage Ids is increased. On the other hand, in the saturation range, assuming that the gate-to-source voltage Vgs of the drive transistor Tr 13 is fixed, even if the drain-to-source voltage Vds is increased, the drain-to-source current IDS of the drive transistor Tr 13 is not increased so much and is nearly fixed.

The precharge voltage Vpre to be also applied between the drain and the source of the drive transistor Tr 13 in the precharge operation time period Tpre is sufficiently lower than the selection voltage value Vs in the writing operation time period Twr. In addition, the precharge voltage Vpre is set at a potential such that the gate-to-source voltage Vgs of the drive transistor Tr 13 arrives at the saturation of the transistor shown in FIG. 5, namely, the drain-to-source voltage Vds of the drive transistor Tr 13 arrives at the saturation range.

If the hold signal Shld at an on level is outputted from the hold line HL, the holding transistor Tr 11 provided in the light emission drive circuit DC composing the display pixel EM is turned on and the supplying voltage Vsc is applied to the gate of the drive transistor Tr 13 and one end (the contact point N11) of the capacity Cs via the hold transistor Tr 11. The selection signal Ssel of the on level is outputted from the selection line SL. Consequently, the selection transistor Tr 12 is turned on and the data line DL to which the precharge voltage Vpre is applied electrically communicates with the source of the drive transistor Tr 13 and the other end of the capacitor Cs (the contact point N12) via the selection transistor Tr 12.

Here, the precharge voltage Vpre to be applied to the data line DL from the signal drive circuit SDR in the precharge operation time period Tpre is set so as to meet the following equation (1):

$$|Vs-Vpre|>Vth12+Vth13 \quad (1)$$

wherein Vth12 is a drain-to-source threshold voltage of the selection transistor Tr 12 when the on-level selection signal Ssel is applied to the gate of the selection transistor Tr 12. In addition, since both of the gate and the drain of the drive transistor 13 are applied with the selection voltage value Vs-in the precharge operation time period Tpre, they have the substantially same potentials. Accordingly, Vth13 is a drain-to-source voltage threshold voltage of the transistor Tr 13 and is also a gate-to-source threshold voltage of the drive transistor Tr 13. In the meantime, Vth12+Vth13 are increased with time and it has a potential difference of Vs−Vpre so as to always meet the equation (1).

Thus, the potential difference Vpre13 that is larger than the threshold Vth13 of the drive transistor Tr 13 is applied to the opposite ends of the capacitor Cs (namely, between the gate and the source of the drive transistor Tr 13). Thereby, the precharge current Ipre of the large current in accordance with this drive transistor precharge voltage Vpre13 compulsorily flows from the supplying voltage line VL toward the signal drive circuit SDR between the drain and the source of the drive transistor Tr 13. Accordingly, the electric charges corresponding to the potential difference Vc in accordance with the precharge current Ipre is accumulated without delay at the opposite ends of the capacitor Cs (namely, the drive transistor precharge voltage Vpre13 (the third potential difference) is charged). In the meantime, in the precharge operation time period, not only the electric charges is accumulated in the capacitor Cs but also the electric charges is accumulated so that the precharge current Ipre flows also in the other capacitance of the current route from the supplying voltage line VL till the data line DL.

In this case, the common voltage Vcom not more than the low potential supplying voltage Vsc (=Vs) is applied to the cathode terminal of the organic EL element OEL. For this reason, the state between an anode and a cathode of the organic EL element OEL is set at an inverse biased state or a no-electric field state, so that the light emission drive current does not flow through the organic EL element and the light emission operation is not carried out.

(Threshold Correction Operation Time Period)

Next, in the threshold correction operation time period Tth after the precharge operation time period Tpre is terminated, as shown in FIGS. 2 and 3B, the selection signal Ssel applied to the selection line SL is changed into an off level (a low level) with the on level hold signal Shld applied to the hold line HL, whereby the hold transistor Tr 11 may hold the on state and the selection transistor Tr 12 is turned off. Thereby, the other end of the capacitor Cs (the contact point N12) is electrically separated from the data line DL to be set at a high impedance state.

In this case, the drive transistor Tr 13 is kept at the on state by the electric charges (the opposite end's potential Vc>Vth13) accumulated in the capacitor CS in the above-described precharge operation time period Tpre. Therefore, the current may flow between the drain and the source of the drive transistor Tr 13 as the gate voltage of the drive transistor Tr 13 is held. Consequently, the potential at the source terminal side of the drive transistor Tr 13 (the contact point N12; the other terminal side of the capacitor Cs) is gradually increased so as to approach the drain terminal side (the supplying voltage line VL side).

Figure 6:
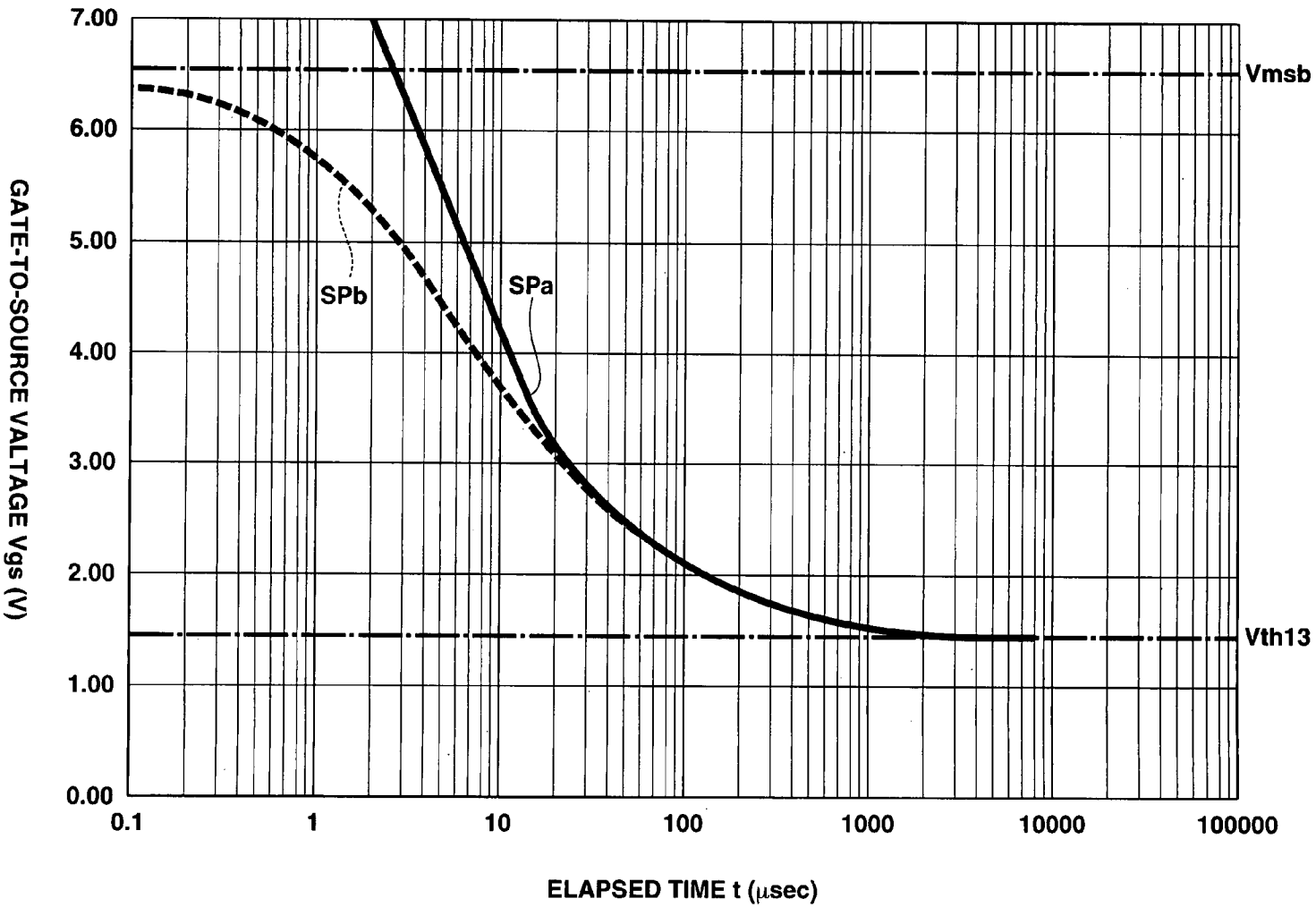
FIG. 6 is a graph showing a temporal response of a voltage between a gate and a source of a thin film transistor in a time of period of a threshold correction operation.
Figure 7:
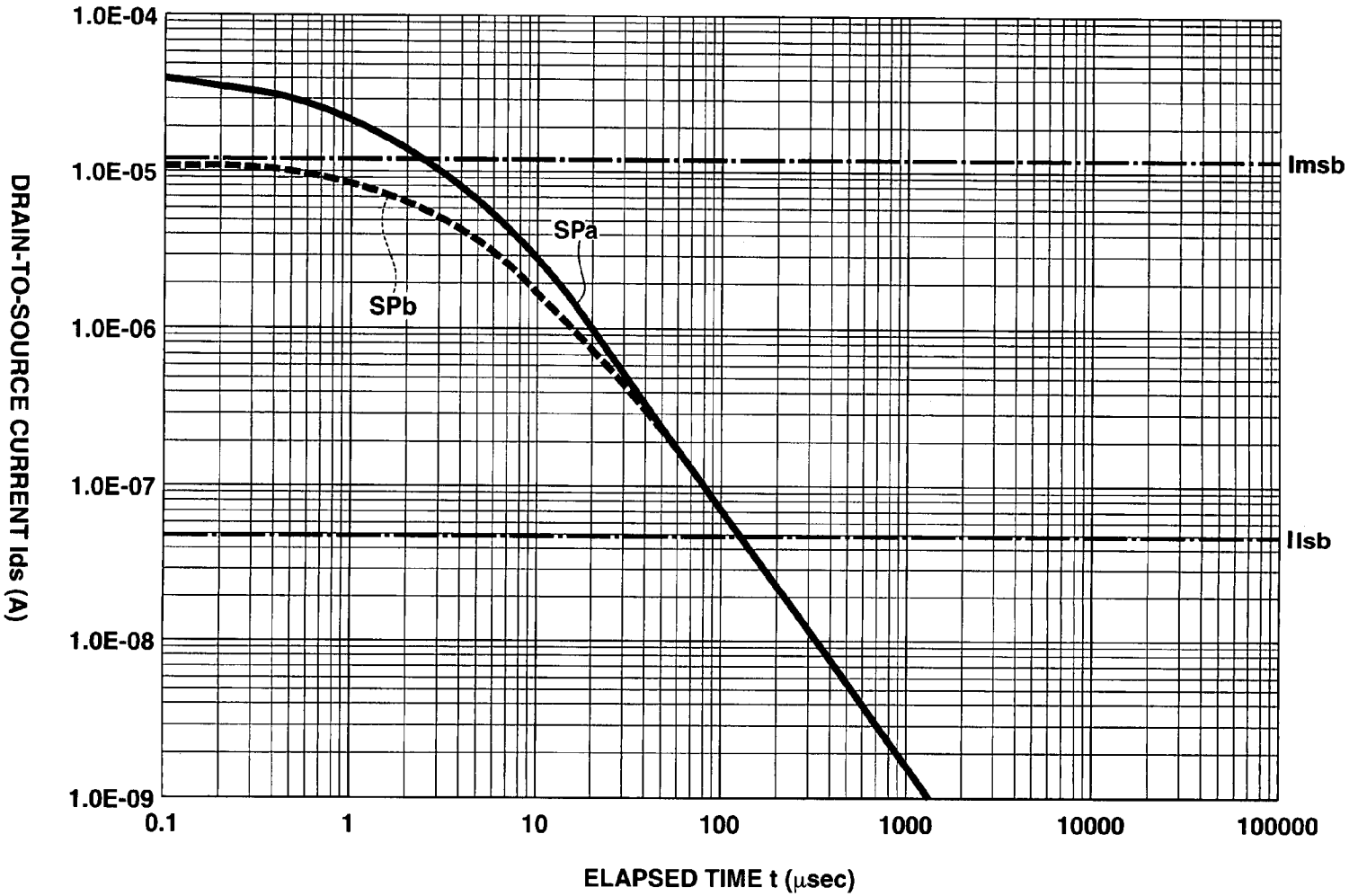
FIG. 7 is a graph showing a temporal response of a voltage between a drain and a source of a thin film transistor in a time of period of a threshold correction operation.

Thereby, as shown in FIG. 6, the gate-to-source voltage Vgs of the drive transistor Tr 13 is decreased, the electric charges accumulated in the capacitor C13 is partially discharged, and finally, the gate-to-source voltage Vgs of the drive transistor Tr 13 is changed so as to decrease (=converge) to the threshold voltage Vth13 (the first potential difference) of the drive transistor Tr 13. In addition, as shown in FIG. 7, the drain-to-source current Ids of the drive transistor Tr 13 is decreased and finally, the drain-to-source current Ids is changed so as to have a linearity.

FIG. 6 is a graph showing a temporal response of a voltage between a gate and a source of a thin film transistor in a time of period of a threshold correction operation according to the present embodiment. FIG. 7 is a graph showing a temporal response of a current between a drain and a source of a thin film transistor in a time of period of a threshold correction operation according to the present embodiment.

In these results, applying the light emission drive circuit DC having an element structure and an element property as shown in Table 1, a temporal response of a gate-to-source voltage Vgs of the drive transistor Tr 13 and a temporal response of the drain-to-source current Ids in the case where a potential difference |Vs−Vpre| is set at 10V and 6.5V are observed to be shown using a logarithmic scale. In the meantime, the capacitance Ct is a sum of the capacity of the capacitor Cs and the other parasitic capacity generated in the light emission drive circuit DC.

TABLE 1

(Structure of light emission drive circuit DC)

| | |
|---|---|
| Gate capacity Cin of Drive transistor Tr 13 | 1.62E−01fF/μm$^2$ |
| Gate width W of Drive transistor Tr 13 | 1200 μm |
| Gate length L of Drive transistor Tr 13 | 7 μm |
| Potential difference \|Vs − Vpre\| | 10 V/6.5 V |
| Threshold voltage Vth13 of drive transistor Tr 13 | 1.5 V |
| Capacity Ct | 20 pF |
| Number of gradation sequence | 256 |
| Maximum luminance gradation sequence voltage Vmsb | 6.53 V |
| Light emission current in maximum luminance gradation sequence | 1.20E−05A/dot(MSB) |
| Light emission current in minimum luminance gradation sequence | 4.68E−08A/dot(LSB) |

In FIGS. 6 and 7, Spa is a property line representing a changing trend of the gate-to-source voltage Vgs in the case where the above-described potential difference |Vs−Vpre| is set at 10V and SPb is a property line representing a changing trend of the gate-to-source voltage Vgs in the case where the potential difference |Vs−Vpre| is set at 6.5V. The potential difference 3.5V of 10V and 6.5V assumes changing with time of a partial pressure between the gate and the source of the drive transistor Tr 13 in accordance with temporal change of increase and decrease such as the drive transistor Tr 13 and the selection transistor Tr 12. In addition, Vmsb is a gate-to-source voltage Vgs of the drive transistor Tr 13 when the organic EL element OEL is made to perform the light emission operation at the maximum luminance gradation sequence (MSB). Imsb is a drain-to-source current Ids (the light emission drive current Iem) of the drive transistor Tr 13. Ilsb is a drain-to-source current Ids (the light emission drive current Iem) of the drive transistor Tr 13 when the organic EL element OEL is made to perform the light emission operation at the minimum luminance gradation sequence (LSB) in the gradation sequences except for the no-light emission.

In this case, in the thin film transistor shown in the table 1, as shown in FIG. 6, it is proved that, in spite of the potential difference |vs−Vpre| generated in the above-described precharge operation time period Tpre, the gate-to-source voltage Vgs (the opposite ends' potential Vc of the capacitor Cs) decreases into a threshold voltage value Vth13 (=1.5V) in a passage of time about 3 msec to 4 μsec (3000 μsec to 4000 μsec). Further, as shown in FIG. 7, it is proved that, in spite of the potential difference |Vs−Vpre| generated in the above-described precharge operation time period Tpre, the drain-to-source voltage Ids is decreased to a current value 4.68E-8A (in the graph of FIG. 6, the gate-to-source voltage Vgs is decreased about to 2.0V) in a passage of time about 50 μsec to 200 μsec.

In this threshold correction operation time period Tth, since the potential of the anode terminal (the contact point N12) of the organic EL element OEL is the same as the common voltage Vcom at the card terminal side or has the potential less than the common voltage Vcom at the card terminal side, the no-potential or the inverse biased voltage has been applied yet to the organic EL element OEL and the organic EL element OEL does not perform the light emission operation.

(Writing Operation Time Period)

Next, in the writing operation time period Twr after the threshold correction operation time period Tth is terminated, process is executed as shown in FIGS. 2 and 4A. That is, in the case where the selection line SL is applied to the on line selection signal Ssel again continuously keeping the hold signal Shld at the on level and the display pixel EM is a gradation sequence display other than the no-light emission in synchronization with this timing, the switching means SM of the signal drive circuit SDR may set the gradation sequence current Idata along an arrow direction in accordance with the display data so as to flow from the supplying voltage line VL into the signal drive circuit SDR via the data line. In addition, in the case where the display pixel EM is the gradation sequence display of the no-light emission, the switching means SM of the signal drive circuit SDR may output the no-light emission display voltage Vzero in which the gate-to-source voltage of the drive transistor Tr 13 is made not more than the threshold value to the data line DL.

In this case, the normal gradation sequence display operation (the gradation sequence display for making the organic EL element OEL to perform the light emission operation) will be described and the no-light emission operation (the gradation sequence display operation so as not to make the organic EL element OEL to perform the light emission operation) will be described later.

Thereby, when the selection transistor Tr 12 is turned on and the operation to drain the gradation sequence current Idata via the data line DL is carried out, the voltage of the potential further lower than the low voltage of the supplying voltage Vsc (=Vs) is applied to the contact point N12 (the source terminal of the drive transistor Tr 13 and the other end side of the capacitor Cs). In the meantime, to one end side (the contact point N11) of the capacitor Cs, the low potential supplying voltage Vsc (=Vs) of the supplying voltage line VL is applied via the hold transistor Tr 11.

Here, the most voltage components among the gate-to-source voltages of the drive transistor Tr 13 required for flowing the gradation sequence current Idata between the drain and the source of the drive transistor Tr 13 are the threshold voltage Vth13. In particularly, in the lowest luminance voltage Vlsb, the ratio of the electric charges needed by the threshold voltage Vth13 in the all electric charges exceeds 50%. Trying to charge the electric charges to arrive at this threshold voltage Mth13 only by the writing operation without the precharge operation and the threshold correction operation according to the embodiment, namely, by the current of which current value is small about the gradation sequence current Idata, the writing operation time period Twr is made longer. Therefore, a frame period to display one image is made longer, so that a good display property is lost. However, according to the present embodiment, in the capacitor Cs connected to the contact point N11 and the contact point N12 (between the gate and the source of the drive transistor Tr 13), the electric charges equivalent to the threshold voltage Vth13 of the drive transistor Tr 13 is held (the threshold voltage Vth13 is charged) by the above-described precharge operation and the threshold correction operation. Therefore, it is possible to charge the electric charges required for making the gradation sequence current Idata steady between the drain and the source of the drive transistor Tr 13 even by the minute current about the gradation sequence current Idata in a relatively short time.

Thus, the drive transistor Tr 13 is set so as to arrive at the drive transistor precharge voltage Vpre 13 higher than the threshold voltage Vth13 (namely, the absolute value thereof is larger that of the threshold voltage Vth13) compulsorily and without delay by outputting the precharge voltage Vpre, which is not a minute current and meets the equation (1) and the gate-to-source voltage of the drive transistor Tr 13 is controlled to cognate into the threshold voltage Vth13 in the threshold correction operation time period Tth. Consequently, as shown in FIG. 4A, the writing current Ia in accordance with the current value of the gradation sequence current Idata flows to the signal drive circuit SDR without delay from the supplying voltage line VL via the drive transistor Tr 13, the contact point N12, the selection transistor Tr 12, and the data line DL.

In other words, as shown in FIG. 6, the electric charges equivalent to the threshold voltage Vth13 of the drive transistor Tr 13 is accumulated in the threshold correction operation time period Tth in the capacitor Cs. For this reason, it is enough that the electric charges needed by the voltage component Vdata in accordance with the gradation sequence current Idata (the writing current Ia) is charged in addition to the charging state. Even if the threshold voltage Vth13 of the drive transistor Tr 13 is changed due to a light emission history and an element property or the like, it is possible to write the voltage component Vdata appropriately in accordance with the gradation sequence signal (the display data) sufficiently without delay. Here, the voltage Vc to be charged in the capacitor Cs (=Vα; the second potential difference) is made into a sum Vα=Vth13+Vdata of the voltage component Vdata in accordance with the threshold voltage Vh13 and the gradation sequence current Idata.

In this case, the low potential supplying voltage Vsc (=Vs) is applied to the supplying voltage line VL and further, the writing current Ia is controlled to flow in a data line DL direction from the supplying voltage lien via the light emission drive circuit DC. Consequently, the potential to be applied to the anode terminal (the contact point N12) of the organic EL element OEL is made not more than the potential Vcom of the cathode terminal and the inverse biased voltage is applied to the organic EL element OEL. Therefore, the light emission drive current does not flow through the organic EL element OEL and the light emission operation is not carried out.

(Light Emission Operation Time Period)

Next, in the light emission operation Tem after the writing operation time period Twr is terminated, as shown in FIGS. 2 and 4B, the off level selection signal Ssel and the hold signal Shld are together applied to the selection line SL and the hold line HL. In synchronization with this timing, the drawing operation of the gradation sequence current Idata due to the signal drive circuit SDR is stopped and the voltage value Ve not less than the anode voltage needed when making the organic EL element OEL to perform the light emission operation at the maximum luminance gradation sequence (the positive voltage that is an order bias with respect to the voltage Vcom connected to the cathode side of the organic EL element OEL) is applied to the supplying voltage line VL as the high potential supplying voltage Vsc. The light emission voltage value Ve is a higher potential than the selection voltage value Vs.

Specifically, the light emission voltage value Ve is set at a potential to meet the following equation (2):

$$|Ve-Vcom|>Vdsmax+Velmax \quad (2)$$

wherein, Vdsmax is the maximum current value between the drain and the source of the drive transistor Tr 13 that the voltage between the drain and the source of the drive transistor Tr 13 arrives at the saturation range shown in FIG. 5 in the light emission operation time period Tem when flowing the gradation sequence current Idata at the maximum luminance gradation sequence. As a result, the drain-to-source current of the drive transistor Tr 13 (the gradation sequence current Idata) can be uniquely set by the gate-to-source voltage of the drive transistor Tr 13. In other words, the gate-to-drain voltage of the drive transistor Tr 13, namely, the electric charges amount accumulated in the capacitor C3 can be uniquely set by the drain-to-source voltage of the drive transistor Tr 13 (the gradation sequence current Idata). Velmax is a partial pressure of the organic EL element OEL at the maximum luminance gradation sequence.

Since the drain-to-source voltage of the drive transistor Tr 13 is located in the saturation range in the light emission operation time period Tem of the drive transistor Tr 13, Vds is set at a voltage to meet the following equation (3).

$$|Ve-Vcom|>Vds\geqq Vth13 \quad (3)$$

In other words, if the drain-to-source voltage Vds of the drive transistor Tr 13 is lower than the threshold Vth13 in the light emission operation time period Tem without meeting the equation (3), it is not possible to uniquely set the drain-to-source current Ids of the drive transistor Tr 13 by the gate-to-source voltage of the drive transistor Tr 13.

If |Ve−Vcom| is constant, the more the luminance gradation sequence is heightened, the more |Vds−Vth| is decreased. In other words, if Vdsmax meets the following equation (4), at any gradation sequence, the drain-to-source voltage of the drive transistor Tr 13 is always located in the saturation range in the light emission operation time period Tem.

$$|Ve-Vcom|>Vdsmax\geqq Vth13max \quad (4)$$

In the meantime, in FIG. 5, Ve−Vcom is defined as 20V, and however, the present embodiment is not limited to this.

The holding transistor Tr 11 and the selection transistor Tr 12 provided to the light emission drive circuit DC are turned off, and the capacitor Cs holds the electric charges accumulated in the above-described writing operation time period Twr.

Thus, since the capacitor Cs holds the charging voltage Va upon the writing operation (=Vth13+Vdata), the gate-to-source voltage Vgs of the drive transistor Tr 13 (the voltage of the contact point N11; the drive voltage) is held and the drive transistor Tr 13 is kept to be turned on.

Accordingly, as shown in FIG. 4B, in the light emission operation time period Tem, the light emission drive current Iem flows in the direction of the organic EL element OEL from the supplying voltage line VL via the drive transistor Tr 13 and the contact point N12 and the organic EL element OEL emits light at a predetermined luminance gradation sequence in accordance with the current value of the light emission drive current Iem. Here, the electric charges held in the capacitor Cs in the light emission operation time period Tem (namely, the charging voltage Vc) is equivalent to the potential difference in the case of flowing the writing current Ia corresponding to the gradation sequence current Idata in the drive transistor Tr 13. For this reason, the light emission drive current Iem flowing through the organic EL element OEL has the current value (Iem nearly equal to Ia=Idata) equivalent of the above-described writing current Ia (the gradation sequence current Idata). Thereby, the light emission drive current Iem corresponding to a predetermined light emission state (the luminance gradation sequence) is supplied on the basis of the voltage component Va written (held) in the writing operation time period Twr, and the organic EL element OEL may continuously emit light at a desired luminance gradation sequence in accordance with the display data (the gradation sequence current Idata).

In this way, according to the light emission drive circuit and its drive control method of the present embodiment, the drive control method in a current designation system to perform the light emission at a predetermine luminance gradation sequence is applied in such a manner that the gradation sequence current Idata (the writing current Ia) designating the current value in accordance with the light emission state (the luminance gradation sequence) of the organic EL element OEL is compulsorily supplied between the drain and the source of the drive transistor Tr 13 in the writing operation time period and the light emission drive current Iem to flow through the organic EL element OEL is controlled based on the voltage component between the gate and the source of the drive transistor Tr 13 held in accordance with its current value. Further, both of the function to convert the current level of the gradation sequence current Idata in accordance with the desired display data (the luminance gradation sequence) into the voltage level (the current and voltage conversion function) and the function to supply the light emission drive current Iem having a predetermined current value to the organic EL element OEL are realized by the single transistor for the light emission driving (the drive transistor Tr 13). Therefore, it is possible to realize a desired light emission property stably for a long time without the affection such as variation of the operational property and the temporal change of each transistor composing the light emission drive circuit DC.

In addition, according to the light emission drive circuit and its drive control method of the present embodiment, the precharge operation is performed prior to the writing operation of the display data into the display pixel EM and the light emission operation of the organic EL element OEL. Thereby, not the minute current like the gradation sequence current Idata but the electric charges equivalent to the drive transistor precharge voltage Vpre13 exceeding the threshold voltage Vth13 of the transistor is compulsorily accumulated once in the capacitor Cs connected between the gate and the source of the transistor for the light emission driving (the drive transistor Tr 13) provided in the light emission drive circuit DC at the precharge voltage Vpre. Then, the drive transistor Tr 13 turns off the selection transistor Tr 12 so that the drive transistor Tr 13 decreases into each of the threshold Vth13 by performing the threshold correction operation. Consequently, after the threshold correction operation is terminated, it is possible to accumulate the electric charges equivalent to the threshold Vth13 of the drive transistor Tr 13 of the light emission drive circuit DC in the capacitor Cs of each light emission drive circuit DC and hold it.

In this way, even if variation is generated in the threshold Vth13 of each drive transistor Tr 13, the electric charges in accordance with the threshold Vth13 of each drive transistor Tr 13 is appropriately charged in the threshold correction operation. Then, in the writing operation of the display data, it is not necessary to charge the capacitor Cs by the gradation sequence current Idata on the basis of the display data so as to be equivalent to the threshold voltage Vth13 and it is only necessary to add and accumulate (charge) the voltage component Vdata in accordance with this display data (the gradation sequence current Idata). Therefore, the electric charges based on the display data can be quickly accumulated (charged) in the capacitor Cs and lack of the writing can be prevented. Accordingly, it is possible to make the organic EL element OEL to perform the light emission operation at the appropriate luminance gradation sequence in accordance with the display data.

Specifically, in the light emission drive circuit applying the current designation system as shown in the present embodiment, the current value of the gradation sequence current Idata (the writing current Ia) to be supplied to the light emission drive circuit DC upon the writing operation (in the present embodiment, draws the current in the light emission drive circuit DC) is approximately equal to the light emission drive current Iem flowing through the organic EL element OEL. Therefore, when performing the display operation at the low luminance gradation sequence (when making the organic EL element OEL to perform the light emission operation at the low luminance gradation sequence), the current value of the gradation sequence current Idata to be supplied to the signal drive circuit SDR is made very small.

On the other hand, time allowed for the writing operation into the display pixel (the light emission drive circuit) has been generally defined in advance on the basis of the specification (the frame time and the number of scan lines) of the display panel (to be described in detail later with reference to the application example to the display unit).

Therefore, in the case of supplying the gradation sequence current Idata in accordance with the display data in the writing operation time period without performing the precharge operation and the threshold correction operation according to the present embodiment and forming a predetermined potential between the gate and the source (equivalent to the opposite ends of the capacitor Cs) of the transistor for the light emission driving (equivalent to the drive transistor Tr 13), first, the electric charges for the threshold voltage Vth13 of the transistor is necessarily accumulated. For this reason, the sufficient electric charge corresponding to the threshold voltage Vth13 and the other capacitance (for example, the parasitic capacitance of the data line DL and the threshold voltage Vth12 of the selection transistor Tr 12) is not accumulated between the gate and the source of this transistor at the minute gradation sequence current Idata in accordance with the low luminance gradation sequence display, which leads to the face that the light emission drive current Iem having the current value in accordance with this gradation sequence current Idata cannot be supplied to the light emission element (the organic EL element OEL).

Figure 8:
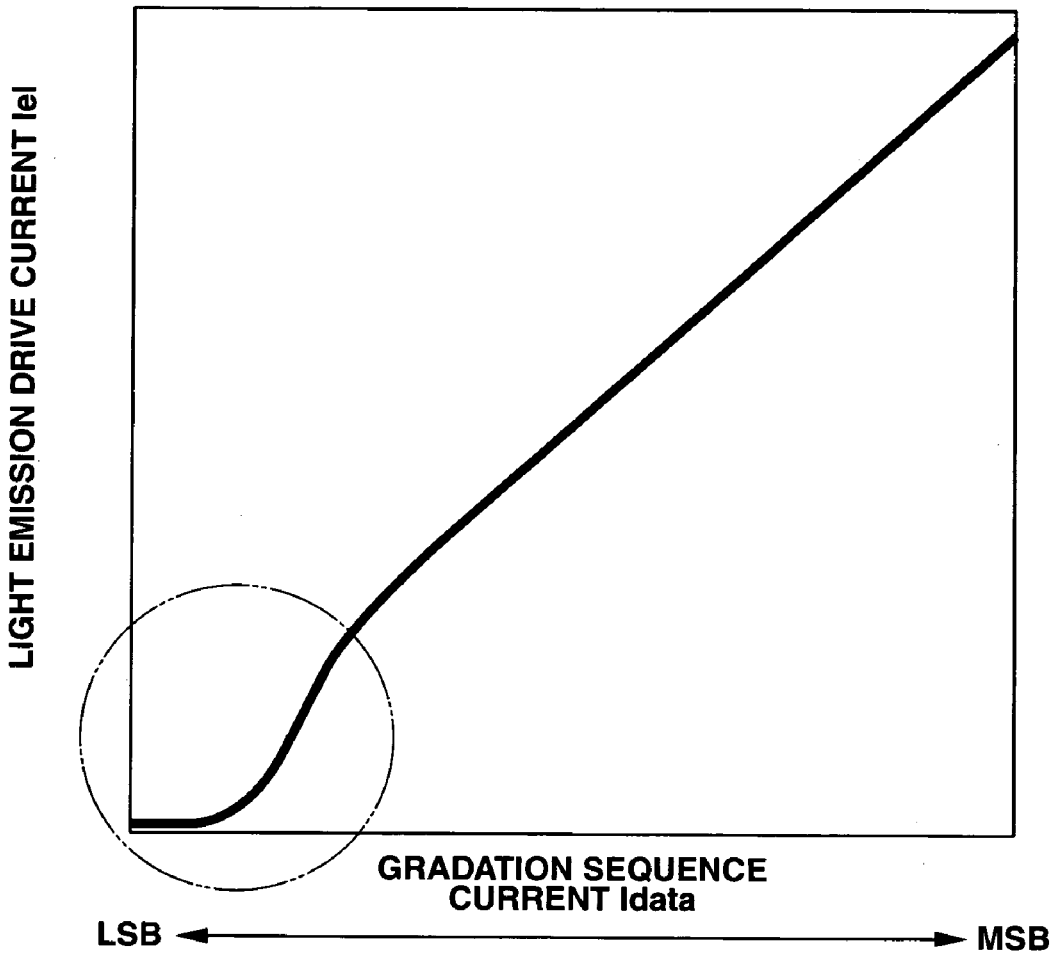
FIG. 8 is a graph showing a changing trend of a light emission drive current against a gradation sequence current in a contrast example with a drive control method of the light emission drive circuit according to the embodiment.

Thereby, the current value of the light emission drive current Iem (the output gradation sequence) shared by the organic EL element OEL with respect to the gradation sequence current Idata (the writing current Ia; the input gradation sequence) to be supplied to the light emission drive circuit DC indicates nonlinearity in the low luminance gradation sequence range as shown by a circle in FIG. 8. This makes impossible to perform the light emission operation at the appropriate luminance gradation sequence in accordance with the display data.

On the contrary, according to the light emission drive circuit and its drive control method of the present invention, prior to the writing operation of the display data, the light emission drive circuit is driven controlled to perform the precharge operation and the threshold correction operation for accumulating the electric charges equivalent to the threshold voltage between the gate and the source (the opposite ends of the capacitor Cs) of the drive transistor (transistor for the light emission driving) Tr 13. Therefore, for example, as shown in FIGS. 9A and 9B, the output gradation sequence (the light emission drive current Iem; the light emission luminance) with respect to the input gradation sequence (the gradation sequence current Idata; the writing current Ia) shows a good linearity even in the low luminance gradation sequence range, so that the light emission operation can be carried out at the appropriate luminance gradation sequence in accordance with the display data.

Figure 9A:
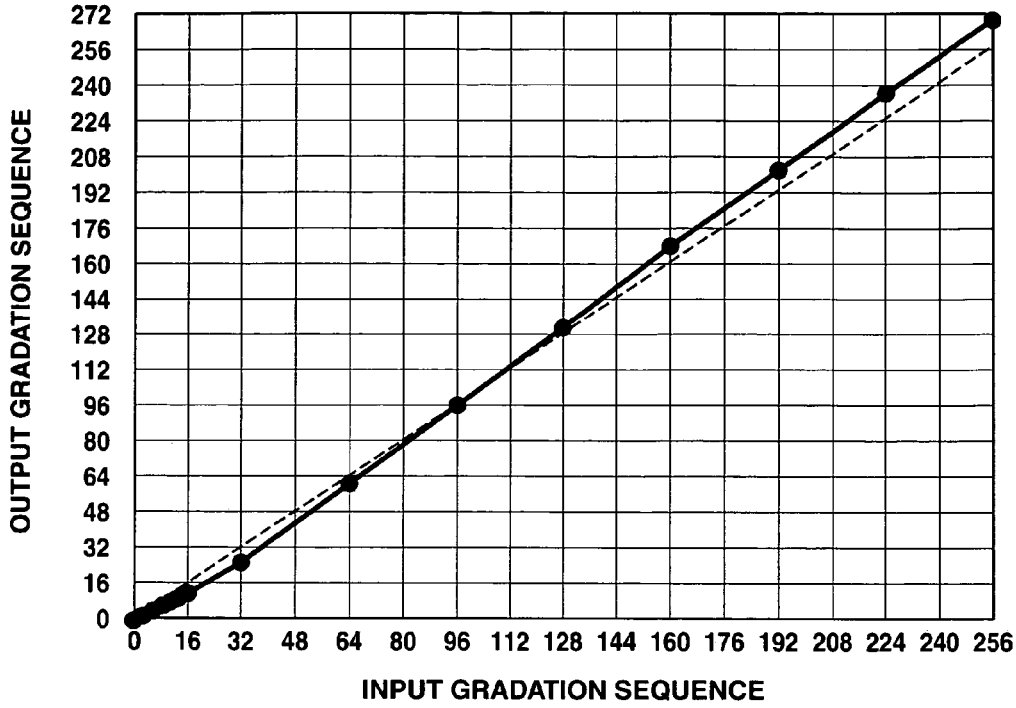
FIGS. 9A and 9B are graphs showing a changing trend of an output gradation sequence against an input gradation sequence in the drive control method of the light emission drive circuit according to the embodiment in the case of different threshold voltages of a drive transistor.
Figure 9B:
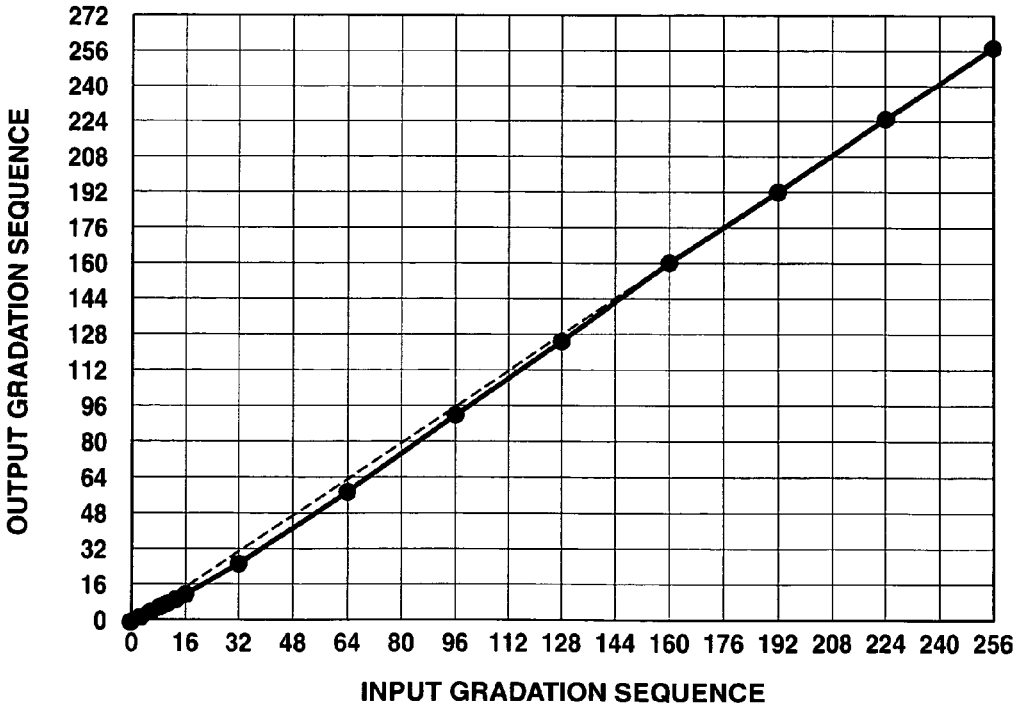

Particularly, according to the light emission drive circuit and its drive control method of the embodiment, as shown in FIGS. 9A and 9B, it has been confirmed that the output gradation sequence with respect to the input gradation sequence shows a sublinearity even if the threshold voltage Vth13 of the drive transistor Tr 13 is changed (shifted) due to the temporal change and the light emission history or the like. FIG. 8 is a graph showing a changing trend of a light emission drive current against a gradation sequence current in a contrast example with a drive control method of the light emission drive circuit according to the embodiment, and FIGS. 9A and 9B are graphs showing a changing trend of an output gradation sequence against an input gradation sequence in the drive control method of the light emission drive circuit according to the embodiment. In FIGS. 9A and 9B, a horizontal axis represents a gradation sequence value on the basis of the gradation sequence current Idata, a vertical axis represents a gradation sequence value on the basis of the light emission drive current Iem generated from the gradation sequence current Idata, and a broken line represents an ideal value. In this case, FIG. 9A is a graph showing a changing trend of an output gradation sequence value against an input gradation sequence value under the initial state that no change is generated in the threshold voltage of the drive transistor Tr 13. FIG. 9B is a graph showing a changing trend of an output gradation sequence value against an input gradation sequence value under the state that the threshold voltage of the drive transistor Tr 13 is shifted by 4V due to the temporal change. In this way, the low gradation sequence is not collapsed not like FIG. 8 and it is possible to acquire the linear light emission drive current Iem with respect to the gradation sequence current Idata.

(Drive Control Method of Light Emission Drive Circuit (Gradation Sequence Display: (2))

Next, a second example (the gradation sequence display operation) of a drive control method in a light emission circuit having the structures will be described below.

Figure 10:
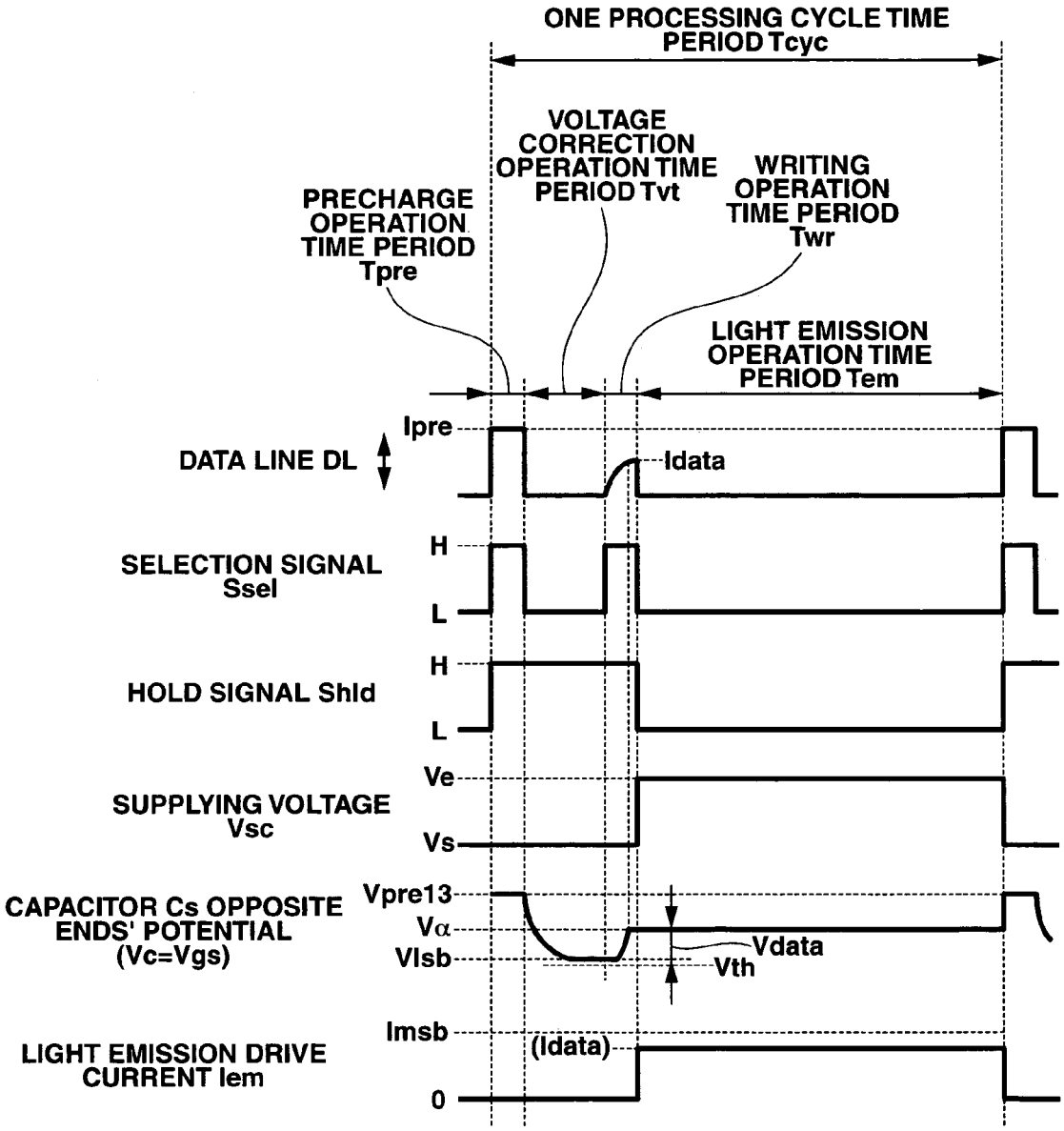
FIG. 10 is a timing chart showing a second example of the drive control operation of the light emission drive circuit according to the embodiment.
Figure 11A:
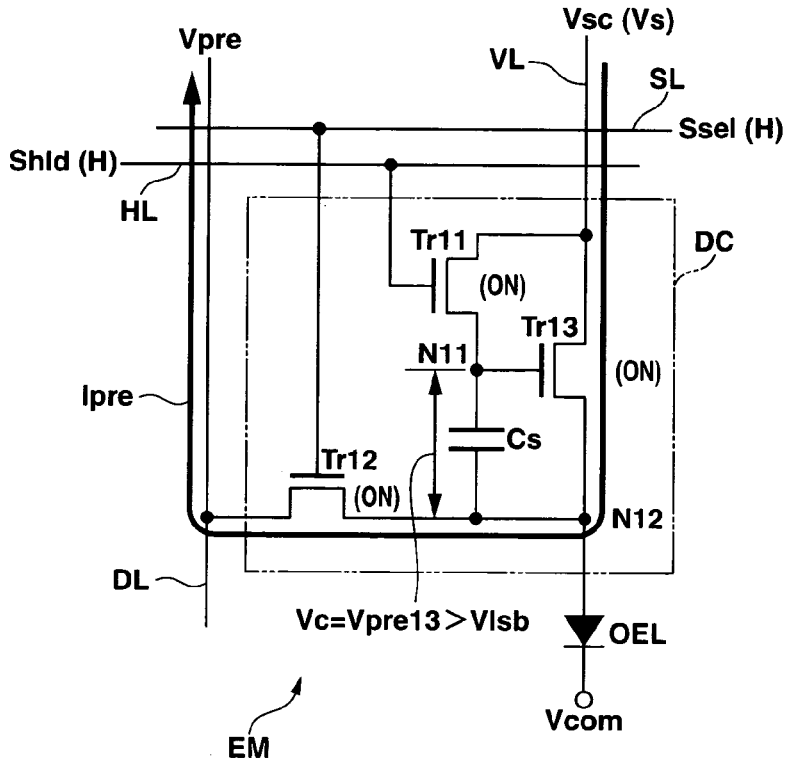
FIGS. 11A and 11B are conceptual views showing the operation example (precharge operation/voltage correction operation) of the light emission drive circuit according to the embodiment in the different state.
Figure 11B:
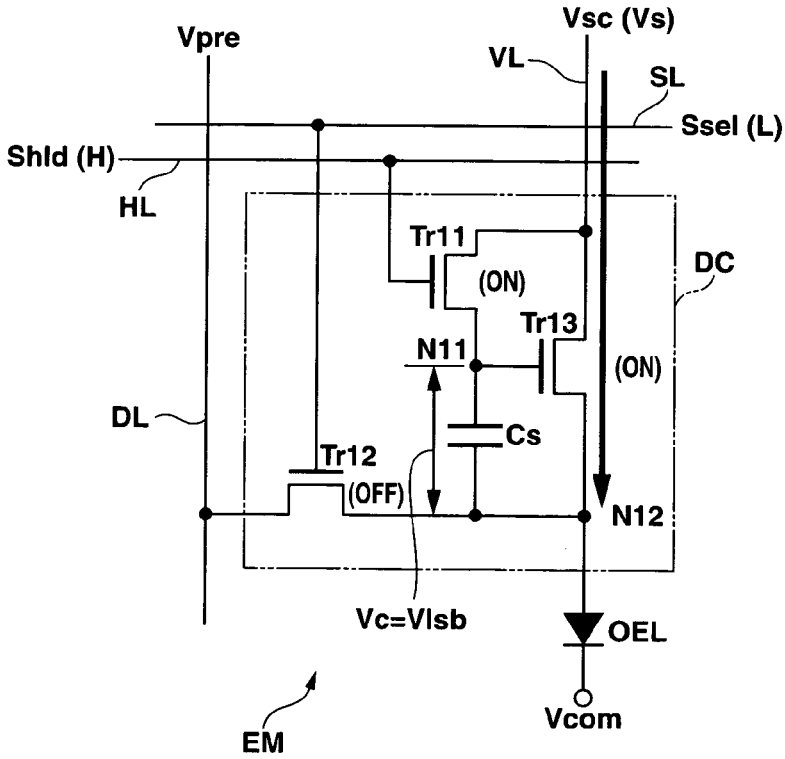
Figure 12A:
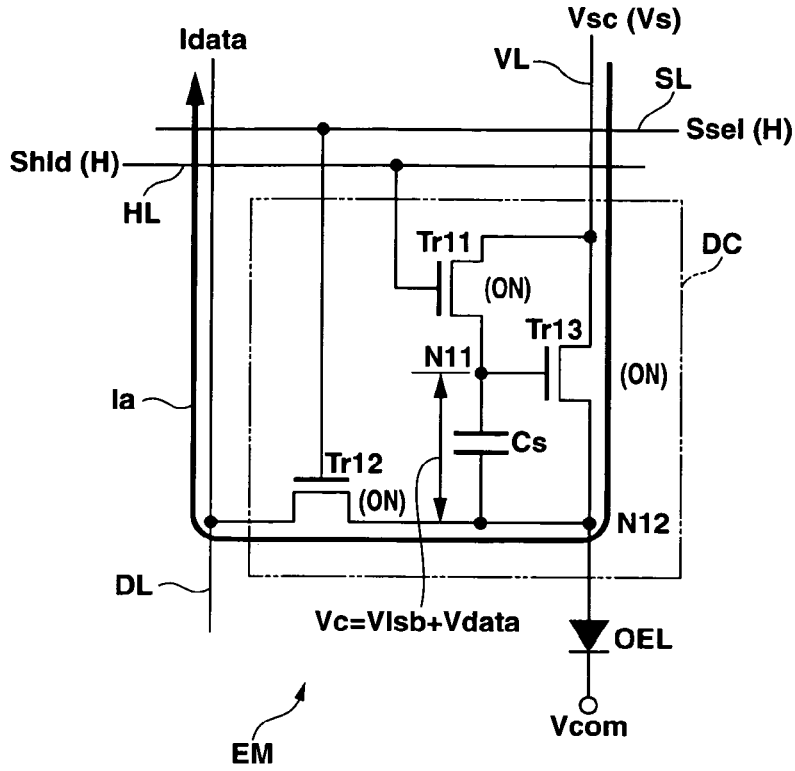
FIGS. 12A and 12B are conceptual views showing the operation example (writing operation/light emission operation) of the light emission drive circuit according to the embodiment in the different state.
Figure 12B:
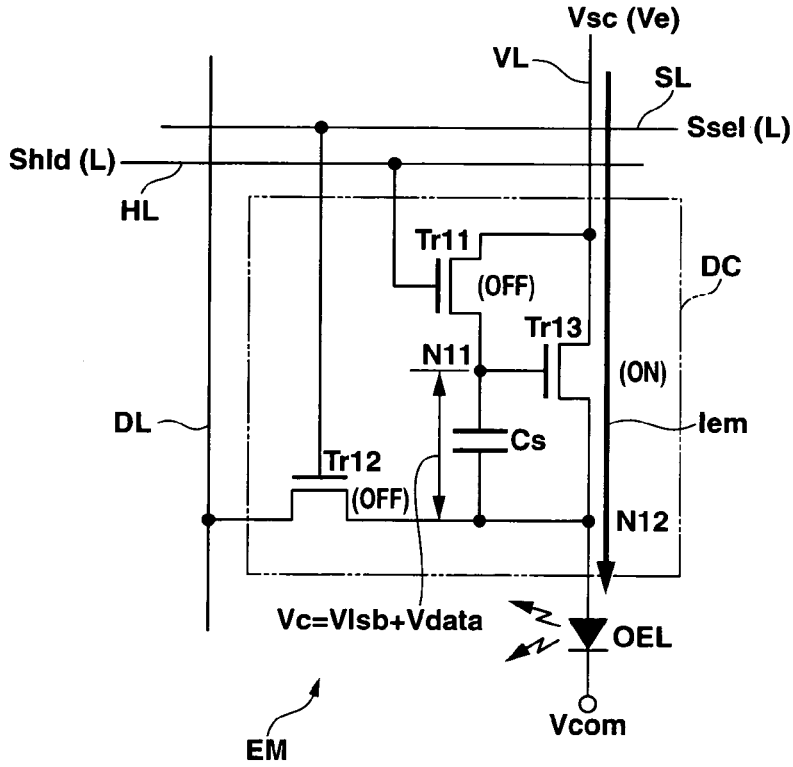

FIG. 10 is a timing chart showing the current value of the data line DL; a potential of the selection signal Ssel; a potential of the hold signal Shld; a potential of the supplying voltage Vsc; the potential difference in the opposite ends of the capacitor Cs; and the current value of the light emission drive current Iem in the second example of the drive control operation of the light emission drive circuit according to the embodiment. FIGS. 11A and 11B are conceptual drawings showing the operation example (precharge operation/voltage correction operation) of the light emission drive circuit according to the embodiment. FIGS. 12A and 12B are conceptual drawings showing the operation example (writing operation/light emission operation) of the light emission drive circuit according to the embodiment. Here, referring to the drive control circuit (FIG. 1) shown in the embodiment, the explanation of the control operation equivalent of the drive control method shown in the first example (FIGS. 2, 3A, 3B, and 4) will be herein simplified.

According to the drive control method shown in the first example, the drive control method provided with the threshold correction operation time period Tth to correct the charging voltage of the capacitor Cs so that the charging voltage decreases from the drive transistor precharge voltage Vpre13 into the threshold value voltage Vth13 of the drive transistor Tr 13 after the precharge operation time period Tpre for charging the drive transistor precharge voltage Vpre13 in the capacitor Cs connected between the gate and the source of the drive transistor Tr 13 as the transistor for the light emission driving is indicated. However, the present invention is not limited to this method.

According to the drive control method shown in the first example, there has been explained the case of applying the method of accumulating the electric charges amount equivalent to the threshold voltage Vth13 between the gate and the source (the capacitor Cs) of the transistor for the light emission driving (the drive transistor Tr 13) prior to the writing operation; and adding the all of the electric charges by the gradation sequence Idata to be supplied upon the writing operation to the electric charges amount equivalent to the threshold voltage Vth13 and accumulating them as the electric charges serving to generate the light emission drive current Iem. In this case, the voltage exceeding the threshold voltage Vth13 is applied between the gate and the source of the drive transistor Tr 13 and the electric charges is accumulated therein in the precharge operation time period Tpre. Then, the electric charges is discharged till the voltage decreases into the threshold voltage Vth13 in the threshold correction operation time period Tth. Therefore, if the difference voltage between the voltage applied between the gate and the source of the drive transistor Tr 13 and the threshold voltage Vth13 is large, the threshold correction operation time period Tth becomes long.

According to the present embodiment, based on such a technical idea, the drive control method is carried out, as shown in FIG. 10, by setting the light emission drive circuit so as to include a precharge operation time period Tpre of accumulating the electric charges based on the drive transistor precharge voltage Vpre13 in the capacitor Cs of the light emission drive circuit DC within one processing cycle time period Tcyc; a voltage correction operation time period Tvt of partially discharging the electric charges accumulated in the capacitor Cs and remaining the electric charges equivalent to the voltage (the minimum luminance voltage Vlsb) to generate the light emission drive current Iem when making the organic EL element OEL to perform the light emission at the minimum luminance gradation sequence (the gradation sequence, of which luminance except for the no-light emission is the minimum) in the capacitor Cs between the gate and the source of the drive transistor Tr 13 and holding the electric charges; a writing operation time period Twr of writing the electric charges on the basis of the gradation sequence signal (the gradation sequence current Idata) in accordance with the display data in the capacitor Cs; and a light emission operation time period Tem of making the organic EL element to perform the light emission operation at a predetermined luminance gradation sequence on the basis of the electric charges accumulated in the capacitor Cs ($Tcyc \geqq Tpre+Tth+Tvt+Twr+Tem$).

Here, the one processing cycle time period Tcyc is a time period required in order for a row of a display pixel EM to display the image for one row in the image of one frame in the case of displaying the image of one frame by arranging a plurality of display pixels EM in a matrix in row and column directions. The precharge operation time periods Tpre and the voltage correction operation time periods Tvt may be acquired at the same time in plural rows and the light emission operation time periods Tem may be acquired at the same time in plural rows while deviating the writing operation time period Twr to write the data for each row.

In other words, a drive control method is applied to set the electric charges accumulated between the gate and the source (the capacitor Cs) of the transistor for the light emission driving (the drive transistor Tr 13) after the precharge operation time periods Tpre that the switch means SM of the signal drive circuit SDR outputs the precharge voltage Vpre to the data line DL and before moving to the writing operation time period Twr that the switching means SM of the signal drive circuit SDR flows the gradation sequence current Idata to the data line DL not at the value equivalent to the threshold voltage Vh13 but at the value equivalent to the voltage (the minimum luminance voltage Vlsb) for generating the light emission drive current when performing the light emission operation at the minimum luminance gradation sequence.

Specifically, as shown in FIG. 10, the voltage correction operation time period Tvt to be carried out after the precharge operation time period is set so as to stop the voltage correction operation and move to the following writing operation time period Twr when attaining to the gate-to-source voltage Vgs (=the minimum luminance voltage Vlsb; the first potential difference) capable of flowing the light emission drive current Iem (=Ilsb; 4.68E-08A) upon performing the light emission operation at the minimum luminance gradation sequence (approximately, 100 to 200 μsec) in the changing trend of the gate-to-source voltage Vgs (the opposite ends' voltage of the capacitor Cs) of the drive transistor Tr 13 shown in FIG. 6 and the changing trend of the drain-to-source voltage Ids (the light emission drive current Iem) of the drive transistor Tr 13 shown in FIG. 7.

According to such a drive control method of the light emission drive circuit, in the voltage correction operation time period Tvt after the precharge operation time period Tpre, it is only necessary to decrease the drive transistor precharge voltage Vpre13 charged in the capacitor Cs once into the minimum luminance voltage Vlsb in accordance with the light emission drive current Iem (=Ilsb) required to make the organic EL element OEL to perform the light emission operation (the display operation) at the minimum luminance gradation sequence, which is the voltage higher than the threshold voltage Vth13 of the drive transistor Tr 13 (namely, the voltage having the large absolute value). For this reason, the potential difference between the drive transistor precharge voltage Vpre13 and the minimum luminance voltage Vlsb is smaller than the potential difference between the potential difference between the drive transistor precharge voltage Vpre13 and the threshold voltage Vth13. This leads to the fact that the voltage correction operation time period Tvt is shorter than the threshold correction operation time period Tth. For example, if the drive transistor Tr 13 in the changing trend of the gate-to-source voltage Vgs (the opposite ends' voltage Vc of the capacitor Cs) shown in FIGS. 6 and 7 is employed, it is possible to largely reduce time required for the correction operation of the charging voltage (about 100 to 200 μsec) as compared to time till the voltage decreases into the threshold voltage Vth13 (approximately, 3 to 4 μsec).

In addition, in the voltage correction operation time period Tvt, not only the electric charges is accumulated in the capacitor Cs but also the electric charges is accumulated so that the gradation sequence current Idata flows in the other capacitance of the current route from the supplying voltage line VL to the data line DL other than the capacitor Cs. Therefore, even when the minute gradation sequence current Idata is accumulated on the basis of the display data in the following writing operation time period Twr, it is possible to add the electric charges serving to generate the light emission drive current Iem without delay by means of the current Idata to the electric charges equivalent to the minimum luminance voltage Vlsb accumulated in the capacitor Cs and to quickly and sufficiently accumulate (write) the voltage component Vdata appropriately corresponding to the display data.

Accordingly, in the one processing cycle time period Tcyc according to the drive control operation (the light emission operation of the light emission element) of the light emission drive circuit, it is possible to reduce time required for the correction operation of the charging voltage Vc of the capacitor Cs (the gate-to-source voltage Vgs) carried out prior to the writing operation time period Twr and the light emission operation time period Tem. This enables to set the light emission operation time period Tem of the light emission element relatively long, to improve the light emission luminance, as same as the case shown in FIG. 9, to prevent the reduction of the light emission luminance in the low luminance gradation sequence range, and to maintain a linearity.

(Drive Control Method of Light Emission Drive Circuit (No-Light Emission Display))

Subsequently, a third example (the no-light emission display operation) of the drive control method in the light emission drive circuit having the structures will be described below.

Figure 13:
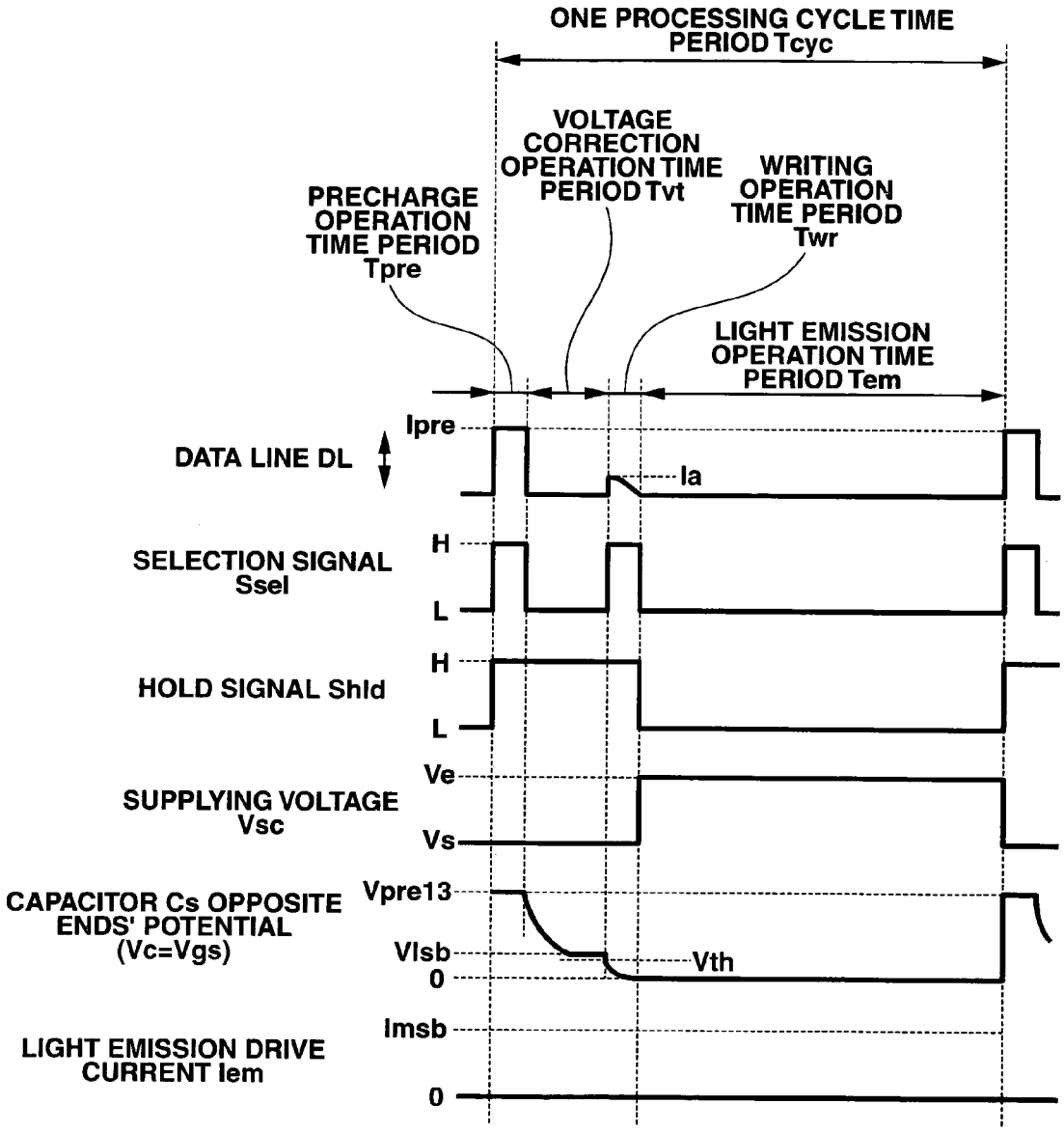
FIG. 13 is a timing chart showing a third example of the drive control operation of the light emission drive circuit according to the embodiment.
Figure 14A:
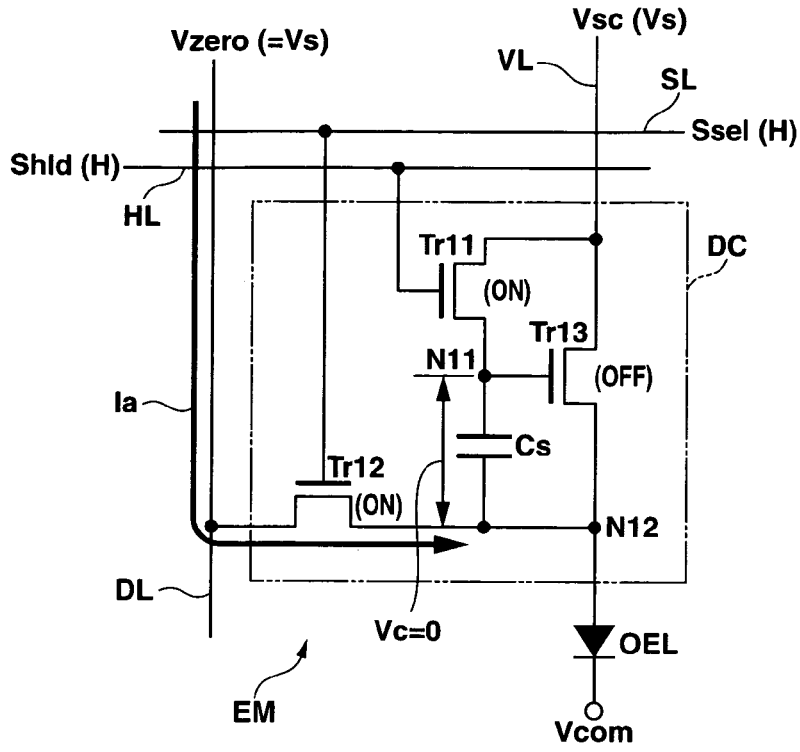
FIGS. 14A and 14B are conceptual views showing the operation example (writing operation/light emission operation) of the light emission drive circuit according to the embodiment in the different state.
Figure 14B:
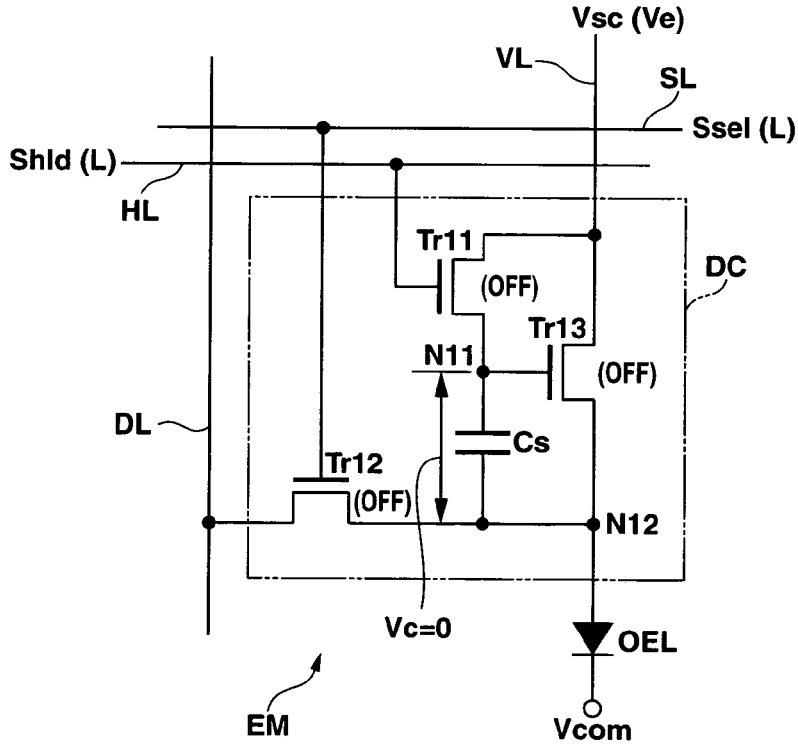

FIG. 13 is a timing chart showing the current value of the data line DL; the potential of the selection signal Ssel; the potential of the hold signal Shld; the potential of the supplying voltage Vsc; the potential difference at the opposite ends of the capacitor Cs; and the current value of the light emission drive current Iem flowing through the organic EL element OEL according to a third example of the drive control operation of the light emission drive circuit according to the embodiment. In the meantime, in the data line DL, the direction of the writing current Ia flowing till the precharge current Ipre and the opposite ends' potential Vc of the capacitor Cs becomes 0V due to the no-light emission display voltage Vzero (to be described later) are inversed with each other. FIGS. 14A and 14B are conceptual drawings showing the operation example (writing operation/light emission operation) of the light emission drive circuit according to the embodiment. Here, the explanations of the control operations equivalent of the drive control methods shown in the first and second examples (FIGS. 2, 3A, 3B, 10, and 11) will be herein simplified.

In any case of the first and second examples, the supplying voltage Vsc may be displaced from the low potential selection voltage value Vs into the high potential light emission voltage value Ve upon moving from the writing operation time period Twr to the light emission operation time period Tem. Therefore, the electric charges such as a parasitic capacitance of the holding transistor Tr 11 is displaced and the gate potential of the drive transistor Tr 13 is increased. According to the first and second examples, even if the charging voltage Vc written in the capacitor Cs is located in the vicinity of the threshold voltage Vth13 in the voltage correction operation time period Tvt of the prior one processing cycle time period Tcyc, the light emission drive current Iem flows by such a slight gate potential displacement, and the no-light emission operation may be unstable. For this reason, it is preferable that this charging voltage Vc is completely discharged, and the gate-to-source voltage Vgs of the drive transistor Tr 13 is set at 0V (the contact N11 and the contact N12 has the same potential). In the case where such writing operation is carried out by using the gradation sequence current Idata of the minute current value, it takes relatively long time till the writing current Ia becomes zero and the electric charges of the capacitor Cs is discharged. Particularly, the more the charging voltage Vc written in the capacitor Cs is near the maximum luminance gradation sequence voltage Vmsb in the voltage correction operation time periods Tvt of the prior one processing cycle time period Tcyc, the more the electric charges amount held in the capacitor Cs is, so that it takes more long time.

According to the drive control method shown in the above-describe first example, the method to accumulate the electric charges equivalent of the threshold voltage Vth13 in the capacitor Cs connected between the gate and the source of the drive transistor Tr 13 as the transistor for the light emission driving prior to the writing operation. Accordingly, as shown in FIG. 6, relatively long time about 3 msec is necessary till the gate-to-source voltage Vgs (the opposite ends' potential Vc of the capacitor Cs) decreases into the threshold voltage Vth13. In addition, in order to realize the no-light emission display operation to hold the organic EL element in the no-light emission state in the light emission operation time period Tem, it is necessary to set the voltage (the opposite ends' potential Vc) charged in the capacitor Cs by the gradation sequence current Idata to be supplied in the writing operation time period Twr after threshold correction time period Tth is terminated (namely, after laps of 3 msec) at the value less than the threshold voltage Vth13.

In the same way, according to the drive control method shown in the second example, the method to accumulate the electric charges equivalent of the minimum luminance voltage Vlsb in the capacitor Cs connected between the gate and the source of the drive transistor Tr 13 prior to the writing operation is employed. Accordingly, as shown in FIG. 6, the operation to correct the charging voltage Vc of the capacitor Cs can be approximately reduced to about 100 to 200 μsec. However, in order to realize the no-light emission display operation, it is necessary to set the voltage (the opposite ends' potential Vc) charged in the capacitor Cs at the value less than the threshold voltage Vth13 by the gradation sequence current Idata supplied in the writing operation time period Twr.

Thus, according to the present embodiment, as shown in FIG. 13, the drive control method is carried out by setting the light emission drive circuit so as to include the precharge operation time period Tpre to accumulate the electric charges based on the precharge voltage Vpre in the capacitor Cs of the light emission drive circuit DC within the one processing cycle time period Tcyc; the voltage correction operation time period Tvt to remain the electric charges equivalent of the minimum luminance voltage Vlsb or the electric charges equivalent of the threshold value voltage Vth13 and to hold it while partially discharging the electric charges accumulated in the capacitor Cs; the writing operation time period Twr to apply the gradation sequence signal (the no-light emission display voltage Vzero) in accordance with the no-light emission display data and to discharge most of the electric charges held in the capacitor Cs; and the light emission operation time period Tem to prevent the organic EL element OEL from performing the light emission operation (to make the organic EL element OEL to perform the no-light emission operation) ($Tcyc \geqq Tpre+Tvt+Twr+Tem$).

In other words, as same as the embodiment shown in the first example or the second example, the drive control method is employed to set the electric charges accumulated between the gate and the source (the capacitor Cs) of the transistor for the light emission driving (the drive transistor Tr 13) at the value equivalent of the threshold voltage Vth13 at once or the value equivalent of the voltage (the minimum luminance voltage Vlsb) for generating the light emission drive current upon performing the light emission operation at the minimum luminance gradation sequence (LSB) in the precharge operation and the voltage correction operation prior to the writing operation time period Twr and set the gate-to-source voltage Vgs (the opposite ends' potential Vc of the capacitor Cs) at 0V by directly applying the no-light emission display voltage Vzero equivalent to the selection voltage value Vs as the supplying voltage Vsc from the signal drive circuit SDR to the light emission drive circuit DC (the contact point N12) via the data line DL as shown in FIG. 14A in the following writing operation.

Thereby, the almost all of the electric charges accumulated in the capacitor Cs are discharged and the gate-to-source voltage Vgs of the drive transistor Tr 13 is set at the sufficiently lower voltage value (about 0V) than the threshold voltage Vth13. Consequently, even if the supplying voltage Vsc is displaced from the low potential selection voltage value Vs to the high potential light emission voltage value Ve and the gate potential of the drive transistor Tr 13 is slightly increased upon moving from the writing operation time period Twr into the light emission operation time period Tem, the gate-to-source voltage of the drive transistor Tr 13 is sufficiently lower than the threshold voltage Vth13. Therefore, as shown in FIG. 14B, the drive transistor Tr 13 is not turned on (held in the off state) and the light emission drive current Iem is not supplied to the organic EL element OEL, so that the light emission operation is not carried out (becomes the no-light emission state).

Here, timing for applying the no-light emission display voltage Vzero from the signal drive circuit SDR to the light emission drive circuit DC is set at the time when the gate-to-source voltage Vgs attains to the threshold voltage Vth13 or the minimum luminance voltage Vlsb in the writing operation time period Twr as same as the embodiment shown in the first example or the second example. Therefore, the timing is set in such a manner that, in the voltage correction operation time period Tvt after the precharge operation, for example, when about 100 to 200 μsec elaps after staring the correction operation in the graph shown in FIG. 6, terminating the voltage correction operation time period Tvt and moving to the writing operation time period Twr, the no-light emission display voltage Vzero is applied.

Thereby, it is possible to largely reduce time that is necessary for the precharge operation and the voltage correction operation carried out prior to the writing operation. Further, as compared to the case that the gradation sequence current in accordance with the no-light emission display data is supplied via the data line DL upon the no-light emission display operation (the no-light emission operation) and the almost all of the electric charges accumulated in the capacitor Cs that is connected between the gate and the source of the drive transistor Tr 13 is discharged, it is possible to well realize the no-light emission display operation while largely reducing time necessary for the writing operation of the no-light emission display data. Accordingly, in addition to the normal gradation sequence display operation in the embodiment shown in the first example or the second example, the no-light emission display operation in the embodiment shown in the third example is controlled to be switched in accordance with the display data and this makes it possible to realize the light emission operation of the desired number of the gradation sequences (for example, 256 gradation sequences) with a relatively high luminance and with sharpness.

Specifically, according to the first example, the switch means SM of the signal drive circuit SDR shown in FIG. 1 may output the precharge voltage Vpre to the data line DL in the precharge operation time period Tpre. Then, in the writing operation time period Twr after the threshold correction operation time period Tth, the switching means SM may output the no-light emission display voltage Vzero to the data line when the display data is the no-light emission display and may perform switching so that the gradation sequence current Idata flows through the data line DL when the display data is the light emission display.

In the same way, according to the second example, the switch means SM of the signal drive circuit SDR shown in FIG. 1 may output the precharge voltage Vpre to the data line DL in the precharge operation time period Tpre. Then, in the writing operation time period Twr after the voltage correction operation time period Tvt, the switch means SM may output the no-light emission display voltage Vzero to the data line DL when the display data is the no-light emission display, and it may perform switching so that the gradation sequence current Idata flows through the data line DL when the display data is the light emission display.

In addition, the embodiment (the drive control method) shown in the each example is described with reference to the circuit structure provided with three transistors Tr 11 to Tr 13 as the light emission drive circuit DC, as shown in FIG. 1. However, it is obvious that the present invention is not limited to this and the other circuit structure is available if it is a light emission drive circuit in accordance with a current designation system and it can effect a current and voltage conversion function to convert a gradation sequence current supplied in accordance with the display data into a voltage component by using a single thin film transistor and accumulate the voltage component in a capacitor connected between a gate and a source or a parasitic capacitance and a light emission drive function to control a light emission drive current to be supplied to a light emission element (an organic EL element) on the basis of the accumulated voltage component.

(Display Unit)

Next, a display unit provided with a display panel having a plurality of display pixels having the light emission drive circuits arranged in a matrix and its display drive method and its display drive method will be described with reference to the drawings below.

Figure 15:
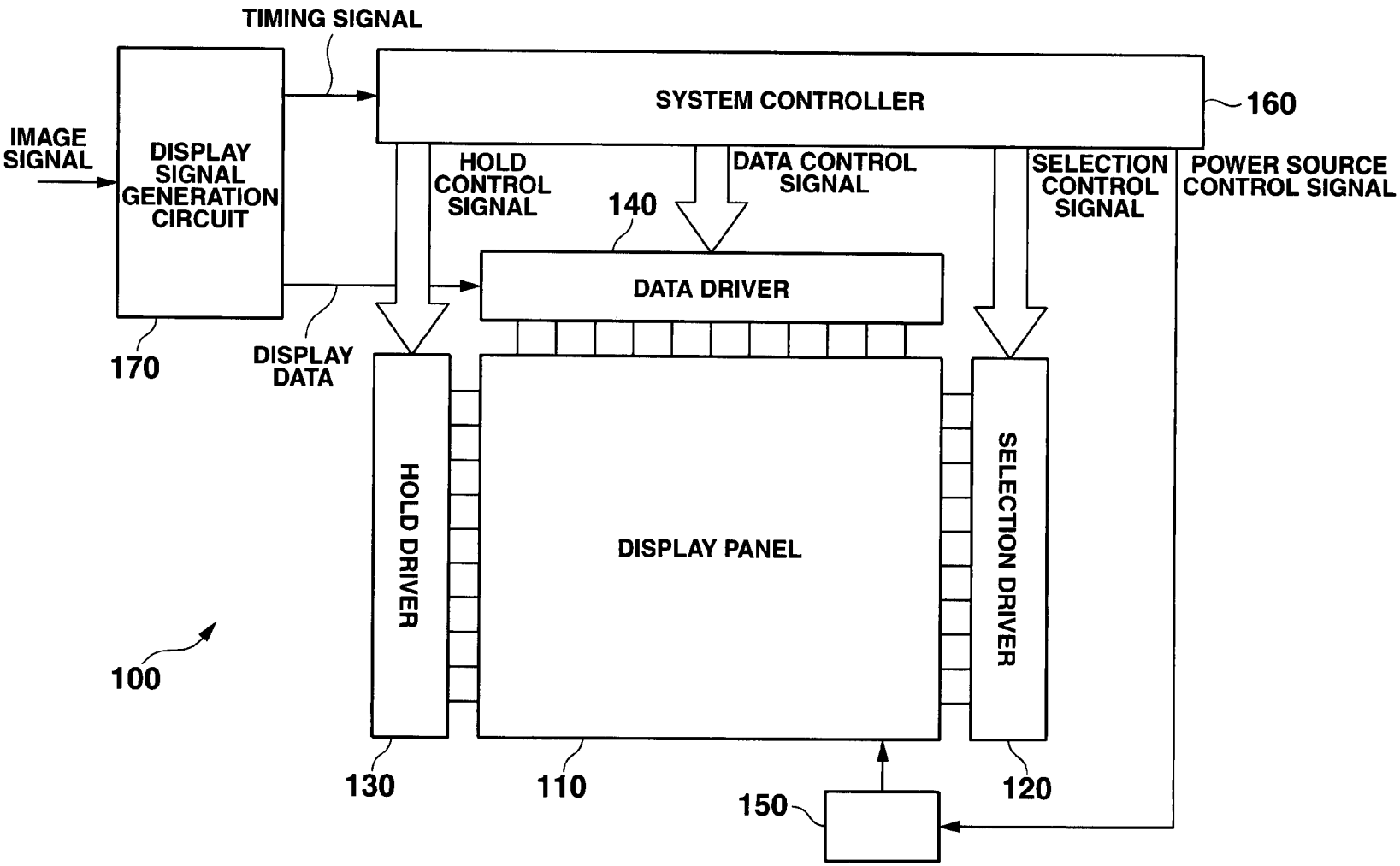
FIG. 15 is a schematic block diagram showing an example of the entire structure of a display unit according to the embodiment.
Figure 16:
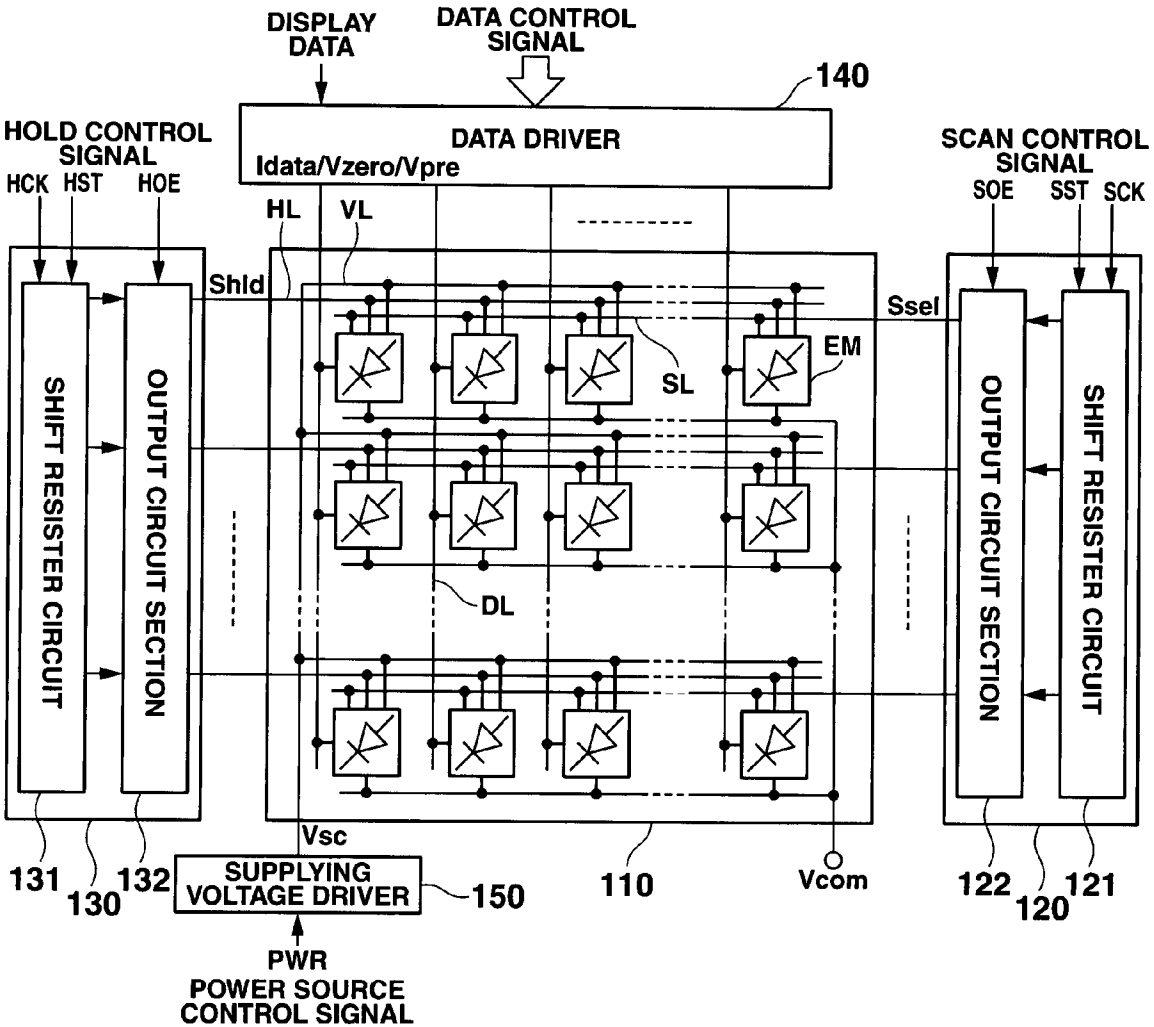
FIG. 16 is a schematic block diagram showing a display panel to be applied to the display unit according to the embodiment and an example of its peripheral circuit.

FIG. 15 is a schematic block diagram showing an example of the entire structure of a display unit according to the embodiment. FIG. 16 is a schematic block diagram showing a display panel to be applied to the display unit according to the embodiment and an example of its peripheral circuit (a selection driver, a holding driver, and a supplying voltage driver). Here, the display unit provided with a function to selectively perform the gradation sequence display operation shown in the above described first or second example and the no-light emission display operation shown in the third example will be described. In addition, the structure equivalent of the display pixel (the light emission drive circuit; refer to FIG. 1) is given the same or the equal reference numeral or mark to simplify its explanation.

As shown in FIGS. 15 and 16, a display unit 100 according to the present embodiment is configured so as to include a display panel 110 arranged in a matrix composed of n rows x m columns (n, m is an arbitrary positive integer) of plural display images provided with the light emission drive circuit DC having the same circuit structure as the embodiment and the organic EL element (the light emission element) OEL located in the vicinity of each intersection point between the plural selection lines SL arranged in approximately a row direction and the plural data lines DL arranged in a column direction; a selection driver 120 that is connected to the selection line SL of this display panel 110 for sequentially applying a selection signal (a writing control terminal) Ssel for each selection line SL at predetermined timing; a holding driver 130 that is connected to a hold line HL arranged in the row direction in parallel with each of the selection lines SL for sequentially applying the hold signal (the voltage control signal) Vhid at predetermined timing; a data or signal driver 140 that is connected to the data line DL of the display panel 110 for supplying the precharge voltage Vpre to the display pixel EM via each data line DL in the precharge operation Tpre and supplying the gradation sequence signal (the gradation sequence current Idata or the no-light emission display voltage Vzero) in accordance with the display data to the display pixel EM via each data line DL in the writing operation time period Twr; a supplying voltage driver 150 that is connected to the supplying voltage line VL connected to the all display pixels EM arranged in the display panel 110 in common for applying a predetermined supplying voltage Vsc to the supplying voltage line VL; a system controller 160 for generating a selection control signal to control the operation states of at least the selection driver 120 and the holding driver 130, the data driver 140, and the supplying voltage driver 150 on the basis of the timing signal to be supplied from a display signal generation circuit 170 to be described later; the hold control signal, the data control signal, and a power source control signal and outputting them; and the display signal generation circuit 107, which generates the display data (the luminance gradation sequence data), for example, on the basis of the image signal to be supplied from the outside of the display unit 100 and supplies it to the data driver 140, extracts or generates a timing signal (the system clock or the like) for displaying predetermine image information on the display panel 110 on the basis of the display data and supplies it to the system controller 160.

The each configuration will be specifically described below.

(Display Panel)

As same as the embodiment (refer to FIG. 1), the display pixel EM arranged in the display panel 110 shown in FIG. 16 is configured so as to have a selection signal Ssel to be applied from the selection driver 120 via the selection line SL and a hold signal Shld to be applied from the holding driver 130 via the hold line HL; a gradation sequence signal to be supplied from the signal driver 140 via the data line DL (the gradation sequence current Idata or the no-light emission display voltage Vzero); the light emission drive circuit DC that carries out the precharge operation and the threshold correction operation (or the voltage correction operation) described in the each drive control method, the writing operation, and the light emission operation on the basis of the supplying voltage Vsc to be applied from the supplying voltage driver 150 via the supplying voltage line VL; and the organic EL element (light emission element) OEL performing the light emission operation at a predetermined luminance gradation sequence in accordance with the current value of the light emission drive current Iem to be supplied from this light emission drive circuit DC. In the meantime, according to the present embodiment, the case that the organic EL element OEL is applied as the light emission element will be described, as same as the embodiment (refer to FIG. 1). However, the other light emission element is available if it is a current control type of a light emission element to perform the light emission operation at a predetermined luminance gradation sequence in accordance with the current value of the light emission drive current.

(Selection Driver)

The selection driver 120 sets the display pixel EM for each row at the selection state by applying the on-level selection signal Ssel to each selection line SL on the basis of the selection control signal to be supplied from the system controller 160. According to the display unit of the embodiment (to be described in detail later with reference to the drive control method (refer to FIG. 20)), in the precharge operation time period, applying the selection signal Ssel to at least plural rows of selection lines SL, preferably, to the all rows of selection lines SL simultaneously, plural rows of the display panel 110, preferably, the all display pixels EM are set at the selection state at the same time. On the other hand, in the panel writing operation time period, the selection signal Ssel is sequentially applied to each row of the selection line SL, whereby the display pixel EM for each row is sequentially controlled so as to be set at the selection state.

For example, as shown in FIG. 16, the selection driver 120 is configured so as to have a shift resistor 121 for sequentially outputting a shift signal in accordance with each row of the selection line SL on the basis of a selection clock signal SCK to be supplied from the system controller 160 to be described later and a selection start signal SST as a selection control signal; and an output circuit section 122 that converts a shift signal outputted from this shift resistor 121 into a predetermined signal level (the on-level) and outputs this shift signal to each selection line SL as the selection signal Ssel on the basis of an output control signal SOE supplied from a system controller 160 as a selection control signal.

Here, in the selection driver 120 according to the present embodiment, particularly, the output circuit section 122 is configured so as to have a function (mode) to sequentially output a shift signal sequentially outputted from the shift resister 121 to each row of the selection line SL as the on-level selection signal Ssel; and a function (mode) for simultaneously outputting the on-level selection signal Ssel to at least plural rows of the selection lines SL, preferably, the all selection lines SL regardless of the shift signal from the shift resistor 121, and on the basis of the output control signal SOE, these functions are configured allowed to be switched.

In other words, as described in later, in the operation for supplying the gradation sequence signal to each row of display pixel EM arranged on the display panel 110 and sequentially writing the display data therein (the panel writing operation), the output circuit section 122 is set at the mode to sequentially output the selection signal Ssel to each selection line SL. In the operation for accumulating (charging) the electric charges in accordance with a predetermined precharge voltage Vpre in at least plural rows of the selection lines SL arranged on the display panel 110, preferably, in the all display pixels EM prior to the panel writing operation, the output circuit section 122 is set at the mode to simultaneously output the selection signal Ssel to at least plural rows of the selection lines SL, preferably, the all selection lines SL.

(Holding Driver)

The holding driver 130 may hold the applying state of a predetermined voltage to a gate terminal of a transistor for the light emission driving provided to the display pixel EM for each row (corresponding to the light emission drive circuit Tr 13 shown with reference to the embodiment) by applying the on-level hold signal Shld to each hold line HL on the basis of the hold control signal supplied from the system controller 160.

According to the display unit of the embodiment (to be described in detail later with reference to the drive control method (refer to FIG. 20)), in the precharge operation time period and the threshold correction operation time period (or the voltage correction time period), the hold signal Shld is applied to at least plural rows of hold lines HL, preferably, to the all rows of hold lines HL simultaneously. Then, plural rows of the display panel 110, preferably, the all display pixels EM are set at the selection state at the same time. On the other hand, in the panel writing operation time period, the hold signal Shld is sequentially applied to each row of the hold line HL, whereby the display pixel EM for each row is sequentially controlled so as to hold the gate voltage of the transistor for the light emission driving provided to the display pixel EM for each row.

For example, as shown in FIG. 16, as same as the selection drier 120, the hold driver 130 is configured so as to have a shift resistor 131 for sequentially outputting a shift signal corresponding to the hold line HL of each row on the basis of a hold clock signal HCK and a hold start signal HST to be supplied from the system controller 160 as a hold control signal and an output circuit section 132 for converting this shift signal into a predetermined signal level (on level) and outputting the shift signal to each hold line HL as the hold signal Shld on the basis of an output control signal HOL to be supplied as the hold control signal.

Here, in the hold driver 130 according to the present embodiment, particularly, the output circuit section 122 is configured so as to have a function (mode) to sequentially output a shift signal sequentially outputted from the shift resister 121 to each row of the hold line HL as the on-level hold signal Shld; and a function (mode) for simultaneously outputting the on-level hold signal Shld to at least plural rows of the hold lines HL, preferably, the all hold lines HL regardless of the shift signal from the shift resistor 121, and on the basis of the output control signal HOE, these functions are configured allowed to be switched.

In other words, as described later, in the operation for supplying the gradation sequence signal to each row of display pixel EM arranged on the display panel 110 and sequentially writing the display data therein (the panel writing operation), the output circuit section 122 is set at the mode to sequentially output the hold signal Shld to each hold line HL. In the operation for accumulating (charging) the electric charges in accordance with a predetermined precharge voltage Vpre in at least plural rows of the display pixels EM arranged on the display panel 110, preferably, in the all display pixels EM prior to the panel writing operation and the operation for partially discharging the accumulated electric charges, remaining the electric charges corresponding to the threshold voltage Vth13 (or the minimum luminance voltage Vlsb), and holding it, the output circuit section 122 is set at the mode to output the hold signal Shld to at least plural rows of the hold signals HL, preferably, the all hold signals HL.

(Data Driver)

Figure 17:
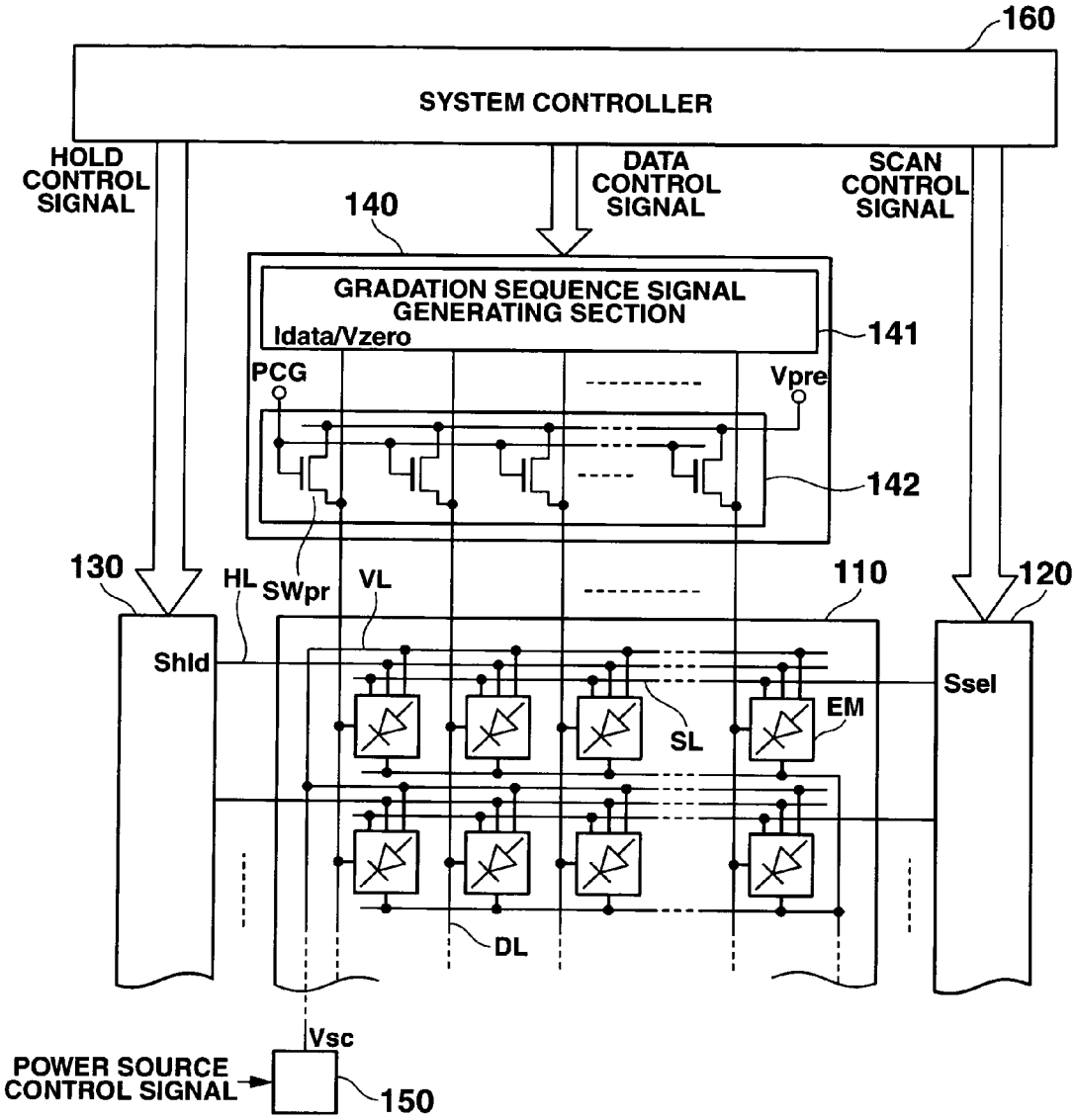
FIG. 17 is a schematic block diagram showing an example of a data driver that can be applied to the display unit according to the embodiment.
Figure 18:
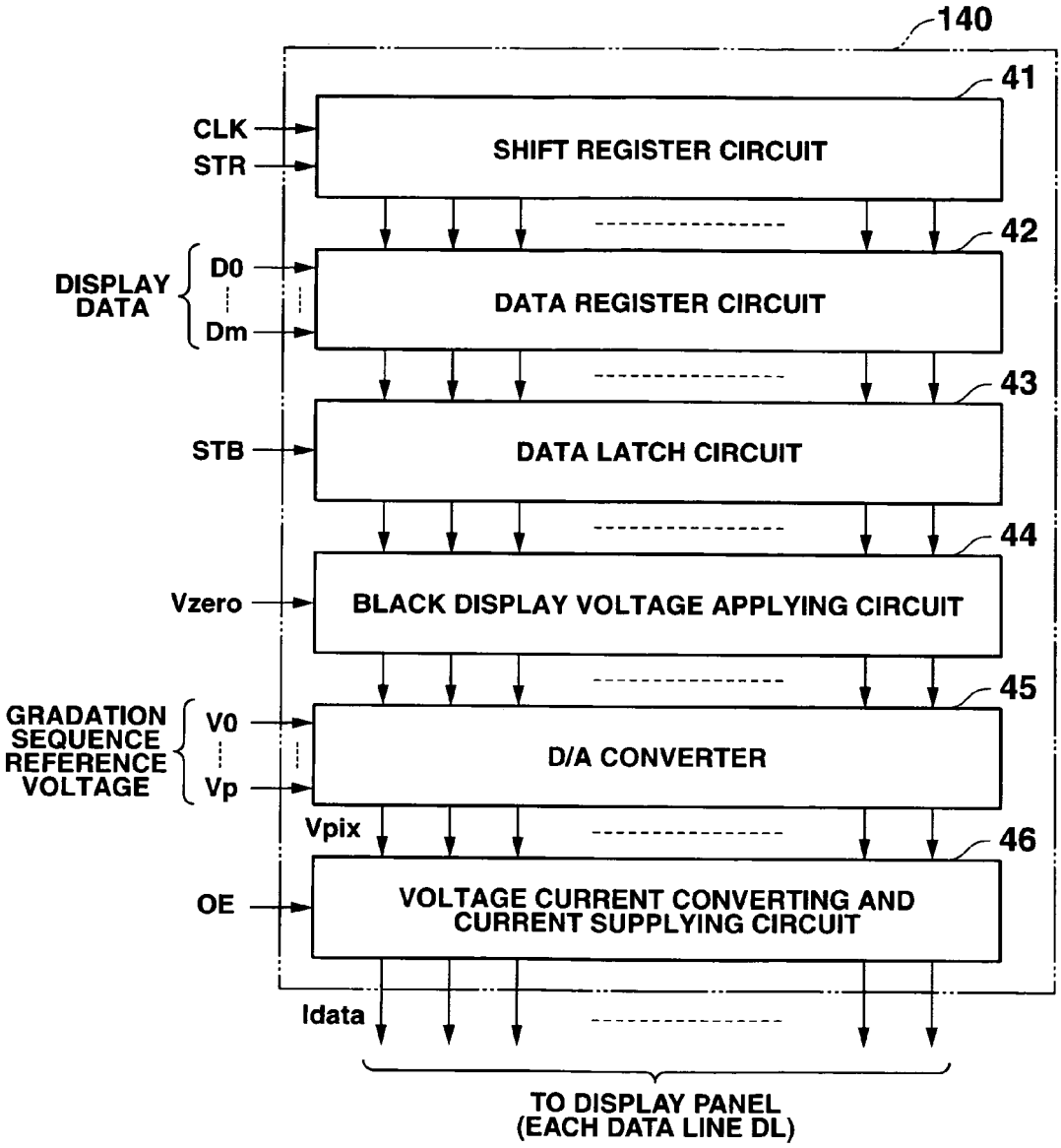
FIG. 18 is a schematic block diagram showing an example of a gradation sequence signal generating section that can be applied to the data driver according to the embodiment.
Figure 19:
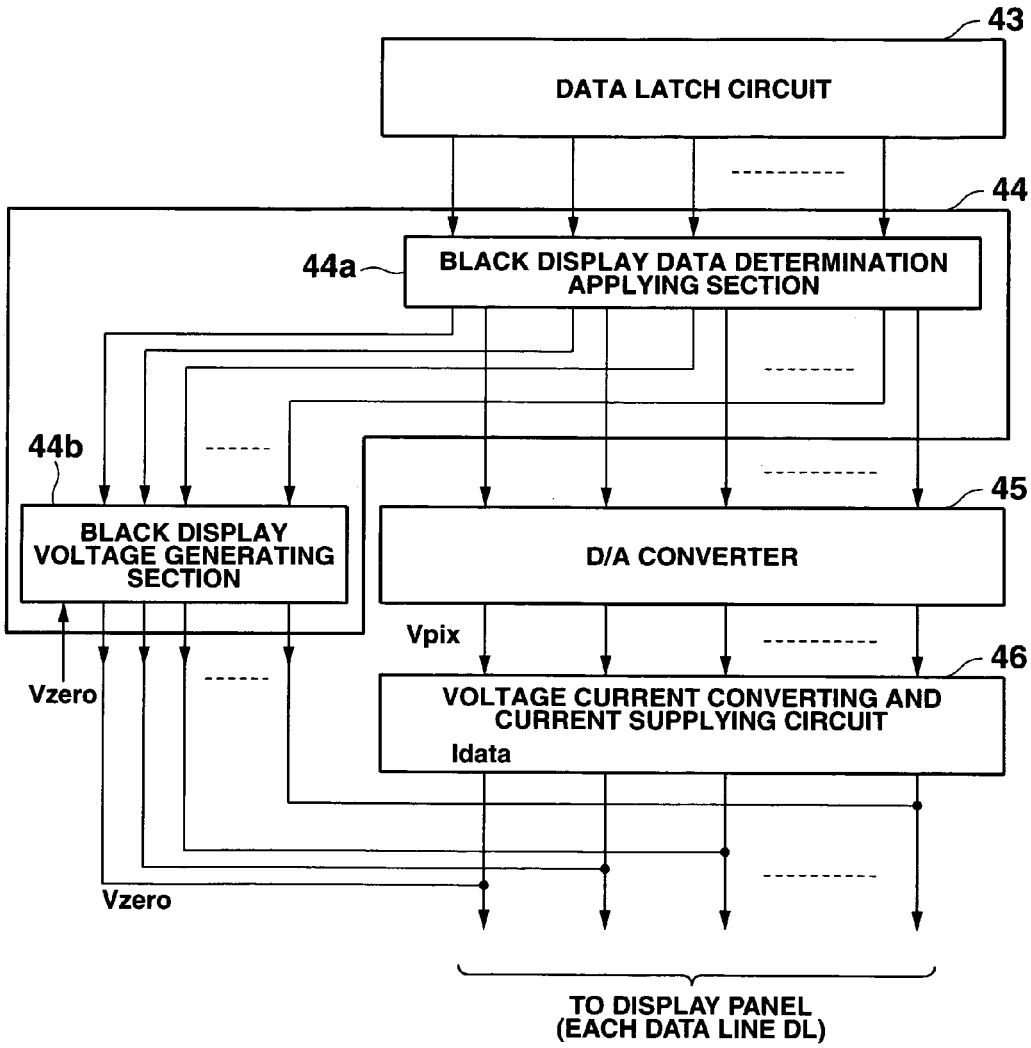
FIG. 19 is a schematic block diagram showing the structures of substantial parts of a gradation sequence signal generating section that can be applied to the data driver according to the embodiment.

FIG. 17 is a schematic block diagram showing an example of a data driver that can be applied to the display unit according to the embodiment. FIG. 18 is a schematic block diagram showing an example of a gradation sequence signal generating section that can be applied to the data driver according to the embodiment. FIG. 19 is a schematic block diagram showing the structures of substantial parts of a gradation sequence signal generating section that can be applied to the data driver according to the embodiment. In the meantime, with respect to the inner structure of the data driver shown in FIGS. 17 to 19, the applicable example is only shown and the present embodiment is not limited to this.

As outlined in FIG. 17, a data driver 140 is configured so as to have a gradation sequence signal generating section 141 that sequentially fetches the display data (the luminance gradation sequence data) composed of a digital signal supplied from the display signal generation circuit 170 to be described later for each row at a predetermined timing on the basis of a data control signal to be supplied from the system controller 160 and holding it, generates the gradation sequence current Idata having the current value corresponding to a gradation sequence value when the gradation sequence of the display data is a value other than 0 bit (namely, the no-light emission display), on the other hand, generates a specific voltage (the no-light emission display voltage) Vzero for performing the no-light emission display operation when the gradation sequence value is a value of 0 bit (the no-light emission display), and simultaneously supplies this specific voltage Vzero to the display pixel EM of each row set at the selection state in the panel writing operation time period via each data line DL; and a precharge voltage supplying section 142 that controls the on and off operations of a transistor switch SWpr of which one end is connected to each data line DL on the basis of a data control signal (a precharge signal PCG) to be supplied from the system controller 160, and simultaneously supplies a predetermined precharge voltage Vpre to at least plural rows of the display pixels EM arranged on the display panel 110, preferably, to the all display pixels EM via the each data line DL.

Here, for example, as shown in FIG. 18, the gradation sequence signal generating section 141 is configured so as to have a shift resistor 41 for sequentially outputting a shift signal on the basis of the data control signal (a shift clock signal CLK and a sampling start signal STR) supplied from the system controller 160; a data resistor circuit 42 for sequentially fetching the display data D0 to Dm for one row to be supplied from the display signal generation circuit 170 on the basis of input timing of this shift signal; a data latch circuit 43 that holds the display data D0 to Dm for one row fetched by the data resistor circuit 42 on the basis of a data control signal (a data latch signal STB); a no-light emission display voltage applying circuit 44 that detects the no-light emission display data (the gradation sequence value of 0 bit) from the display data D0 to Dm held by this data latch circuit 43, applies a predetermined no-light emission display voltage Vzero to the data line DL of a row corresponding to this display data, and passes the display data D0 to Dm other than the no-light emission display data as they are and outputting it to a D/A converter 45 of the next stage; a D/A converter 45 that converts the display data D0 to Dm (other than the no-light emission display data) inputted passing through the no-light emission display voltage applying circuit 44 into a predetermined analog signal voltage (the gradation sequence voltage Vpix) on the basis of gradation sequence reference voltages V0 to VP supplied from power source supplying means (its illustration is herein omitted); and a voltage current converting and gradation sequence current supplying circuit 46 that generates the gradation sequence current Idata corresponding to the displace data converted into the analog signal voltage, and outputs it to the data line DL of a row corresponding to this display data at timing based on a data control signal (an output enable signal OE) to be supplied from the system controller 160.

Here, for example, as shown in FIG. 19, the no-light emission display voltage applying circuit 44 is configured so as to have a no-light emission display data determining section 44*a* that detects the display data having the gradation sequence of 0 bit as the no-light emission display data among the display data D0 to Dm composed of the digital data held in the data latch circuit 43 in accordance with each of the specific rows; and a no-light emission display voltage generating section 44*b* that directly applies a predetermined no-light emission display voltage Vzero to the data line DL of the row that is determined as the no-light emission display data without going through the D/A converter 45 of the next stage and the voltage current converting and gradation sequence current supplying circuit 46 of the next stage.

As indicated in the drive control method according to the third example, the no-light emission display voltage Vzero applied to the data line DL by the no-light emission display voltage generating section 44*b* is set at an arbitrary voltage value necessary for making the gate-to-source voltage Vgs into 0V (or brings it close to 0V) by discharging the electric charges accumulated between the gate and the source of the transistor for the light emission operation (the drive transistor Tr 13) of the light emission drive circuit DC configuring the display pixel EM due to the precharge operation and the threshold correction operation (or the voltage correction operation).

(Supplying Voltage Driver)

The supplying voltage driver 150 applies the supplying voltage Vsc of the high level light emission voltage value Ve to at least plural rows of display elements EM, preferably, to the all display elements EM via the supplying voltage line VL only in a period of time to make each display pixel EM (the organic EL element OEL) arranged in the display panel 110 on the basis of a power source control signal (a supplying voltage switch signal PWR) to be supplied from the system controller 160 and the supplying voltage driver 150 applies the supplying voltage Vsc of the low level selection voltage value Vs to at least plural rows of display pixels EM, preferably, to the all display pixels EM in the other period of time.

The supplying voltage Vsc of the low level selection voltage value Vs is applied from the supplying voltage driver 150 to at least plural rows of display pixels EM, preferably, to the all display pixels EM in the precharge operation time period in which at least plural rows of display pixels EM arranged in the display panel 110, preferably, the all display pixels EM are simultaneously supplied to charge; in the threshold correction operation time period (or the voltage correction operation time period) in which the precharge voltage Vpre is partially discharged and the threshold Vth13 (or the minimum luminance voltage Vlsb) is held in at least plural rows of display pixels EM, preferably, to the all display pixels EM; and the panel writing operation time period for sequentially setting the display pixel group EM of each row at the selection state and writing the gradation sequence signal (the gradation sequence current Idata or the no-light emission display voltage Vzero (specifically, described in detail later).

(System Controller)

The system controller 160 may operate each driver at a predetermined timing by generating a selection control signal to control the operation state of each of the selection driver 120 and the holding driver 130, the data driver 140, and the supplying voltage driver 150, a hold control signal, a data control signal, and a power source control signal and outputting them to generate the selection signal Ssel and a hold signal Shld having a predetermined voltage level, a gradation sequence signal (the gradation sequence current Idata, the no-light emission display voltage Vzero), and a supplying voltage Vsc and output them; and may continuously perform the drive control operation (the precharge operation, the threshold correction operation (or the voltage correction operation), the panel writing operation, and the light emission operation)) in each display pixel EM (the light emission drive circuit DC) to display predetermined image information based on an image signal on the display panel 110.

(Display Signal Generating Circuit)

The display signal generation circuit 170 may extract a luminance gradation sequence signal component, for example, from the image signal to be supplied form the outside of the display unit 100 and may supply this luminance gradation sequence signal component to the data resistor circuit 42 of the data driver 140 as the display data (the luminance gradation sequence data) composed of the digital signal for each row of the display panel 110. Here, in the case where the image signal includes the timing signal component to define the display timing of the image information like a TV broadcast signal (a composite image signal), the display signal generation circuit 170 may have a function to extract the timing signal component and supply it to the system controller 160 other than a function to extract the luminance gradation sequence signal component. In this case, the system controller 160 may generate each control signal to be individually supplied to the selection driver 120 and the holding driver 130, the data driver 140, and the supplying voltage driver 150 on the basis of the timing signal supplied from the display signal generation circuit 170.

(Display Drive Method of Display Unit)

Next, a display drive method (the display operation of the image information) in a display unit according to the present embodiment will be described below.

Figure 20:
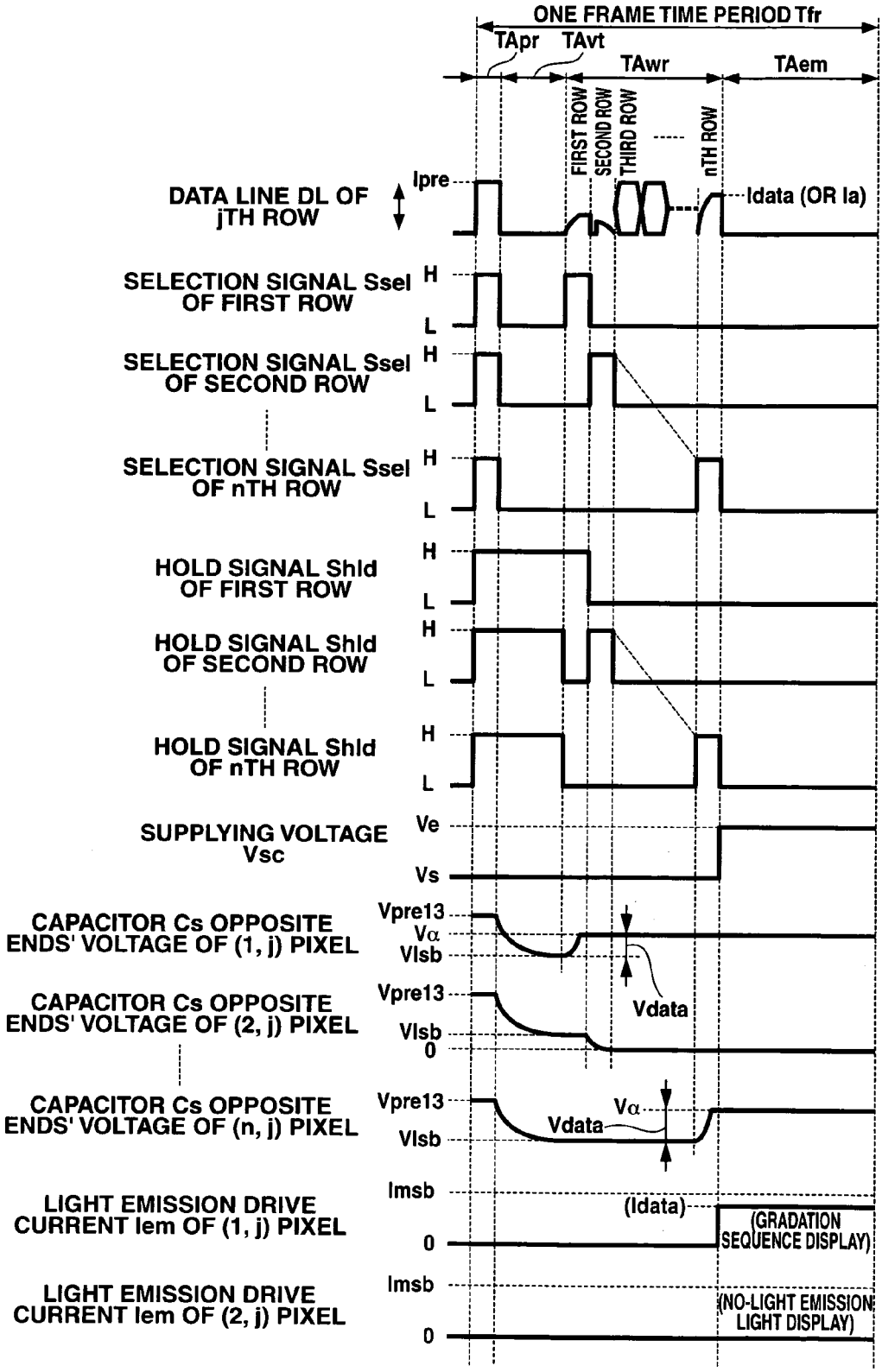
FIG. 20 is a timing chart showing an example of a display drive method of the display unit according to the embodiment.

FIG. 20 is a timing chart showing an example of the display drive method of the display unit according to the embodiment. Here, the case to apply the drive control method shown in the second example and the third example in the display pixel EM (the light emission drive circuit DC) shown in the embodiment (refer to FIG. 1) to the display unit of the embodiment will be described with reference to the display operation of the image information, and the description of the equivalent drive control method is herein omitted.

The drive control operation of the display operation of the display unit 100 according to the present embodiment, as shown in FIG. 20, is carried out by setting the light emission drive circuit so as to include a precharge operation time period TApr of accumulating the electric charges corresponding to the precharge voltage Vpre in each display pixel EM (the light emission drive circuit DC) by simultaneously setting at least plural rows of the display pixels EM displayed on the display panel 110, preferably, the all display pixels, EM at the selection state and applying a predetermined precharge voltage Vpre from the precharge voltage supplying section 142 provided in the data driver 140 via the data line DL within one frame time period Tfr (equivalent to the one processing cycle time period Tcyc); a voltage correction operation time period TAvt of partially discharging the electric charges accumulated in each display pixel EM and remaining the electric charges equivalent to the voltage (the minimum luminance voltage) set in the transistor for the light emission driving (equivalent to the voltage the drive transistor Tr 13) when making the light emission element provided in each display pixel EM (the organic EL element OEL) and holding the electric charges; a writing operation time period TAwr of accumulating the electric charges corresponding to the gradation sequence signal in each display pixel EM by setting the display pixels EM displayed on the display panel 110 for each line at the selection state and applying the gradation sequence signal (the gradation sequence current Idata or the no-light emission display voltage Vzero) from the gradation sequence signal generating section 141 provided in the data driver 140 via the data line DL in accordance with the display data; and a light emission operation time period TAem of making the light emission elements (the organic EL elements) to simultaneously perform the light emission operation at a luminance gradation sequence in accordance with the display data on the basis of the electric charges accumulated in the each display pixel EM (Tfr TApr+TAvt+TAwr+TAem). Here, the precharge operation time period TApr, the voltage correction operation time period TAvt, the writing operation time period TAwr, and the light emission operation time period TAem are set so that they do not temporarily overlap with each other.

(Precharge Operation Time Period)

First, in the precharge operation time period TApr, as shown in FIG. 20, the on-level selection signal Ssel is applied to at least plural rows of the display pixels EM, preferably, the all selection lines SL from the selection driver 120, whereby at least plural rows of the selection line displayed on the display panel 110, preferably, the all display pixels EM are simultaneously set at the selection state.

In addition, in synchronization with this timing, the low level supplying voltage Vsc (=Vs) is applied to at least plural rows of the display pixels EM, preferably, the all display pixels EM from the supplying voltage driver 150 via the common supplying voltage line VL, and the on-level hold signal Shld is applied to at least plural rows of the display pixels EM, preferably, the all hold lines HL from the hold driver 130. As a consequence, plural rows of the display pixels EM, preferably, the all display pixels EM are set at the hold state (in detail, the state that the voltage based on the low level supplying voltage Vsc is applied on a gate of the transistor for the light emission driving (the drive transistor Tr 13) configuring the light emission drive circuit DC shown in FIG. 1).

Then, a predetermined precharge voltage Vpre is applied to plural rows of the data lines DL, preferably, the all data lines DL from the precharge voltage supplying section 142 provided on the data driver 140 in synchronization with this timing. Consequently, the electric charges corresponding to the precharge voltage Vpre is accumulated in the plural rows of the display pixels EM, preferably, the all display pixels EM (in detail, between the gate and the source of the transistor for the light emission driving (the drive transistor Tr 13) configuring the light emission drive circuit SC; the opposite ends of the capacitor Cs (refer to the opposite ends' potential Vc of each display pixel of FIG. 20).

(Potential Correction Operation Time Period)

Next, in the voltage correction operation time period TAvt, as shown in FIG. 20, by holding the supplying voltage Vsc to be applied from the supplying voltage driver 150 to each display pixel EM at a low level (Vs) and applying the off-level selection signal Ssel to at least plural rows of the selection liens SL, preferably, the all selection lines SL from the selection driver 120 with the hold signal Shld to be applied from the hold driver 130 to each display pixel EM held at the on level, at least plural rows of the display pixels EM, preferably, the all display pixels EM are simultaneously set at the no-selection state.

Thereby, as the drive control method shown in FIG. 2, the electric charges accumulated in each display pixel EM (between the gate and the source of the transistor for the light emission driving configuring the light emission drive circuit DC; the opposite ends of the capacitor Cs) is partially discharged and the potential on the basis of the electric charges accumulated (held) in the each display pixel EM (the gate-to-source voltage Vgs of the transistor for the light emission driving; the opposite ends' potential Vc of the capacitor Cs) is changed so as to decrease from the precharge voltage Vpre into the threshold voltage Vth13 of the transistor for the light emission driving (the drive transistor Tr 13).

Here, in the voltage correction operation time period TAvt, when the potential based on the electric charges accumulated (held) in each display pixel EM (the opposite ends' potential Vc of the capacitor Cs) is lowered to a voltage value (the minimum luminance voltage Vlsb) upon the light emission operation of the light emission element (the organic EL element OEL) provided in each display pixel at the minimum luminance gradation sequence, this correction operation is terminated to move to the following panel writing operation.

In other words, due to the series of precharge operation and voltage correction operation, the electric charges in accordance with the minimum luminance voltage Vlsb is accumulated in at least plural rows of the display pixels EM arranged on the display panel 110, preferably, the all display pixels EM (between the gate and the source of the transistor for the light emission driving).

(Panel Writing Operation Time Period)

Subsequently, in the panel writing operation time period TAwr, as shown in FIG. 20, the on-level selection signal Ssel is sequentially applied from the selection driver 120 to the selection line SL of each row so that they do not temporarily overlap with each other, and the off-level selection signal Ssel is applied to the selection line SL of the remaining row, whereby the display pixel EM of each row is sequentially set at the selection state.

In addition, the on-level hold signal Shld is sequentially applied to the hold line HL of the row set at the selection state from the hold driver 130 in synchronization with this timing, and the off-level hold signal Shld is applied to the hold line HL of the row that is not selected. Thereby, the display pixel EM of each row at the selection state is sequentially set at the hold state (the state that the voltage on the basis of the low-level supplying voltage Vsc (=Vs) is applied at the gate of the transistor for the light emission driving (the drive transistor Tr 13)). In the meantime, in the panel writing operation time period TAwr, following the precharge operation time period TApr and voltage correction operation time period TAvt, the state that the low-level supplying voltage Vsc (=Vs) is applied to at least plural rows of the display pixels EM, preferably, the all display pixels EM from the supplying voltage driver 150 is kept.

Then, the gradation sequence signal (the gradation sequence current Idata or the no-light emission display voltage Vzero) on the basis of the display data (the digital data) supplied from the display signal generation circuit 170 is applied to at least plural rows of the data lines DL, preferably, the all data lines DL from the gradation sequence signal generating section 141 provided in the data driver 140 in synchronization with this timing. Thereby, the voltage component based on this gradation sequence signal is charged (written) in the display pixel EM (between the gate and the source of the transistor for the light emission driving; the opposite ends of the capacitor Cs) of the row set at the selection state.

Here, in the case where the display data to be supplied from the display signal generation circuit 170 to the data driver 140 is the luminance gradation sequence data other than the no-light emission display data (the gradation sequence value other than 0 bit) as same as the drive control method shown in the second example and third example, the gradation sequence current Idata in accordance with this display data is generated by the data driver 140 to flow on the data line DL of the corresponding row. On the other hand, when the display data to be supplied from the display signal generation circuit 170 is the no-light emission display data (the gradation sequence value of 0 bit), a predetermined no-light emission display voltage Vzero is generated from the data driver 140 to be supplied to the data line DL of the corresponding row.

In FIG. 20, in order to explain the state that those two kinds of gradation sequence signals are supplied, as an example, the case is shown, in which the gradation sequence current Idata based on the luminance gradation sequence data other than the no-light emission display data (the gradation sequence value other than 0 bit) is supplied to the display pixels EM at jth column of first and nth rows, and further, the no-light emission display voltage Vzero based on the no-light emission display data (the gradation sequence value of 0 bit) is supplied to the display pixel EM at jth column of second row.

Accordingly, in the display pixel EM to which the gradation sequence current Idata is supplied as the gradation sequence signal, as shown in FIG. 20, the electric charges (the voltage component Vdata) based on this gradation sequence signal is accumulated in addition to the electric charges (the potential) in accordance with the minimum luminance voltage Vlsb held in each display pixel EX of the corresponding row (between the gate and the source of the transistor for the light emission driving). This results in that the voltage Vα in accordance with the display data is charged between the gate and the source of the transistor for the light emission driving.

In addition, in the display pixel EM to which the gradation sequence current Idata is supplied as the gradation sequence signal, as shown in FIG. 20, almost all of the electric charges in accordance with the minimum luminance voltage Vlsb held in each display pixel EX of the corresponding row is discharged and this results in that the voltage (0V) in accordance with the display data is set between the gate and the source of the transistor for the light emission driving.

The writing operation of the gradation sequence signal to the display pixel EX of each row is repeated based on timing that the selection signal Ssel is applied to the selection line SL of each row. Thereby, the display data (the gradation sequence signal) is written in at least plural rows of the display pixels EM arranged on the display panel 110, preferably, the all display pixels EM (refer to the opposite ends' potential Vc of the capacitor Cs of each display pixel in FIG. 20).

(Light Operation Time Period)

Subsequently, in the light emission operation time period TAem, as shown in FIG. 20, the selection signal Ssel is applied from the selection driver 120 to each selection line SL and the hold signal Shld is applied from the hold driver 130 to each hold line HL at the off level. Thereby, the display pixel EM of each row is set at the no-selection state and the no-holding state.

In addition, by applying the high level supplying voltage Vsc (=Ve) to at least plural rows of the display pixels EM, preferably, the all display pixels EM from the supplying voltage driver 150 in synchronization with this timing, at least plural rows of the display pixels EM, preferably, the all display pixels EM are set at the light emission state.

Thereby, the light emission drive current Iem in accordance with the display data (the gradation sequence signal) is generated on the basis of the voltage component held in each display pixel EM (between the gate and the source of the transistor for the light emission driving) to be supplied to the light emission element (the organic EL element OEL).

In other words, in the display pixel EM in which the gradation sequence signal (the gradation sequence current Idata) in accordance with the normal gradation sequence operation (other than the no-light emission display), the light emission drive current Iem having the current value almost the same as this gradation sequence current Idata is generated to be supplied to the light emission element (the organic EL element OEL). Then, the light emission operation is carried out at a predetermined luminance gradation sequence in accordance with the display data (refer to the light emission drive current Iem in the display pixel EM at jth column of first row in FIG. 20).

On the other hand, in the display pixel EM in which the gradation sequence signal (the no-light emission display voltage Vzero) in accordance with the no-light emission display operation is written, since the gate-to-source voltage (the opposite ends' potential Vc of the capacitor Cs) of the transistor for the light emission driving is set not more than the threshold value (0V), the light emission drive current Iem is not supplied to the light emission element (the organic EL element OEL) and this light emission element is held at the no-light emission state (refer to the light emission drive current Iem in the display pixel EM at jth column of second row in FIG. 20).

Such light emission operations (or the no-light emission operations) are simultaneously carried out in at least plural rows of the display pixels EM arranged on the display panel 110, preferably, to the all display pixels EM. Thereby, the predetermined image information on the basis of the image signal is displayed on the display panel 110.

In this way, according to the display unit and its display drive method of the embodiment, supplying the gradation sequence current Idata on the basis of the display data (the image signal) to each display pixel other than the case of the no-light emission display and controlling the light emission drive current to be supplied to the light emission element (the organic EL element) based on the display data held in accordance with this current value, it is possible to apply the drive control method of the current designation system to make the light emission element to perform the light emission operation at a predetermined luminance gradation sequence in accordance with the display data. In addition, both of the function (the current/voltage conversion function) to convert the current level of the gradation sequence current Idata into the voltage level by a single transistor (the drive transistor Tr 13) for the light emission driving provided to each display element and the function (the light emission drive function) to supply the light emission drive current Iem having a predetermined current value on the basis of the voltage level are provided. Therefore, it is possible to realize a desired light emission property stably for a long time without the affection such as variation of the operational property and the temporal change of the thin film transistor configuring the light emission drive circuit in each display pixel.

In addition, according to the display unit and its display driving method of the embodiment, the precharge operation and the voltage correction operation are carried out prior to the writing operation of the display data into each display pixel (the panel writing operation) and the light emission operation of the light emission element. Consequently, it is possible to set the transistor for the light emission driving at the state that the electric charges equivalent to the minimum luminance voltage having the voltage value, of which absolute value is larger than the absolute value of the threshold voltage of the transistor, is accumulated and held in advance between the gate and the source of the transistor for the light emission driving (the drive transistor Tr 13). As a result, in the writing operation of the display data, it is not necessary to charge the electric charges that is the voltage, of which absolute value is larger than the absolute value of the threshold voltage, between the gate and the source (the capacitor Cs) of the transistor for the light emission driving by the gradation sequence current Idata based on the display data. In addition, it is only necessary to add and accumulate (charge) only the voltage component Vdata in accordance with this display data (the gradation sequence current Idata) so as to be capable of quickly and appropriately writing the voltage component based on the display data.

Accordingly, even upon the low luminance gradation sequence display that the gradation sequence in accordance with the display data is very small, it is possible to quickly and appropriately write the voltage component based on the display data. As a consequence, it is possible to prevent the generation of the short of writing in each display element and the desired image information can be displayed at the appropriate luminance gradation sequence in accordance with the image signal.

In addition, upon the no-light emission display, by supplying the predetermined no-light emission display voltage Vzero based on the display data (the image signal) to each display pixel, it is possible to discharge almost all of the electric charges (the voltage components) held between the gate and the source (the capacitor Cs) of the transistor for the light emission driving. Therefore, by controlling the transistor for the light emission driving not to supply the light emission drive current to the light emission element (the organic EL element, the transistor can be set at the no-light emission state and the no-light emission operation can be realized well.

Further, according to the display unit and its display drive method, the precharge operation and the voltage correction operation are carried out simultaneously with respect to at least plural rows of the display pixels, preferably, the all display pixels in prior to the panel writing operation to write the display data in each display pixel arranged in the display panel. Accordingly, it is possible to hold the voltage component, of which absolute value is larger than the absolute value of the threshold voltage, between the gate and the source of the transistor for the light emission driving provided in each display pixel (the light emission drive circuit) for very short time. Therefore, the panel writing operation time period and the light emission operation time period for one frame time period (about 16.7 msec) that has been defined in advance can be set relatively long and it is possible to realize the image display of a good display image quality preventing deterioration of the light emission luminance.

According to the embodiment, the case that the drive control method shown in the second example is applied as the display drive method of the display unit and the voltage correction operation to accumulate the electric charges equivalent to the minimum luminance voltage (its absolute value is larger than the absolute value of the threshold voltage) in each display pixel (between the gate and the source of the transistor for the light emission driving) is carried out prior to the panel writing operation is described. However, the present invention is not limited to this. For example, as the drive control method shown in the first example, it is obvious that the threshold correction operation to accumulate the electric charges equivalent to the threshold voltage of the transistor for the light emission driving provided in each display pixel (the light emission drive circuit) may be carried out.

Figure 21:
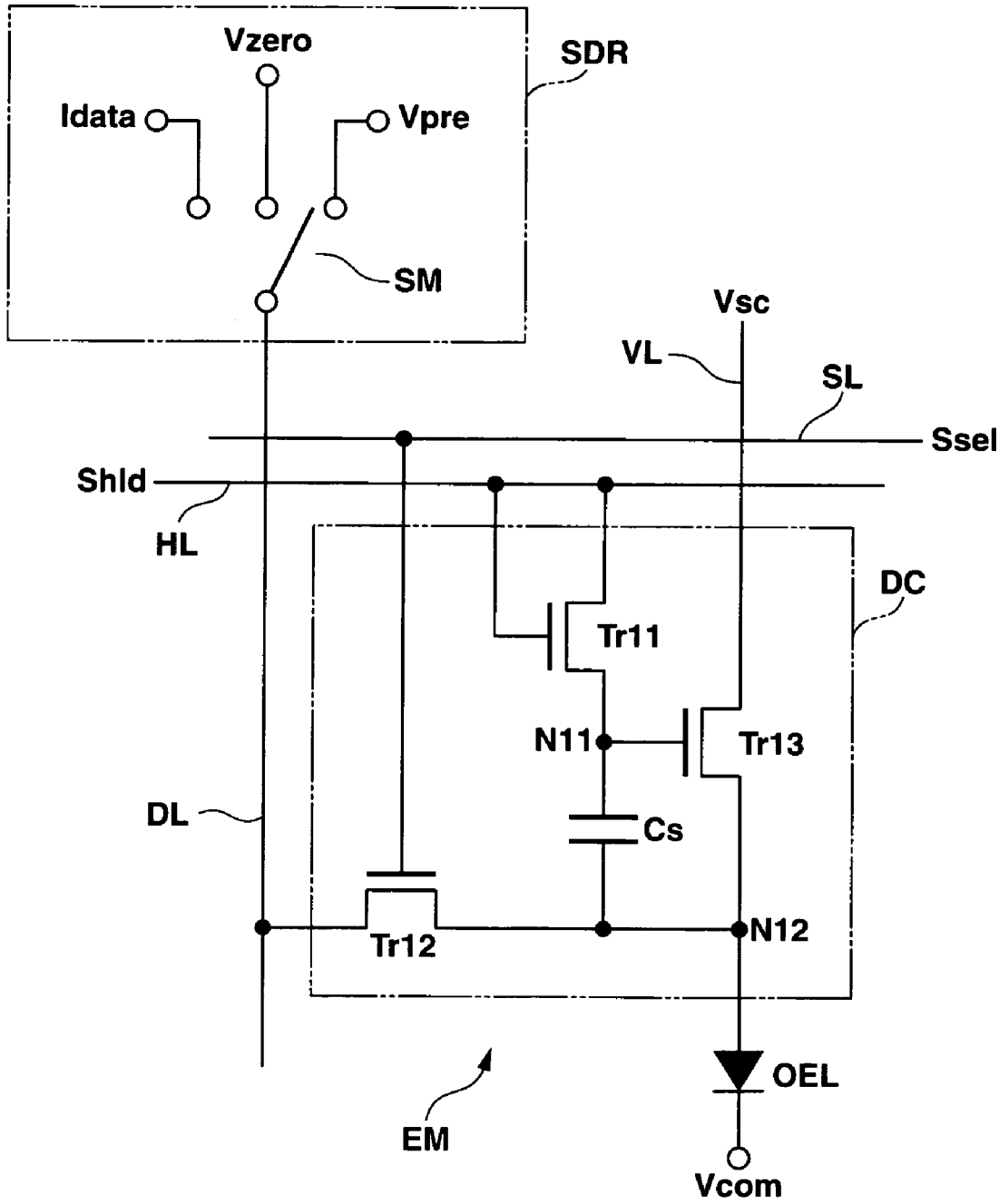
FIG. 21 is a circuit block diagram showing the other light emission drive circuit according to the embodiment.
Figure 22:
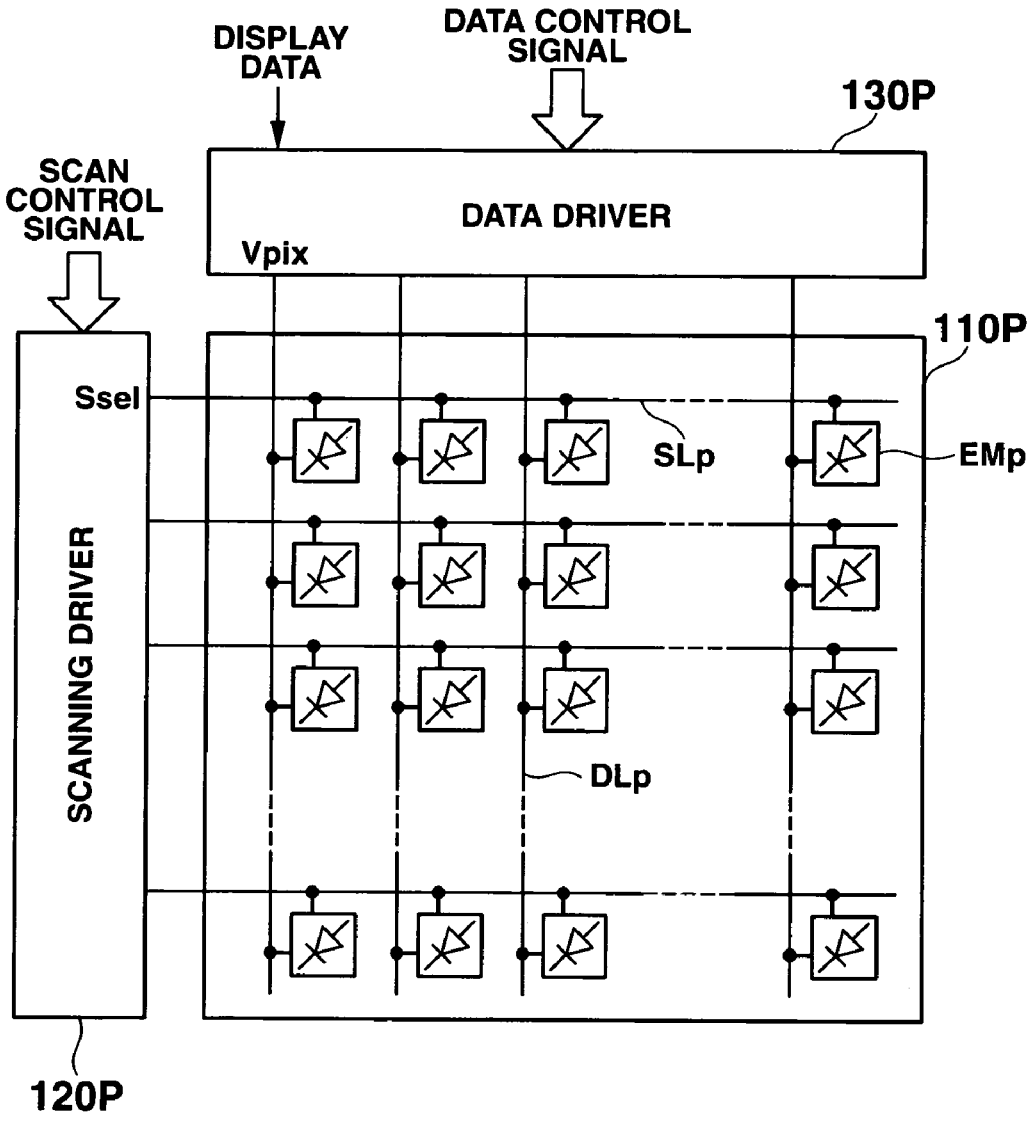
FIG.22 RELATED ART
FIG. 22 is a schematic block diagram showing the substantial parts of a light emission element type of a display according to a prior art.
Figure 23:
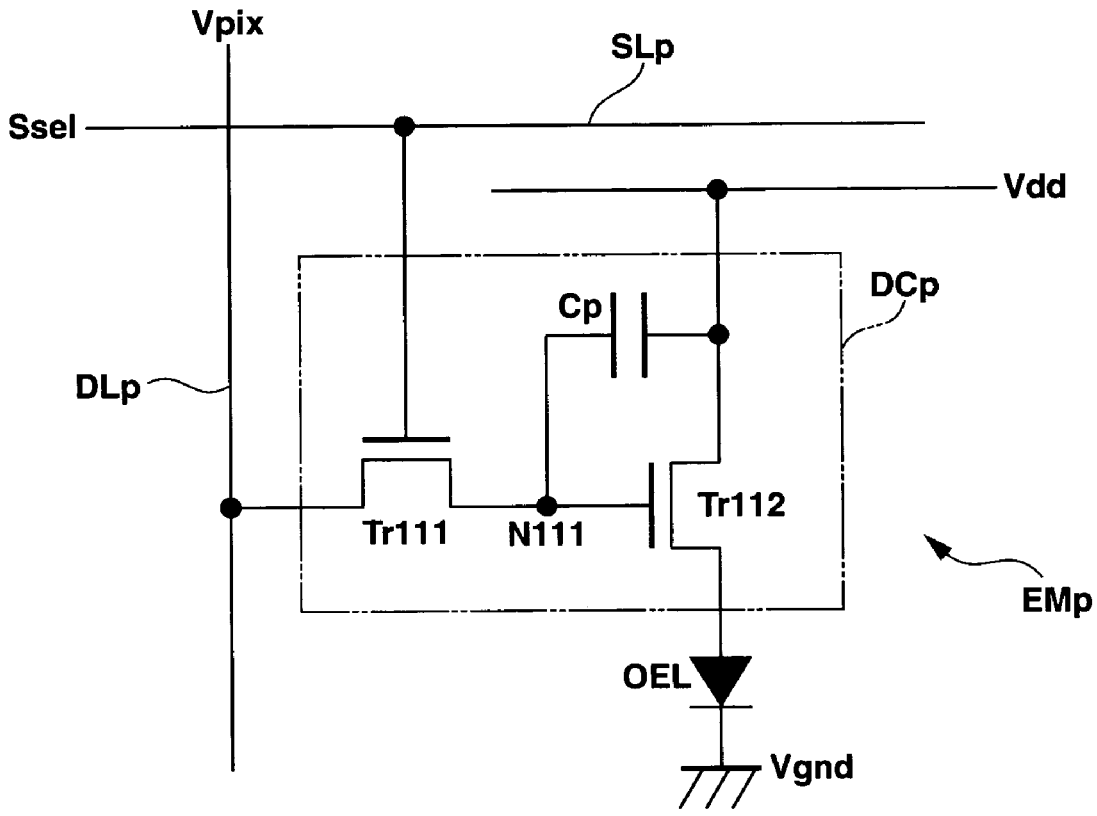
FIG.23 RELATED ART
FIG. 23 is an equivalent circuit diagram showing a constituent example of a light emission element (a light emission circuit and a light emission terminal) type of a display according to the prior art.

In the embodiment, the drain of the hold transistor Tr 11 of the light emission drive circuit DC is connected to the supplying voltage line VL. However, the present invention is not limited to this. As shown in FIG. 21, the drain can function in the same way even if the drain is connected to the hold line HL.

In addition, according to the embodiment, the no-light emission display voltage Vzero is the selection voltage value Vs. However, if the transistor for the light emission driving does not supply the current between the drain and the source even by the threshold variation when the potential of the supplying voltage Vsc is modulated from the selection voltage value Vs into the light emission voltage value Vs in the light emission operation time period Tem, the no-light emission display voltage Vzero may be not different form the selection voltage value Vs.

In the display unit according to the present embodiment, any of the hold transistor Tr 11, the selection transistor Tr 12, and the drive transistor Tr 13 is a thin film transistor of an n-channel amorphous silicon. However, it may be a polysilicon thin film transistor or all of them may be n-channel types or all of them may be p-channel types. In the case where all of them are p-channel types, it is only necessary that high and low at the on level and the off level of the signal are inversed.

What is claimed is:

1. A light emission circuit comprising:

a selection line;

a hold line;

a data line;

a supplying voltage line;

a hold transistor having a gate electrically connected to the hold line, and a current path;

a drive transistor having a gate and a current path, the gate of the drive transistor being electrically connected to a first end of the current path of the hold transistor and a first end of the current path of the drive transistor being connected to the supplying voltage line; and a selection transistor having a gate and a current path, the gate of the selection transistor being electrically connected to the selection line, a first end of the current path of the selection transistor being connected to a second end of the current path of the drive transistor, and a second end of the current path of the selection transistor being connected to the data line;

wherein the selection transistor is turned on by a first control signal from the selection line in a precharge time period, the hold transistor is turned on by a second control signal from the hold line, and a voltage having an absolute value that is larger than an absolute value of a threshold voltage of the drive transistor or a voltage exceeding a minimum luminance voltage necessary for generating a light emission drive current required for making a light emission element perform a light emission operation at a minimum luminance gradation sequence is provided to the drive transistor; and wherein the selection transistor is turned off by the first control signal from the selection line in a correction operation time period, and a voltage between the gate of the drive transistor and the second end of the current path of the drive transistor is set so as to decrease to the threshold voltage of the drive transistor or the minimum luminance voltage.

2. A display unit comprising:

a plurality of display pixels each of which includes a light emission element and a light emission drive circuit having an electric charge accumulating section for accumulating electric charges based on a gradation sequence signal to designate a luminance gradation sequence in accordance with display data, a light emission control section for generating a light emission drive current having a predetermined current value in accordance with the electric charges accumulated in the electric charge accumulating section and supplying the light emission drive current to the light emission element, a writing control section for controlling a supplying state of the electric charges based on the gradation sequence signal to the electric charge accumulating section, and a voltage control section for controlling a drive voltage for making the light emission control section perform the operation, respectively;

selection lines in which writing control signals for controlling the operation state of the writing control sections of the display pixels are applied;

hold lines in which voltage control signals for controlling the operation state of the voltage control sections of the display pixels are applied; and data lines to which the gradation sequence signals are supplied;

wherein in each of the display pixels:

the electric accumulating section includes a capacitance element;

the light emission control section includes a drive transistor, in which a first end side of a current path through which the light emission drive current flows is connected to the light emission element and is connected to a first end side of the capacitance element, a supplying voltage for flowing the light emission drive current is applied to a second end side of the current path, and a control terminal for controlling a supplying state of the light emission drive current is connected to a second end side of the capacitance element;

the writing control section includes a selection transistor, in which a first end side of a current path is connected to one of the data lines, a second end side of the current path is connected to the first end side of the capacitance element, and a control terminal is connected to one of the selection lines; and the voltage control section includes a hold transistor, in which one end side of a current path is connected to the second end side of the capacitance element, and a control terminal is connected to one of the hold lines.

3. The display unit according to claim 2, further comprising:

a selection driver which applies the writing control signals in the selection lines;

a hold driver which applies the voltage control signals in the hold lines; and a data driver which supplies the gradation sequence signals to the data lines.

4. The display unit according to claim 2, wherein the light emission control section generates the light emission drive current having the predetermined current value, wherein the drive transistor is turned on at a predetermined conducting state in accordance with a potential difference based on the electric charges accumulated in the capacitance element.

5. The display unit according to claim 2, further comprising a supplying voltage driver for applying the supplying voltage to the second end side of the current path of the drive transistor.

6. The display unit according to claim 5, wherein the supplying voltage driver applies the supplying voltage to the control element of the drive transistor.

7. The display unit according to claim 3, wherein, in each of the display pixels, the light emission drive circuit applies the gradation sequence signal applied from the data driver to the data line to the electric accumulating section via the writing control section.

8. The display unit according to claim 7, wherein the gradation sequence signal is a gradation sequence current having a predetermined current value for making the light emission element perform a light emission operation at a desired luminance gradation sequence based on the display data, and the electric charges in accordance with the gradation sequence current are accumulated in the electric accumulating section.

9. The display unit according to claim 7, wherein the gradation sequence signal is a gradation sequence voltage having a predetermined current value for making the light emission element perform a no-light emission operation based on the display data, and the electric charges accumulated in the electric accumulating section are discharged in accordance with the gradation sequence voltage.

10. The display unit according to claim 7, wherein the data driver selectively applies, as the gradation sequence signal, a gradation sequence current and a gradation sequence voltage to the data line;

wherein the gradation sequence current has a predetermined current value for making the light emission element perform a light emission operation at a desired luminance gradation sequence based on the display data, and the electric charges in accordance with the gradation sequence current are accumulated in the electric accumulating section; and wherein the gradation sequence voltage has a predetermined current value for making the light emission element perform a no-light emission operation based on the display data, and the electric charges accumulated in the electric accumulating section are discharged in accordance with the gradation sequence voltage.

11. A display unit comprising:

a plurality of display pixels each of which includes a light emission element and a light emission drive circuit having an electric charge accumulating section for accumulating electric charges based on a gradation sequence signal to designate a luminance gradation sequence in accordance with display data, a light emission control section for generating a light emission drive current having a predetermined current value in accordance with the electric charges accumulated in the electric charge accumulating section and supplying the light emission drive current to the light emission element, a writing control section for controlling a supplying state of the electric charges based on the gradation sequence signal to the electric charge accumulating section, and a voltage control section for controlling a drive voltage for making the light emission control section perform the operation, respectively;

selection lines in which writing control signals for controlling the operation state of the writing control sections of the display pixels are applied;

hold lines in which voltage control signals for controlling the operation state of the voltage control sections of the display pixels are applied;

data lines to which the gradation sequence signals are supplied;

a selection driver which applies the writing control signals in the selection lines;

a hold driver which applies the voltage control signals in the hold lines; and a data driver which supplies the gradation sequence signals to the data lines;

wherein, with respect to each of the display pixels, the data driver applies a precharge voltage exceeding a threshold value of the drive transistor to the data line, and the light emission drive circuit applies the precharge voltage applied to the data line to the electric charge accumulating section via the writing control section.

12. The display unit according to claim 11, wherein the light emission drive circuit partially discharges the electric charges accumulated in the electric charge accumulating section on the basis of the precharge voltage and maintains the electric charges equivalent to the threshold voltage of the drive transistor.

13. The display unit according to claim 11, wherein the precharge voltage and the gradation sequence signal applied from the data driver to the data line are applied in the electric charge accumulating section via the writing control section at different timings, respectively.

14. A display unit comprising:

a plurality of display pixels each of which includes a light emission element and a light emission drive circuit having an electric charge accumulating section for accumulating electric charges based on a gradation sequence signal to designate a luminance gradation sequence in accordance with display data, a light emission control section for generating a light emission drive current having a predetermined current value in accordance with the electric charges accumulated in the electric charge accumulating section and supplying the light emission drive current to the light emission element, a writing control section for controlling a supplying state of the electric charges based on the gradation sequence signal to the electric charge accumulating section, and a voltage control section for controlling a drive voltage for making the light emission control section perform the operation, respectively;

selection lines in which writing control signals for controlling the operation state of the writing control sections of the display pixels are applied;

hold lines in which voltage control signals for controlling the operation state of the voltage control sections of the display pixels are applied;

data lines to which the gradation sequence signals are supplied;

a selection driver which applies the writing control signals in the selection lines;

a hold driver which applies the voltage control signals in the hold lines; and a data driver which supplies the gradation sequence signals to the data lines;

wherein, with respect to each of the display pixels, the data driver applies a precharge voltage exceeding a minimum luminance value necessary for generating the light emission drive current required for making the light emission element perform a light emission operation at a minimum luminance gradation sequence to the data line, and the light emission drive circuit applies the precharge voltage applied to the data line to the electric charge accumulating section via the writing control section.

15. The display unit according to claim 14, wherein the light emission drive circuit partially discharges the electric charges accumulated in the electric charge accumulating section on the basis of the precharge voltage, maintains the electric charges equivalent to the minimum luminance electric charge, and holds this electric charge.

* * * * *